US011864622B2

(12) United States Patent
Amos et al.

(10) Patent No.: US 11,864,622 B2
(45) Date of Patent: Jan. 9, 2024

(54) GROUND-ENGAGING STRUCTURES FOR ARTICLES OF FOOTWEAR

(71) Applicant: NIKE, Inc., Beaverton, OR (US)

(72) Inventors: Michael S. Amos, Beaverton, OR (US); Lysandre Follet, Portland, OR (US); Thomas Foxen, Portland, OR (US); John Hurd, Lake Oswego, OR (US); Shane S. Kohatsu, Portland, OR (US); Troy C. Lindner, Portland, OR (US); Jonathan Rasca, McKinney, TX (US); Andrea Vinet, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/893,897

(22) Filed: Aug. 23, 2022

(65) Prior Publication Data

US 2022/0395054 A1 Dec. 15, 2022

Related U.S. Application Data

(60) Division of application No. 16/985,519, filed on Aug. 5, 2020, now Pat. No. 11,457,692, which is a (Continued)

(51) Int. Cl.
*A43B 5/06* (2022.01)
*A43B 13/12* (2006.01)
(Continued)

(52) U.S. Cl.
CPC ..... *A43B 13/122* (2013.01); *A43B 1/0009* (2013.01); *A43B 5/02* (2013.01);
(Continued)

(58) Field of Classification Search
CPC ..... A43B 1/0009; A43B 5/08; A43B 7/08; A43B 7/087; A43B 5/06
(Continued)

(56) References Cited

U.S. PATENT DOCUMENTS 124,127 A 2/1872 Gibson, Jr.
921,452 A 5/1909 Pierce
(Continued)

FOREIGN PATENT DOCUMENTS

CN 1921779 A 2/2007
CN 101278772 A 10/2008
(Continued)

OTHER PUBLICATIONS

Oct. 5, 2016—International Search Report—PCT/US2016/033502.
(Continued)

*Primary Examiner* — Marie D Bays
(74) *Attorney, Agent, or Firm* — Banner & Witcoff, Ltd.

(57) ABSTRACT

Ground-engaging components for articles of footwear include: (a) an outer perimeter boundary rim that at least partially defines an outer perimeter of the ground-engaging component, wherein the outer perimeter boundary rim defines an open space at least at a forefoot support area of the ground-engaging component; and (b) a matrix structure extending at least partially across the open space at least at the forefoot support area to define an open cellular construction with plural open cells in the open space at least at the forefoot support area. A plurality of these open cells of the open cellular construction have openings with curved perimeters and no distinct corners. Additional aspects of this invention relate to ground-engaging components that are very lightweight yet very stiff, particularly in the forefoot support area. Two or more sizes of the ground-engaging components may be provided with substantially constant forefoot stiffness (optionally substantially constant over a size run).

18 Claims, 20 Drawing Sheets

Related U.S. Application Data continuation of application No. 15/575,435, filed as application No. PCT/US2016/033502 on May 20, 2016, now Pat. No. 10,750,816.

(60) Provisional application No. 62/165,708, filed on May 22, 2015.

(51) Int. Cl.

| | |
|---|---|
| ***A43B 1/00*** | (2006.01) |
| ***A43B 13/18*** | (2006.01) |
| ***A43B 13/22*** | (2006.01) |
| ***A43C 15/16*** | (2006.01) |
| ***A43C 15/00*** | (2006.01) |
| ***A43B 5/02*** | (2006.01) |

(52) U.S. Cl.
CPC ..... *A43B 5/06* (2013.01); *A43B 13/186* (2013.01); *A43B 13/223* (2013.01); *A43C 15/00* (2013.01); *A43C 15/161* (2013.01)

(58) Field of Classification Search
USPC ..... 36/3 R, 3 B, 8.1
See application file for complete search history.

(56) References Cited

U.S. PATENT DOCUMENTS

| | | | | |
|---|---|---|---|---|
| 1,137,159 | A | 4/1915 | Meyer | |
| 1,918,639 | A | 7/1933 | Greentree | |
| 2,185,762 | A * | 1/1940 | Cox | A43B 5/08 D2/918 |
| 2,902,780 | A | 9/1959 | Bellew | |
| 3,383,782 | A * | 5/1968 | Mcginnity | A43B 3/30 36/9 R |
| 3,605,292 | A * | 9/1971 | Goldblatt | A43B 13/226 36/8.1 |
| 3,849,915 | A * | 11/1974 | Inohara | A43B 5/00 36/67 B |
| 3,918,181 | A | 11/1975 | Inohara | |
| 4,546,559 | A | 10/1985 | Dassler | |
| 4,559,724 | A | 12/1985 | Norton | |
| 5,044,096 | A * | 9/1991 | Polegato | A43B 13/12 36/3 R |
| 5,581,913 | A * | 12/1996 | Kataoka | A43B 5/06 36/129 |
| 6,508,015 | B1 * | 1/2003 | Rauch | A43B 7/06 36/3 R |
| 7,236,166 | B2 | 6/2007 | Zinniel et al. | |
| 7,367,141 | B2 * | 5/2008 | Polegato Moretti | A43B 13/16 36/59 R |
| 7,658,018 | B2 | 2/2010 | Lin et al. | |
| 8,276,294 | B2 * | 10/2012 | Polegato Moretti | A43B 13/12 36/3 R |
| 8,375,604 | B2 | 2/2013 | Eder et al. | |
| 8,745,892 | B2 * | 6/2014 | Polegato Moretti | B29D 35/122 36/3 R |
| 8,991,073 | B2 | 3/2015 | Moretti | |
| D821,074 | S | 6/2018 | Follet et al. | |
| 2002/0043008 | A1 | 4/2002 | Favreau | |
| 2002/0088140 | A1 * | 7/2002 | Wang | A43B 5/08 36/141 |
| 2005/0000116 | A1 | 1/2005 | Snow | |
| 2005/0172513 | A1 * | 8/2005 | Lechhart | A43B 7/125 36/3 R |
| 2006/0162183 | A1 | 7/2006 | Polegato Moretti | |
| 2007/0119074 | A1 | 5/2007 | Aveni et al. | |
| 2007/0130801 | A1 | 6/2007 | Wu | |
| 2007/0271815 | A1 * | 11/2007 | Moretti | A43B 23/0235 36/3 R |
| 2008/0060228 | A1 | 3/2008 | Morgan et al. | |
| 2009/0100716 | A1 | 4/2009 | Gerber | |
| 2009/0126230 | A1 | 5/2009 | McDonald et al. | |
| 2009/0172971 | A1 * | 7/2009 | Peikert | A43B 13/12 12/146 B |
| 2009/0188134 | A1 | 7/2009 | Polegato Moretti | |
| 2009/0193690 | A1 | 8/2009 | Moretti | |
| 2009/0277047 | A1 | 11/2009 | Polegato Moretti | |
| 2011/0167678 | A1 * | 7/2011 | Peikert | A43B 7/08 36/3 R |
| 2012/0036740 | A1 | 2/2012 | Gerber | |
| 2012/0151804 | A1 | 6/2012 | Polegato Moretti | |
| 2012/0151805 | A1 | 6/2012 | Polegato Moretti | |
| 2013/0118036 | A1 | 5/2013 | Gibson | |
| 2013/0139412 | A1 | 6/2013 | Auger et al. | |
| 2013/0340295 | A1 | 12/2013 | Adami et al. | |
| 2014/0182170 | A1 | 7/2014 | Wawrousek et al. | |
| 2014/0202042 | A1 | 7/2014 | Berend et al. | |
| 2015/0075034 | A1 * | 3/2015 | Cross | A43C 11/002 36/103 |
| 2015/0082669 | A1 * | 3/2015 | Peikert | A43B 7/08 36/30 R |
| 2015/0128452 | A1 | 5/2015 | Hull et al. | |
| 2015/0237958 | A1 * | 8/2015 | Cross | A43B 13/02 36/103 |
| 2015/0245685 | A1 * | 9/2015 | Cross | A43B 13/187 12/146 B |
| 2015/0245686 | A1 * | 9/2015 | Cross | A43B 13/28 36/29 |
| 2016/0219979 | A1 | 8/2016 | Wright | |
| 2017/0055634 | A1 | 3/2017 | Baucom et al. | |
| 2017/0224053 | A1 | 8/2017 | Truelsen et al. | |
| 2017/0238656 | A1 | 8/2017 | Hurd et al. | |
| 2017/0318904 | A1 | 11/2017 | McDonald et al. | |
| 2018/0146742 | A1 * | 5/2018 | Amos | A43C 15/165 |
| 2018/0146743 | A1 * | 5/2018 | Amos | A43B 3/0063 |
| 2018/0153264 | A1 * | 6/2018 | Amos | A43B 3/0063 |
| 2018/0192738 | A1 * | 7/2018 | Amos | A43C 15/005 |
| 2018/0206590 | A1 * | 7/2018 | Amos | A43B 13/223 |
| 2018/0317591 | A1 | 11/2018 | Hollinger et al. | |
| 2020/0077734 | A1 | 3/2020 | Bidal et al. | |
| 2021/0219666 | A1 | 7/2021 | Fedderly et al. | |
| 2022/0007765 | A1 | 1/2022 | Nystrom | |

FOREIGN PATENT DOCUMENTS

| | | | |
|---|---|---|---|
| CN | 101404905 | A | 4/2009 |
| CN | 204032509 | U | 12/2014 |
| CN | 105142450 | A | 12/2015 |
| EP | 1354528 | A1 | 10/2003 |
| JP | 2005304653 | A | 11/2005 |
| WO | 2014100462 | A1 | 6/2014 |
| WO | 2015052813 | A1 | 4/2015 |

OTHER PUBLICATIONS

Dec. 22, 2021—(EP) Partial ESR—App. No. 21197943.0.
Oct. 3, 2013—Larson, Peter "Mizuno Wave Universe 5 Review: A Feather-Light Racing Flat With a Roomy Toebox," URL: https://runblogger.com/2013/10/mizuno-wave-universe-5-review-feather.html (retrieved May 28, 2022), p. 2.
May 10, 2022—(EP) EESR—App. No. 21197943.0.

* cited by examiner

GROUND-ENGAGING STRUCTURES FOR ARTICLES OF FOOTWEAR

CROSS-REFERENCE TO RELATED APPLICATION

This application is a divisional of U.S. patent application Ser. No. 16/985,519, filed Aug. 5, 2020, which is a continuation of U.S. patent application Ser. No. 15/575,435, filed Nov. 20, 2017, now U.S. Pat. No. 10,750,816, which application is a U.S. National Stage application under 35 U.S.C. § 371 of International Application PCT/US2016/033502, filed May 20, 2016, which claims priority to U.S. Provisional Patent Application No. 62/165,708, titled "Ground-Engaging Structures for Articles of Footwear" and filed May 22, 2015. These applications, in their entirety, are incorporated by reference herein.

FIELD OF THE INVENTION

The present invention relates to the field of footwear. More specifically, aspects of the present invention pertain to articles of athletic footwear and/or ground-engaging structures for articles of footwear, e.g., used in track and field events and/or for sprint or other relatively short and fast running events (e.g., for 40 yd/m, 100 m, 200 m, 400 m, etc.).

Terminology/General Information

First, some general terminology and information is provided that will assist in understanding various portions of this specification and the invention(s) as described herein. As noted above, the present invention relates to the field of footwear. "Footwear" means any type of wearing apparel for the feet, and this term includes, but is not limited to: all types of shoes, boots, sneakers, sandals, thongs, flip-flops, mules, scuffs, slippers, sport-specific shoes (such as track shoes, golf shoes, tennis shoes, baseball cleats, soccer or football cleats, ski boots, basketball shoes, cross training shoes, etc.), and the like.

FIG. 1 also provides information that may be useful for explaining and understanding the specification and/or aspects of this invention. More specifically, FIG. 1 provides a representation of a footwear component 100, which in this illustrated example constitutes a portion of a sole structure for an article of footwear. The same general definitions and terminology described below may apply to footwear in general and/or to other footwear components or portions thereof, such as an upper, a midsole component, an outsole component, a ground-engaging component, etc.

First, as illustrated in FIG. 1, the terms "forward" or "forward direction" as used herein, unless otherwise noted or clear from the context, mean toward or in a direction toward a forward-most toe ("FT") area of the footwear structure or component 100. The terms "rearward" or "rearward direction" as used herein, unless otherwise noted or clear from the context, mean toward or in a direction toward a rear-most heel area ("RH") of the footwear structure or component 100. The terms "lateral" or "lateral side" as used herein, unless otherwise noted or clear from the context, mean the outside or "little toe" side of the footwear structure or component 100. The terms "medial" or "medial side" as used herein, unless otherwise noted or clear from the context, mean the inside or "big toe" side of the footwear structure or component 100.

Also, various example features and aspects of this invention may be disclosed or explained herein with reference to a "longitudinal direction" and/or with respect to a "longitudinal length" of a footwear component 100 (such as a footwear sole structure). As shown in FIG. 1, the "longitudinal direction" is determined as the direction of a line extending from a rearmost heel location (RH in FIG. 1) to the forwardmost toe location (FT in FIG. 1) of the footwear component 100 in question (a sole structure or foot-supporting member in this illustrated example). The "longitudinal length" L is the length dimension measured from the rearmost heel location RH to the forwardmost toe location FT. The rearmost heel location RH and the forwardmost toe location FT may be located by determining the rear heel and forward toe tangent points with respect to front and back parallel vertical planes VP when the component 100 (e.g., sole structure or foot-supporting member in this illustrated example, optionally as part of an article of footwear or foot-receiving device) is oriented on a horizontal support surface S in an unloaded condition (e.g., with no weight or force applied to it other than potentially the weight/force of the shoe components with which it is engaged). If the forwardmost and/or rearmost locations of a specific footwear component 100 constitute a line segment (rather than a tangent point), then the forwardmost toe location and/or the rearmost heel location constitute the mid-point of the corresponding line segment. If the forwardmost and/or rearmost locations of a specific footwear component 100 constitute two or more separated points or line segments, then the forwardmost toe location and/or the rearmost heel location constitute the mid-point of a line segment connecting the furthest spaced and separated points and/or furthest spaced and separated end points of the line segments (irrespective of whether the midpoint itself lies on the component 100 structure). If the forwardmost and/or rearwardmost locations constitute one or more areas, then the forwardmost toe location and/or the rearwardmost heel location constitute the geographic center of the area or combined areas (irrespective of whether the geographic center itself lies on the component 100 structure).

Once the longitudinal direction of a component or structure 100 has been determined with the component 100 oriented on a horizontal support surface S in an unloaded condition, planes may be oriented perpendicular to this longitudinal direction (e.g., planes running into and out of the page of FIG. 1). The locations of these perpendicular planes may be specified based on their positions along the longitudinal length L where the perpendicular plane intersects the longitudinal direction between the rearmost heel location RH and the forwardmost toe location FT. In this illustrated example of FIG. 1, the rearmost heel location RH is considered as the origin for measurements (or the "0L position") and the forwardmost toe location FT is considered the end of the longitudinal length of this component (or the "1.0L position"). Plane position may be specified based on its location along the longitudinal length L (between 0L and 1.0L), measured forward from the rearmost heel RH location in this example. FIG. 1 shows locations of various planes perpendicular to the longitudinal direction (and oriented in the transverse direction) and located along the longitudinal length L at positions 0.25L, 0.4L, 0.5L, 0.55L, 0.6L, and 0.8L (measured in a forward direction from the rearmost heel location RH). These planes may extend into and out of the page of the paper from the view shown in FIG. 1, and similar planes may be oriented at any other desired positions along the longitudinal length L. While these planes may be parallel to the parallel vertical planes VP used to determine the rearmost heel RH and forwardmost toe FT locations, this is not a requirement. Rather, the orientations of the perpendicular planes along the longitudinal length L will depend on the orientation of the longitudinal direction, which may or may not be parallel to the horizontal surface S in the arrangement/orientation shown in FIG. 1.

Also, the following footwear sizing information is applicable to footwear structures described below:

TABLE OF MEN'S/BOY'S SHOE SIZES

| U.S. Size | Europe Size | UK Size | Length (inches) | Length (cm) |
|---|---|---|---|---|
| 4.5 | 36 | 3.5 | 9 | 22.9 |
| 5 | 37 | 4 | 9.125 | 23.2 |
| 5.5 | 37 | 4.5 | 9.25 | 23.5 |
| 6 | 39 | 5.5 | 9.25 | 23.5 |
| 6.5 | 39 | 6 | 9.5 | 24.1 |
| 7 | 40 | 6.5 | 9.625 | 24.4 |
| 7.5 | 40-41 | 7 | 9.75 | 24.8 |
| 8 | 41 | 7.5 | 9.938 | 25.2 |
| 8.5 | 41-42 | 8 | 10.125 | 25.7 |
| 9 | 42 | 8.5 | 10.25 | 26 |
| 9.5 | 42-43 | 9 | 10.438 | 26.5 |
| 10 | 43 | 9.5 | 10.563 | 26.8 |
| 10.5 | 43-44 | 10 | 10.75 | 27.3 |
| 11 | 44 | 10.5 | 10.938 | 27.8 |
| 11.5 | 44-45 | 11 | 11.125 | 28.3 |
| 12 | 45 | 11.5 | 11.25 | 28.6 |
| 13 | 46 | 12.5 | 11.563 | 29.4 |
| 14 | 47 | 13.5 | 11.875 | 30.2 |
| 15 | 48 | 14.5 | 12.188 | 31 |
| 16 | 49 | 15.5 | 12.5 | 31.8 |

TABLE OF WOMEN'S/GIRL'S SHOE SIZES

| U.S. Size | Europe Size | UK Size | Length (inches) | Length (cm) |
|---|---|---|---|---|
| 4 | 35 | 2 | 8.188 | 20.8 |
| 4.5 | 35 | 2.5 | 8.375 | 21.3 |
| 5 | 35-36 | 3 | 8.5 | 21.6 |
| 5.5 | 36 | 3.5 | 8.75 | 22.2 |
| 6 | 36-37 | 4 | 8.875 | 22.5 |
| 6.5 | 37 | 4.5 | 9.063 | 23 |
| 7 | 37-38 | 5 | 9.25 | 23.5 |
| 7.5 | 38 | 5.5 | 9.375 | 23.8 |
| 8 | 38-39 | 6 | 9.5 | 24.1 |
| 8.5 | 39 | 6.5 | 9.688 | 24.6 |
| 9 | 39-40 | 7 | 9.875 | 25.1 |
| 9.5 | 40 | 7.5 | 10 | 25.4 |
| 10 | 40-41 | 8 | 10.188 | 25.9 |
| 10.5 | 41 | 8.5 | 10.313 | 26.2 |
| 11 | 41-42 | 9 | 10.5 | 26.7 |
| 11.5 | 42 | 9.5 | 10.688 | 27.1 |
| 12 | 42-43 | 10 | 10.875 | 27.6 |

SUMMARY

This Summary is provided to introduce some concepts relating to this invention in a simplified form that are further described below in the Detailed Description. This Summary is not intended to identify key features or essential features of the invention.

While potentially useful for any desired types or styles of shoes, aspects of this invention may be of particular interest for athletic shoes, including track shoes or shoes for sprint and/or other relatively fast and short running events (e.g., for 40 yd/m, 100 m, 200 m, 400 m, etc.).

Some aspects of this invention relate to ground-engaging components, such as sole plates, for articles of footwear that include: (a) an outer perimeter boundary rim (e.g., at least 3 mm wide (0.12 inches) or 6 mm wide (0.24 inches)) that at least partially defines an outer perimeter of the ground-engaging component/sole plate (the outer perimeter boundary rim may be present around at least 80% or at least 90% of the outer perimeter of the ground-engaging component/sole plate), wherein the outer perimeter boundary rim defines an upper-facing surface and a ground-facing surface opposite the upper-facing surface, wherein the outer perimeter boundary rim defines an open space at least at a forefoot support area of the ground-engaging component/sole plate (and optionally over the arch support area and/or heel support area as well), and wherein the outer perimeter boundary rim may be sized and shaped so as to support an entire plantar surface of a wearer's foot; and (b) a matrix structure (also called a "support structure" herein) extending from the outer perimeter boundary rim (e.g., from the ground-facing surface and/or the upper-facing surface) and at least partially across the open space at least at the forefoot support area to define an open cellular construction with plural open cells across the open space at least at the forefoot support area, wherein a plurality (e.g., at least a majority (and in some examples, at least 55%, at least 60%, at least 70%, at least 80%, at least 90%, or even at least 95%)) of the open cells of the open cellular construction have openings with curved perimeters and no distinct corners (e.g., round, elliptical, and/or oval shaped openings).

In at least some example structures in accordance with aspects of this invention, the matrix structure further may define one or more partially open cells located within the open space and/or one or more closed cells (e.g., cells located beneath and/or at the ground-facing surface of the outer perimeter boundary rim). The open space and/or the matrix structure may extend to all areas of the ground-engaging component/sole plate inside its outer perimeter boundary rim (e.g., from front toe area to rear heel area, from medial side edge to lateral side edge, etc.).

Additionally or alternatively, if desired, the matrix structure may define one or more cleat support areas for engaging or supporting primary traction elements, such as track spikes or other cleat elements (e.g., permanently fixed cleats or track spikes, removable cleats or track spikes, integrally formed cleats or track spikes, etc.). The cleat support area(s) may be located: (a) within the outer perimeter boundary rim (e.g., on its ground-facing surface), (b) at least partially within the outer perimeter boundary rim (e.g., at least partially within its ground-facing surface), (c) within the open space, (d) extending from the outer perimeter boundary rim into and/or across the open space, and/or (e) between a lateral side of the outer perimeter boundary rim and a medial side of the outer perimeter boundary rim.

The matrix structure further may define a plurality of secondary traction elements at various locations, e.g., dispersed around one or more of any present cleat support areas; between open cells, partially open cells, and/or closed cells of the matrix structure; at the outer perimeter boundary rim; at "corners" of the matrix structure; etc. As some more specific examples, the matrix structure may define at least four secondary traction elements dispersed around at least some individual open and/or partially open cells of the open cellular construction, and optionally, six secondary traction elements may be disposed around at least some of the individual open and/or partially open cells (e.g., in a generally hexagonal arrangement of secondary traction elements). At least some of the plurality of individual open cells that include secondary traction elements dispersed around them may be located at a medial forefoot support area, a central forefoot support area, a lateral forefoot support area, a first metatarsal head support area, a forward toe support area, and/or a heel area of the ground-engaging component. In some more specific examples, at least 30% of individual open and/or partially open cells of the open cellular construction (and in some examples, at least 40%, at least 50%, or even at least 60% of individual open and/or partially open cells) each will include a plurality of secondary traction elements dispersed around a periphery of that individual open and/or partially open cell. Such cells may include at least four secondary traction elements or even six (or at least six) secondary traction elements arranged around them (e.g., arranged in a generally hexagonal arrangement around the individual cell).

While primary traction elements may be provided at any desired locations on ground-engaging components/sole plates in accordance with this invention, in some example structures the cleat support areas for primary traction elements will be provided at least at two or more of the following: (a) a first cleat support area (and optionally with an associated primary traction element) at, near, or at least partially in a lateral side of the ground-facing surface of the outer perimeter boundary rim; (b) a second cleat support area (and optionally with an associated primary traction element) between the lateral side of the ground-facing surface of the outer perimeter boundary rim and a medial side of the ground-facing surface of the outer perimeter boundary rim; (c) a third cleat support area (and optionally with an associated primary traction element) between the second cleat support area and the medial side of the ground-facing surface of the outer perimeter boundary rim; and/or (d) a fourth cleat support area (and optionally with an associated primary traction element) at, near, or at least partially in the medial side of the ground-facing surface of the outer perimeter boundary rim. Although some ground-engaging components/sole plates according to some aspects of this invention may include only these four cleat support areas (and associated primary traction elements), more or fewer cleat support areas (and primary traction elements associated therewith) may be provided, if desired. Also, if desired, open cells of the matrix structure may be located between adjacent cleat mount areas (e.g., so that the matrix structure extends contiguously around and between at least some of the cleat mount areas).

Any one or more of the cleat support areas may include a cleat mount area for engaging a primary traction element, such as a track spike or other cleat. If desired, in accordance with at least some examples of this invention, the cleat support areas and/or the cleat mount areas of at least some of the cleat support areas (e.g., the first, second, and third cleat support areas described above) may be "substantially aligned" or even "highly substantially aligned." As another more specific example, in ground-engaging components/sole plates that include the first, second, and third cleat support areas and/or the first, second, and third cleat mount areas "substantially aligned" or "highly substantially aligned," these components may be "substantially aligned" or "highly substantially aligned" in the forefoot support area of the ground-engaging component/sole plate along a line that extends from a rear lateral direction toward a forward medial direction of the ground-engaging component/sole plate. When present, the fourth cleat support area mentioned above (and/or any cleat mount area for engaging a primary traction element included with it) may be located rearward from the line along which the first, second, and third cleat support areas (and/or their associated cleat mount areas) are "substantially aligned" or "highly substantially aligned." Additionally or alternatively, if desired, the first, second, third, and fourth cleat support areas noted above (and/or any associated cleat amount areas) may substantially lie along a smooth curve that extends across the forefoot support area. Components of these types (e.g., cleats mount areas and/or cleat support areas) are considered to be "substantially aligned," as that term is used herein in this context, if the geographical centers of the objects in question (e.g., the centers or points of the primary traction elements) lie on a straight line and/or within a distance of 10 mm (0.39 inches) from a straight line. "Highly substantially aligned" objects each have their geographic centers (e.g., the centers or points of the primary traction elements) lying on a straight line and/or within a distance of 5 mm (0.2 inches) from a straight line.

Matrix structures in accordance with at least some examples of this invention may include at least one set of open and/or partially open cells, wherein geographical centers of at least three cells of this first set of "at least partially open cells" are "substantially aligned" or "highly substantially aligned" (the term "at least partially open cells" means one or more of partially open cells and/or open cells, which terms will be explained in more detail below). Optionally, the geographic centers (e.g., centers of openings) of at least three cells (and in some examples, at least four cells or even at least six cells) of a "substantially aligned" or "highly substantially aligned" set of cells will be located in the forefoot support area, along a line that extends from a rear lateral direction toward a forward medial direction of the ground-engaging component/sole plate and/or article of footwear in which it may be contained. Open or partially open cells are considered to be "substantially aligned," as that term is used herein in this context, if the geographical centers (e.g., centers of openings) of each of the cells in question lie on a straight line and/or within a distance of 10 mm (0.39 inches) from a straight line. "Highly substantially aligned" cells each have their geographic centers (e.g., centers of openings) lying on a straight line and/or within a distance of 5 mm (0.2 inches) from a straight line.

Matrix structures in accordance with at least some examples of this invention also may include two or more sets of open and/or partially open cells, wherein geographical centers of at least three cells within the respective sets are substantially aligned or highly substantially aligned with a straight line for that set (and optionally substantially aligned or highly substantially aligned with a straight line that extends from the rear lateral direction toward the forward medial direction of the ground-engaging component/sole plate and/or sole structure). Some matrix structures in accordance with this aspect of the invention may include from 2 to 20 sets of substantially aligned cells and/or highly substantially aligned cells, or even from 3-15 sets of substantially aligned cells and/or highly substantially aligned cells. When multiple sets of substantially aligned cells and/or highly substantially aligned cells are present in a matrix structure, the aligned or highly aligned sets of cells may be separated from one another along the front-to-back and/or longitudinal direction of the ground-engaging component/sole plate and/or sole structure.

As some even more specific examples, the matrix structure further may define a set of open and/or partially open cells located immediately rearward and/or immediately forward of the first, second, and third cleat support areas and/or cleat mount areas noted above. The geographical centers (e.g., centers of openings) of at least three open and/or partially open cells of either or both of these sets of open and/or partially open cells may be substantially aligned or highly substantially aligned, optionally along a line that extends from the rear lateral direction toward the forward medial direction of the ground-engaging component/sole plate. One or more additional sets of substantially aligned or highly substantially aligned open cells and/or partially open cells may be provided at other locations and/or other orientations around the ground-engaging component/sole plate structure (with each "set" including at least three substantially aligned or highly substantially aligned open cells and/or partially open cells). As some even more specific examples, ground-engaging components/sole plate structures in accordance with at least some examples of this invention further may include: (a) from 1-8 additional sets of three or more substantially aligned or highly substantially aligned open cells and/or partially open cells rearward of the first, second, and third cleat support areas and/or cleat mount areas noted above and/or (b) from 1-8 additional sets of three or more substantially aligned or highly substantially aligned open cells and/or partially open cells forward of the first, second, and third cleat support areas and/or cleat mount areas noted above. Optionally, if desired, the geographical centers (e.g., centers of openings) of the at least three open and/or partially open cells of any one or more of these sets of open and/or partially open cells may be substantially aligned or highly substantially aligned along a line that extends from a rear lateral direction toward a forward medial direction of the ground-engaging components/sole plate structures.

As noted above, the matrix structure in at least some ground-engaging components/sole plates in accordance with this invention will define secondary traction elements, e.g., at corners defined by the matrix structure. In some ground-engaging components/sole plates according to this invention, the matrix structure will define at least one cluster of at least ten secondary traction elements located within a 35 mm diameter circle, and in some examples, within a 30 mm diameter circle or even within a 25 mm diameter circle. These clusters may be located at various places in the sole structure to increase the traction and/or potentially the local stiffness at that area (because the secondary traction elements increase the z-height (thickness) of the matrix at the local area, this increased z-height can increase stiffness at that local area). As some more specific examples, one or more clusters of at least 10 secondary traction elements as described above may be provided at a location along a medial side of the ground-engaging component/sole plate rearward of a first metatarsal head support area of the ground-engaging component/sole plate (e.g., rearward of the rearward most medial side primary traction element) and forward of a heel support area of the ground-engaging component/sole plate. Additionally or alternatively, a cluster of this type could be provided in the medial side forefoot support area, e.g., between two medial side primary traction elements, and/or in the arch support area.

Another aspect of this invention relates to ground-engaging components/sole plates for articles of footwear that include: (a) an outer perimeter boundary rim that at least partially defines an outer perimeter of the ground-engaging component/sole plate, wherein the outer perimeter boundary rim defines an upper-facing surface and a ground-facing surface opposite the upper-facing surface, and wherein the outer perimeter boundary rim defines an open space at least at a forefoot support area of the ground-engaging component/sole plate; and (b) a matrix structure extending from the outer perimeter boundary rim (e.g., from the ground-facing surface (and optionally integrally formed with the ground-facing surface) and/or from the upper-facing surface (and optionally integrally formed with the upper-facing surface)) and extending at least partially across the open space at least at the forefoot support area to define an open cellular construction with plural open cells across the open space at least at the forefoot support area. These example ground-engaging components/sole plates may further include at least one of the following sets of properties:

| Property Set | Size Range (inches) | Weight (grams) |
|---|---|---|
| A | 9 to 9.25 | Less than 60 grams |
| B | 9.25 to 9.5 | Less than 62 grams |
| C | 9.5 to 9.75 | Less than 64 grams |
| D | 9.75 to 10.125 | Less than 68 grams |
| E | 10.125 to 10.438 | Less than 71 grams |
| F | 10.438 to 10.75 | Less than 75 grams |
| G | 10.75 to 11.125 | Less than 78 grams |
| H | 11.125 to 11.41 | Less than 82 grams |
| I | 11.41 to 11.72 | Less than 88 grams |
| J | 11.72 to 12.03 | Less than 94 grams |
| | | Size/Weight Ratio (inches/grams) |
| K | 9 to 9.25 | At least 0.145 |
| L | 9.25 to 9.5 | At least 0.145 |
| M | 9.5 to 9.75 | At least 0.145 |
| N | 9.75 to 10.125 | At least 0.14 |
| O | 10.125 to 10.438 | At least 0.14 |
| P | 10.438 to 10.75 | At least 0.135 |
| Q | 10.75 to 11.125 | At least 0.135 |
| R | 11.125 to 11.41 | At least 0.13 |
| S | 11.41 to 11.72 | At least 0.125 |
| T | 11.72 to 12.03 | At least 0.12 |

The "size range" in this Table corresponds to a longitudinal length L of the ground-engaging component/sole plate, the "weight" corresponds to the weight of the outer perimeter boundary rim and the matrix structure of the ground-engaging component/sole plate alone, excluding any separately engaged cleats, spikes, or other primary traction elements, and the "size/weight ratio" corresponds to a ratio of the longitudinal length of the ground-engaging component (in inches) with the weight (in grams). The ground-engaging component/sole plate may extend to support an entire plantar surface of a wearer's foot.

The ground-engaging components/sole plates according to this aspect of the invention may have any one or more of the features for the ground-engaging components/sole plates described above, including any one or more features relating to the outer perimeter boundary rim, the cleat support area(s), the cleat mount area(s), the primary traction element (s), the secondary traction element(s), the open cell and/or partially open cell structures, the "substantially aligned" or "highly substantially aligned" features, etc.

Still additional aspects of this invention relate to sets of ground-engaging components/sole plates of different sizes, e.g., having any of the structures and/or features described above. These sets of ground-engaging components/sole plates will include at least two ground-engaging components/sole plates having standard sizes at least ±two standard sizes different from one another. The matrix structures of these ground-engaging components/sole plates differ from one another and are structured and arranged with respect to their respective outer perimeter boundary rims so that the two ground-engaging components/sole plates of the set will have forefoot stiffnesses within ±10% of one another (e.g., when measured under the same/comparable measurement conditions).

The "set" further may include a third ground-engaging component/sole plate having a standard size at least ±two standard sizes different from the other two standard sizes, wherein the matrix structure of the third ground-engaging component/sole plate differs from the other two and is structured and arranged with respect to the outer perimeter boundary rim of the third component/plate so that the third ground-engaging component/sole plate will have a forefoot stiffness within ±10% of that of the first and/or second components/plates mentioned above (e.g., when measured under the same/comparable measurement conditions). One or more additional ground-engaging components/sole plates having different matrix structures may be provided in the set (and optionally at least two standard sizes different from the other components/plates of the set), wherein the matrix structures of these additional ground-engaging components/sole plates may be structured and arranged with respect to their respective outer perimeter boundary rims so that the additional ground-engaging components/sole plates will have forefoot stiffnesses within ±10% of that of at least one other (and optionally all) components/plates in the set (e.g., when measured under the same/comparable measurement conditions). In this manner, all of the ground-engaging components/sole plates of the set may have substantially the same forefoot stiffness features of other plates in the set (e.g., within ±10% of one another and/or within ±10% of at least one plate of the set).

As noted above, in this aspect of the invention, the ground-engaging components/sole plates of the set that are at least two standard sizes different from the other ground-engaging components/sole plates of the set will have different matrix structures. If desired, however, the set further may include ground-engaging components/sole plates at ±one standard size different from another component/plate in the set. The components/plates sized at ±one standard size different from another component/plate in the set may have matrix structures and/or boundary rim structures that are "scaled up" or "scaled down" versions from another plate in the set. As even more specific examples, the size 7 plate may be a scaled down version of the size 8 plate or it may be a scaled up version of the size 6 plate.

As another option/example feature, one plate size can be used for more than one standard shoe size. For example, the ½ sized shoes may use the same plate size as one of the corresponding whole sizes surrounding it. As more specific examples, a 5½ size shoe may use the plate for a size 5 or a size 6 shoe (and the size 5 plate may be a scaled down version of the size 6 plate, e.g., with the same general matrix structure (except for the scaling)). The ±one standard size plates and/or the ½ size plates in the set may have substantially the same forefoot stiffness features as the other plates in the set (e.g., within ±10% of one another and/or within ±10% of at least one other plate of the set).

Additional aspects of this invention relate to articles of footwear that include an upper and a sole structure engaged with the upper. The sole structure will include a ground-engaging component/sole plate having any one or more of the features described above and/or any combinations of features described above. The upper may be made from any desired upper materials and/or upper constructions, including upper materials and/or upper constructions as are conventionally known and used in the footwear art (e.g., especially upper materials and/or constructions used in track shoes or shoes for sprint or other relatively short and fast running events (e.g., for 40 yd/m, 100 m, 200 m, 400 m, etc.)). As some more specific examples, at least a portion (or even a majority, all, or substantially all) of the upper may include a woven textile component and/or a knitted textile component (and/or other lightweight constructions).

Articles of footwear in accordance with at least some examples of this invention will not include an external midsole component (e.g., located outside of the upper). Rather, in at least some examples of this invention, the sole structure will consist essentially of the ground-engaging component/sole plate, and the article of footwear will consist essentially of an upper (and its one or more component parts, including any laces or other securing system components and/or an interior insole or sock liner component) with the ground-engaging component/sole plate engaged with it. Some articles of footwear according to aspects of this invention will include the upper-facing surface of the ground-engaging component/sole plate directly engaged with the upper (e.g., with a bottom surface or strobel of the upper). Optionally, the bottom surface of the upper (e.g., a strobel) may include a component with desired colors or other graphics to be displayed through the open cells of the matrix structure.

If desired, in accordance with at least some examples of this invention, at least some portion(s) of a bottom surface of the upper (e.g., the strobel) may be exposed and/or visible at an exterior of the shoe structure. As some more specific examples, the bottom surface of the upper may be exposed/visible: (a) in the open space of the ground-engaging component/sole plate (e.g., at least in the forefoot support area through open cells and/or partially open cells in any present matrix structure, etc.); (b) in the arch support area of the sole structure (e.g., through open cells and/or partially open cells in any present matrix structure, etc.); and/or (c) in the heel support area of the sole structure (e.g., through open cells and/or partially open cells in any present matrix structure, etc.).

Additional aspects of this invention relate to methods of making ground-engaging support components/sole plates, sole structures, and/or articles of footwear of the various types and structures described above.

BRIEF DESCRIPTION OF THE DRAWINGS

The foregoing Summary, as well as the following Detailed Description, will be better understood when read in conjunction with the accompanying drawings in which like reference numerals refer to the same or similar elements in all of the various views in which that reference number appears.

The reader should understand that the attached drawings are not necessarily drawn to scale.

DETAILED DESCRIPTION

In the following description of various examples of footwear structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures and functions without departing from the scope of the present invention. Additionally, the terms "ground-engaging component" and "sole plate" are used throughout and interchangeably in this application. One skilled in the art will understand that a "sole plate," as used herein, is a type of ground-engaging component for an article of footwear. Unless otherwise noted or clear from the context, any feature or other information described with respect to a "ground-engaging component" also could be used with or applied to a "sole plate," and/or any feature or other information described with respect to a "sole plate" also could be used with or applied to other "ground-engaging components."

Figure 1:
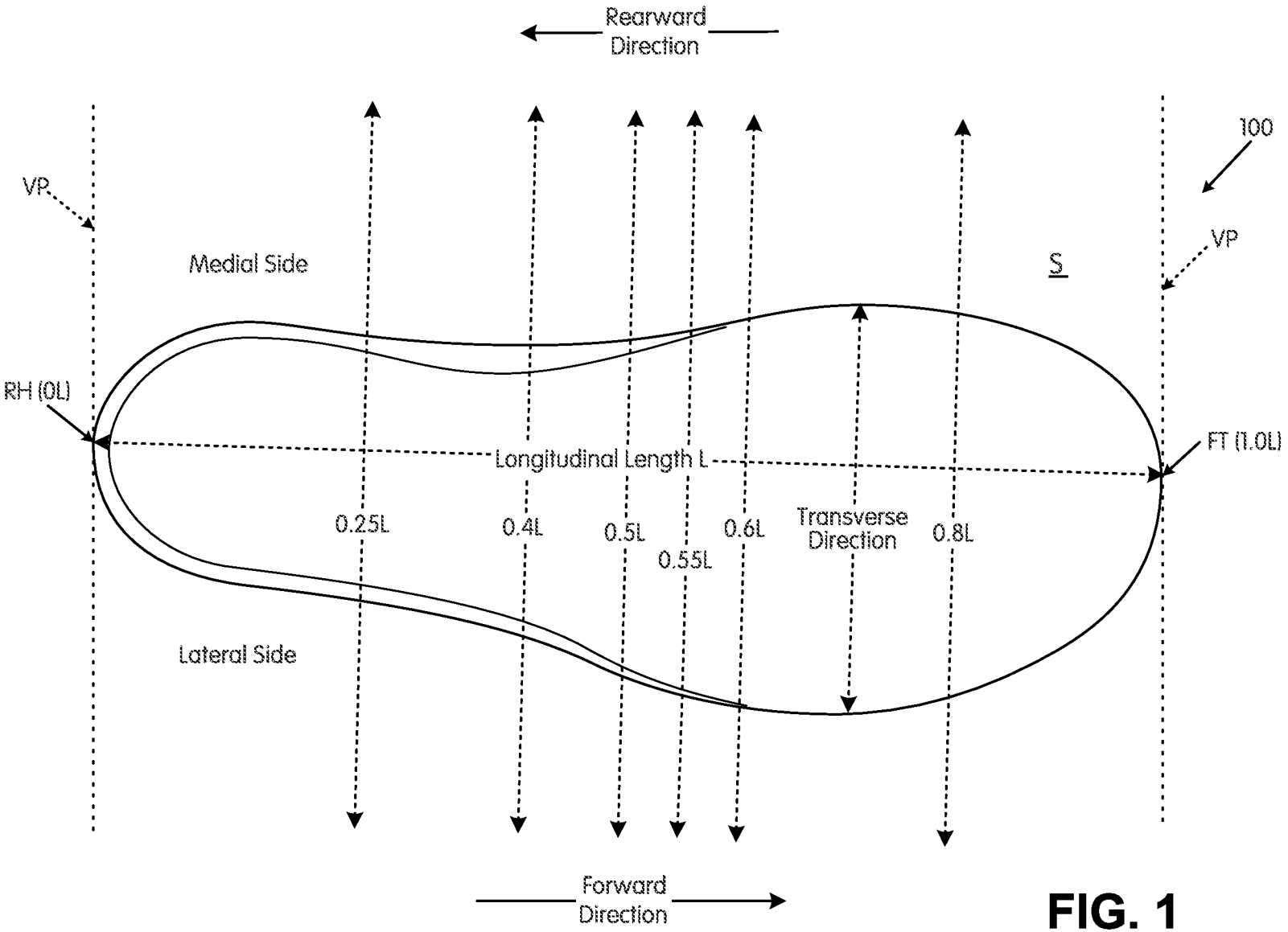
FIG. 1 is provided to help illustrate and explain background and definitional information useful for understanding certain terminology and aspects of this invention.
Figure 2A:
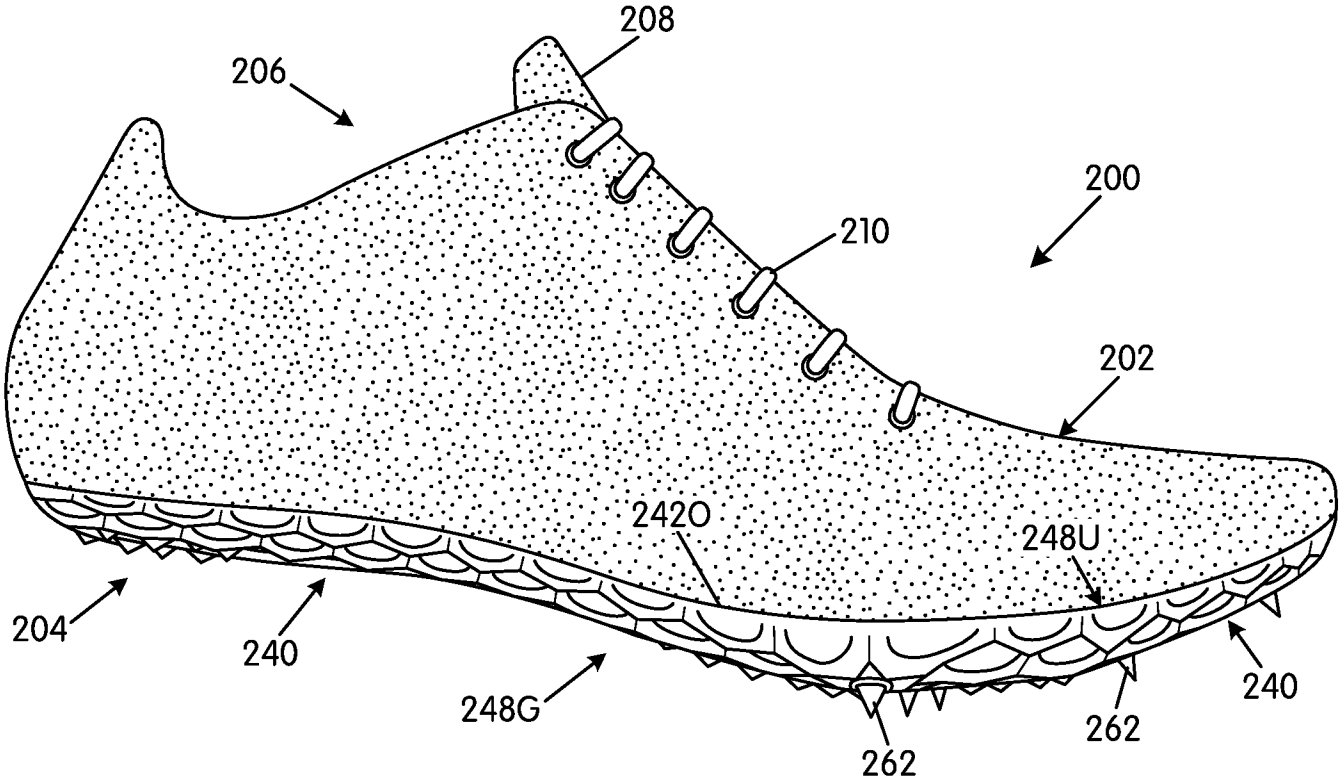
FIGS. 2A-2D provide a lateral side view, a bottom view, an enlarged bottom view around a cleat mount area, and an enlarged perspective view around a cleat mount area, respectively, of an article of footwear in accordance with at least some aspects of this invention.
Figure 2B:
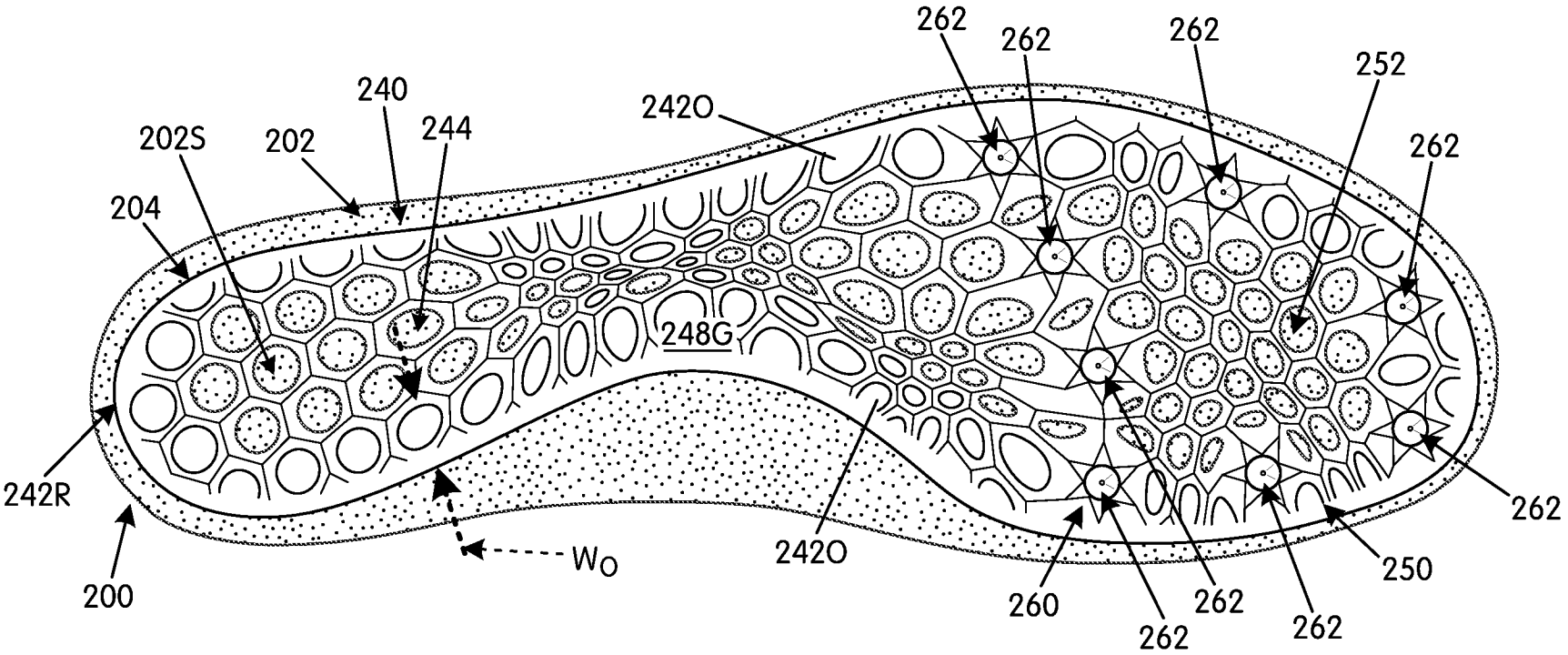

FIGS. 2A and 2B provide lateral side and bottom views, respectively, of an article of footwear 200 in accordance with at least some aspects of this invention. This example article of footwear 200 is a track shoe, and more specifically, a track shoe targeted for sprints or other relatively short distance runs, such as 40 yd/m, 100 m, 200 m, 400 m, etc. Aspects of this invention, however, also may be used in shoes for other distance runs and/or other types of uses or athletic activities. The article of footwear 200 includes an upper 202 and a sole structure 204 engaged with the upper 202. The upper 202 and sole structure 204 may be engaged together in any desired manner, including in manners conventionally known and used in the footwear arts (such as by adhesives or cements, by stitching or sewing, by mechanical connectors, etc.).

The upper 202 of this example includes a foot-receiving opening 206 that provides access to an interior chamber into which the wearer's foot is inserted. The upper 202 further includes a tongue member 208 located across the foot instep area and positioned so as to moderate the feel of the closure system 210 (which in this illustrated example constitutes a lace type closure system).

As mentioned above, the upper 202 may be made from any desired materials and/or in any desired constructions and/or manners without departing from this invention. As some more specific examples, at least a portion of the upper 202 (and optionally a majority, all, or substantially all of the upper 202) may be formed as a woven textile component and/or a knitted textile component. The textile components for upper 202 may have structures and/or constructions like those provided in FLYKNIT® brand footwear and/or via FLYWEAVE™ technology available in products from NIKE, Inc. of Beaverton, OR.

Additionally or alternatively, if desired, the upper 202 construction may include uppers having foot securing and engaging structures (e.g., "dynamic" and/or "adaptive fit" structures), e.g., of the types described in U.S. Patent Appln. Publn. No. 2013/0104423, which publication is entirely incorporated herein by reference. As some additional examples, if desired, uppers and articles of footwear in accordance with this invention may include foot securing and engaging structures of the types used in FLYWIRE® Brand footwear available from NIKE, Inc. of Beaverton, Oregon Additionally or alternatively, if desired, uppers and articles of footwear in accordance with this invention may include fused layers of upper materials, e.g., uppers of the types included in NIKE's "FUSE" line of footwear products. As still additional examples, uppers of the types described in U.S. Pat. Nos. 7,347,011 and/or 8,429,835 may be used without departing from this invention (each of U.S. Pat. Nos. 7,347,011 and 8,429,835 is entirely incorporated herein by reference).

The sole structure 204 of this example article of footwear 200 now will be described in more detail. As shown in FIGS. 2A and 2B, the sole structure 204 of this example includes one main component, namely a ground-engaging component or sole plate 240, optionally engaged with the bottom surface 202S (e.g., a strobel member) and/or side surface of the upper 202 via adhesives or cements, mechanical fasteners, sewing or stitching, etc. The ground-engaging component 240 of this example has its rearmost extent 242R located at a rear heel support area. The ground-engaging component 240 of this example extends to support an entire plantar surface of the wearer's foot.

Notably, in this illustrated example, no external or internal midsole component (e.g., a foam material, a fluid-filled bladder, etc.) is provided. In this manner, the shoe/sole plate will absorb little energy from the user when racing, and the vast majority of the force applied to the shoe by the runner will be transferred to the contact surface (e.g., the track or ground). If desired, an interior insole component (or sock liner) may be provided to enhance the comfort of the shoe. Alternatively, if desired, a midsole component could be provided and located between (a) a bottom surface 202S of the upper 202 (e.g., a strobel member) and (b) the ground-engaging component 240. Preferably, the midsole component, if any, will be thin, lightweight component, such as one or more of: one or more foam material parts, one or more fluid-filled bladders, one or more mechanical shock-absorbing components, etc.

In this illustrated example, a bottom surface 202S of the upper 202 is exposed and/or visible at an exterior of the sole structure 204 substantially throughout the bottom of the sole structure 204 (and may be exposed over more than 30%, more than 40%, more than 50%, more than 60%, and even more than 75% of the bottom surface area of the sole structure 204). As shown in FIG. 2B, the bottom surface 202S of the upper 202 is exposed at the forefoot support area, the arch support area, and/or the heel support area (through open cells 252 or any partially open cells 254 of the ground-engaging component 240 (also called the "open space" 244 herein) described in more detail below).

Example ground-engaging components 240 for sole structures 204/articles of footwear 200 in accordance with this invention now will be described in more detail with reference to FIGS. 2A through 2C. As shown, these example ground-engaging components 240 include an outer perimeter boundary rim 242O, for example, that may be at least 3 mm (0.12 inches) wide (and in some examples, is at least 4 mm (0.16 inches) wide, at least 6 mm (0.24 inches) wide, or even at least 8 mm (0.32 inches) wide). This "width" Wo is defined as the direct, shortest distance from one (e.g., exterior) edge of the outer perimeter boundary rim 242O to its opposite (e.g., interior) edge by the open space 244, as shown in FIG. 2B. While FIG. 2B shows this outer perimeter boundary rim 242O extending completely and continuously around and defining 100% of an outer perimeter of the ground-engaging component 240, other options are possible. For example, if desired, there may be one or more breaks in the outer perimeter boundary rim 242O at the outer perimeter of the ground-engaging component 240 such that the outer perimeter boundary rim 242O is present around only at least 75%, at least 80%, at least 90%, or even at least 95% of the outer perimeter of the ground-engaging component 240. The outer perimeter boundary rim 242O may have a constant or changing width Wo over the course of its perimeter.

FIG. 2B further shows that the outer perimeter boundary rim 242O of the ground-engaging component 240 defines an open space 244 at least at a forefoot support area of the ground-engaging component 240, and in this illustrated example, the open space 244 extends into and through the arch support area and the heel support area of the ground-engaging component 240. The rearmost extent 242R of the outer perimeter boundary rim 242O of these examples is located within the heel support area, and optionally at a rear heel support area and/or rearmost heel RH location of the ground-engaging component 240. The ground-engaging component 240 may fit and be fixed to a bottom surface 202S and/or side surface of the upper 202, e.g., by cements or adhesives, by mechanical connectors, by stitching, etc.

The ground-engaging component 240 of this example is shaped so as to extend completely across the forefoot support area of the sole structure 204 from the lateral side to the medial side. In this manner, the outer perimeter boundary rim 242O forms the medial and lateral side edges of the sole structure 204 at least at the forefoot medial and forefoot lateral sides and around the front toe area. The ground-engaging component 240 also may extend completely across the sole structure 204 from the lateral side edge to the medial side edge at other areas of the sole structure 204, including throughout the longitudinal length of the sole structure 204. In this manner, the outer perimeter boundary rim 242O may form the medial and lateral side edges of the bottom of the sole structure 204 throughout the sole structure 204, if desired.

Figure 2D:
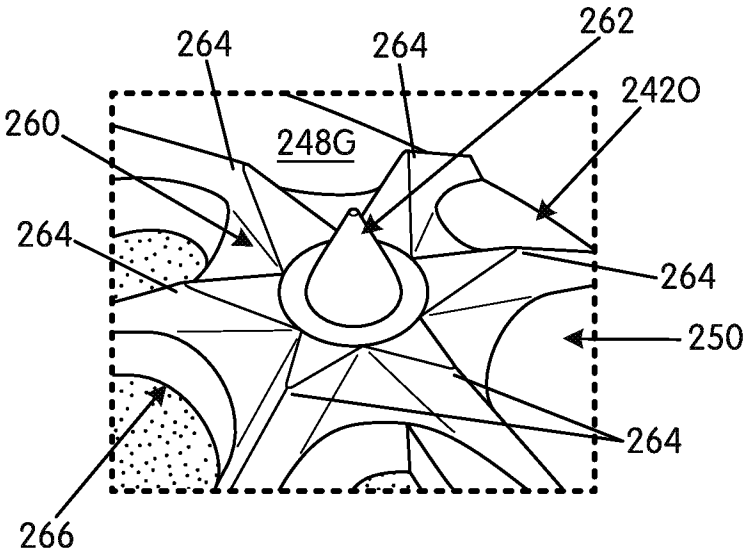
Figure 2C:
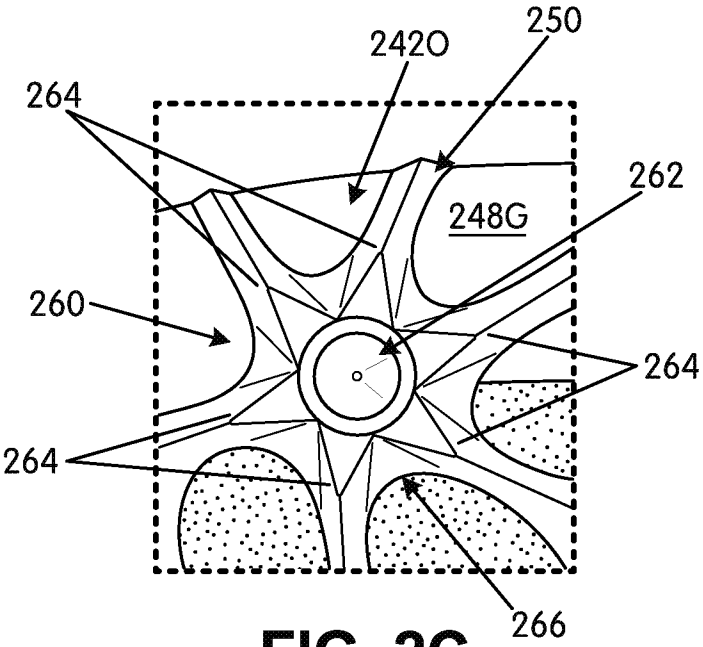

The outer perimeter boundary rim 242O of this illustrated example ground-engaging component 240 defines an upper-facing surface 248U (e.g., see FIG. 2A) and a ground-facing surface 248G (e.g., as shown in FIGS. 2B-2C) opposite the upper-facing surface 248U. The upper-facing surface 248U provides a surface for supporting the wearer's foot and/or engaging the upper 202 (and/or optionally engaging any present midsole component 220). The outer perimeter boundary rim 242O may provide a relatively large surface area for securely supporting a plantar surface of a wearer's foot. Further, the outer perimeter boundary rim 242O may provide a relatively large surface area for securely engaging another footwear component (such as the bottom surface 202S of the upper 202), e.g., a surface for bonding via adhesives or cements, for supporting stitches or sewn seams, for supporting mechanical fasteners, etc.

FIGS. 2B and 2C further illustrate that the ground-engaging component 240 of this example sole structure 204 includes a support structure 250 that extends from the outer perimeter boundary rim 242O into and at least partially across (and optionally completely across) the open space 244. The top surface of this example support structure 250 at locations within the open space 244 lies flush with and/or smoothly transitions into the outer perimeter boundary rim 242O to provide a portion of the upper-facing surface 248U (and may be used for the purposes of the upper-facing surface 248U as described above).

The support structure 250 of these examples extends from the ground-facing surface 248G of the outer perimeter boundary rim 242O to define at least a portion of the ground-facing surface 248G of the ground-engaging component 240. In the illustrated examples of FIGS. 2A-2C, the support structure 250 includes a matrix structure (also labeled 250 herein) extending from the ground-facing surface 248G of the outer perimeter boundary rim 242O and into, partially across, or fully across the open space 244 to define a cellular construction. The illustrated matrix structure 250 defines at least one of: (a) one or more open cells located within the open space 244, (b) one or more partially open cells located within the open space 244, and/or (c) one or more closed cells, e.g., located beneath the outer perimeter boundary rim 242O. An "open cell" constitutes a cell in which the perimeter of the cell opening is defined completely by the matrix structure 250 (note, for example, cells 252 in FIG. 2B). A "partially open cell" constitutes a cell in which one or more portions of the perimeter of the cell opening are defined by the matrix structure 250 within the open space 244 and one or more other portions of the perimeter of the cell opening are defined by another structure, such as the outer perimeter boundary rim 242O. A "closed cell" may have the outer matrix structure 250 but no opening (e.g., it may be formed such that the portion of the matrix 250 that would define the cell opening is located under the outer perimeter boundary rim 242O). As shown in FIG. 2B (as well as other figures described in more detail below), in the illustrated example matrix structure 250, at least 50% of the open cells 252 of the open cellular construction (and optionally, at least 60%, at least 70%, at least 80%, at least 90%, or even at least 95%) have openings with curved perimeters and no distinct corners (e.g., round, elliptical, and/or oval shaped openings as viewed at least from the upper-facing surface 248U). The open space 244 and/or matrix structure 250 may extend to all areas of the ground-engaging component 240 within the outer perimeter boundary rim 242O.

As further shown in FIGS. 2B-2D (as well as other figures described below), the matrix structure 250 further defines one or more primary traction element or cleat support areas 260. Eight separate cleat support areas 260 are shown in the examples of FIGS. 2A-2C, with: (a) three primary cleat support areas 260 on the medial side of the ground-engaging component 240 (one at or near a medial forefoot support area or medial midfoot support area of the ground-engaging component 240, one forward of that one in the medial forefoot support area, and one forward of that one at the medial toe support area); (b) three primary cleat support areas 260 on the lateral side of the ground-engaging component 240 (one at or near a lateral forefoot support area or lateral midfoot support area of the ground-engaging component 240, one forward of that one in the lateral forefoot support area, and one forward of that one at the lateral toe support area); and (c) two primary cleat support areas 260 in the central forefoot area (e.g., between the rearmost lateral side cleat support area 260 and the rearmost medial side cleat support area 260). Primary traction elements, such as track spikes 262 or other cleats, may be engaged or integrally formed with the ground-engaging component 240 at the cleat support areas 260 (e.g., with one cleat or track spike 262 provided per cleat support area 260). The cleats or track spikes 262 (also called "primary traction elements" herein) may be permanently fixed at the cleat mount areas in their associated cleat support areas 260, such as by in-molding the cleats or track spikes 262 into the cleat support areas 260 when the matrix structure 250 is formed (e.g., by molding). In such structures, the cleat or track spike 262 may include a disk or outer perimeter member that is embedded in the material of the cleat support area 260 during the molding process. As another alternative, the cleats or track spikes 262 may be removably mounted to the ground-engaging component 240 at the cleat mount areas, e.g., by a threaded type connector, a turnbuckle type connector, or other removable cleat/spike structures as are known and used in the footwear arts. Hardware or other structures for mounting the removable cleats may be integrally formed in the cleat support area 260 or otherwise engaged in the cleat support area 260 (e.g., by in-molding, adhesives, or mechanical connectors).

The cleat support areas 260 can take on various structures without departing from this invention. In the illustrated example, the cleat support areas 260 are defined by and as part of the matrix structure 250 as a thicker portion of matrix material located within or partially within the outer perimeter boundary rim 242O and/or located within the open space 244. As various options, if desired, one or more of the cleat support areas 260 may be defined in one or more of the following areas: (a) solely in the outer perimeter boundary rim 242O, (b) partially in the outer perimeter boundary rim 242O and partially in the open space 244, and/or (c) completely within the open space 244 (and optionally located at or adjacent the outer perimeter boundary rim 242O). When multiple cleat support areas 260 are present in a single ground-engaging component 240, all of the cleat support areas 260 need not have the same size, construction, and/or orientation with respect to the outer perimeter boundary rim 242O and/or open space 244 (although they all may have the same size, construction, and/or orientation, if desired).

While other constructions are possible, in this illustrated example (e.g., see FIGS. 2B-2D), the cleat support areas 260 are formed as generally hexagonal shaped areas of thicker material into which or at which at least a portion of the cleat/spike 262 and/or mounting hardware will be fixed or otherwise engaged. The cleat support areas 260 are integrally formed as part of the matrix structure 250 in this illustrated example. The illustrated example further shows that the matrix structure 250 defines a plurality of secondary traction elements 264 dispersed around the cleat support areas 260. While other options and numbers of secondary traction elements 264 are possible, in this illustrated example, a secondary traction element 264 is provided at each of the six corners of the generally hexagonal structure making up the cleat support area 260 (such that each cleat support area 260 has six secondary traction elements 264 dispersed around it). The secondary traction elements 264 of this example are raised, sharp points or pyramid type structures made of the matrix 250 material and raised above a base surface 266 of the generally hexagonal cleat support area 260. The free ends of the primary traction elements 262 extend beyond the free ends of the secondary traction elements 264 (in the cleat extension direction and/or when the shoe 200 is positioned on a flat surface) and are designed to engage the ground first. Note FIG. 2D. If the primary traction elements 262 sink a sufficient depth into the contact surface (e.g., a track, the ground, etc.), the secondary traction elements 264 then may engage the contact surface and provide additional traction to the wearer. In an individual cleat mount area 260 around a single primary traction element 262, the points or peaks of the immediately surrounding secondary traction elements 264 that surround that primary traction element 262 may be located within 1.5 inches (3.8 cm) (and in some examples, within 1 inch (2.5 cm) or even within 0.75 inch (1.9 cm)) of the peak or point of the surrounded primary traction element 262 in that mount area 260.

In at least some examples of this invention, the outer perimeter boundary rim 242O and the support structure 250 extending into/across the open space 244 may constitute an unitary, one-piece construction. The one-piece construction can be formed from a polymeric material, such as a PEBAX® brand polymer material or a thermoplastic polyurethane material. As another example, if desired, the ground-engaging component 240 may be made as multiple parts (e.g., split at the forward-most toe area, split along the front-to-back direction, and/or split or separated at other areas), wherein each part includes one or more of: at least a portion of the outer perimeter boundary rim 242O and at least a portion of the support structure 250. As another option, if desired, rather than an unitary, one-piece construction, one or more of the outer perimeter boundary rim 242O and the support structure 250 individually may be made of two or more parts. The material of the matrix structure 250 and ground-engaging component 240 in general may be relatively stiff, hard, and/or resilient so that when the ground-engaging component 240 flexes in use (e.g., when sprinting), the material tends to return (e.g., spring) the component 240 back to or toward its original shape and structure when the force is removed or sufficiently relaxed (e.g., as occurs during a step cycle when the foot is lifting off the ground).

Figure 3:
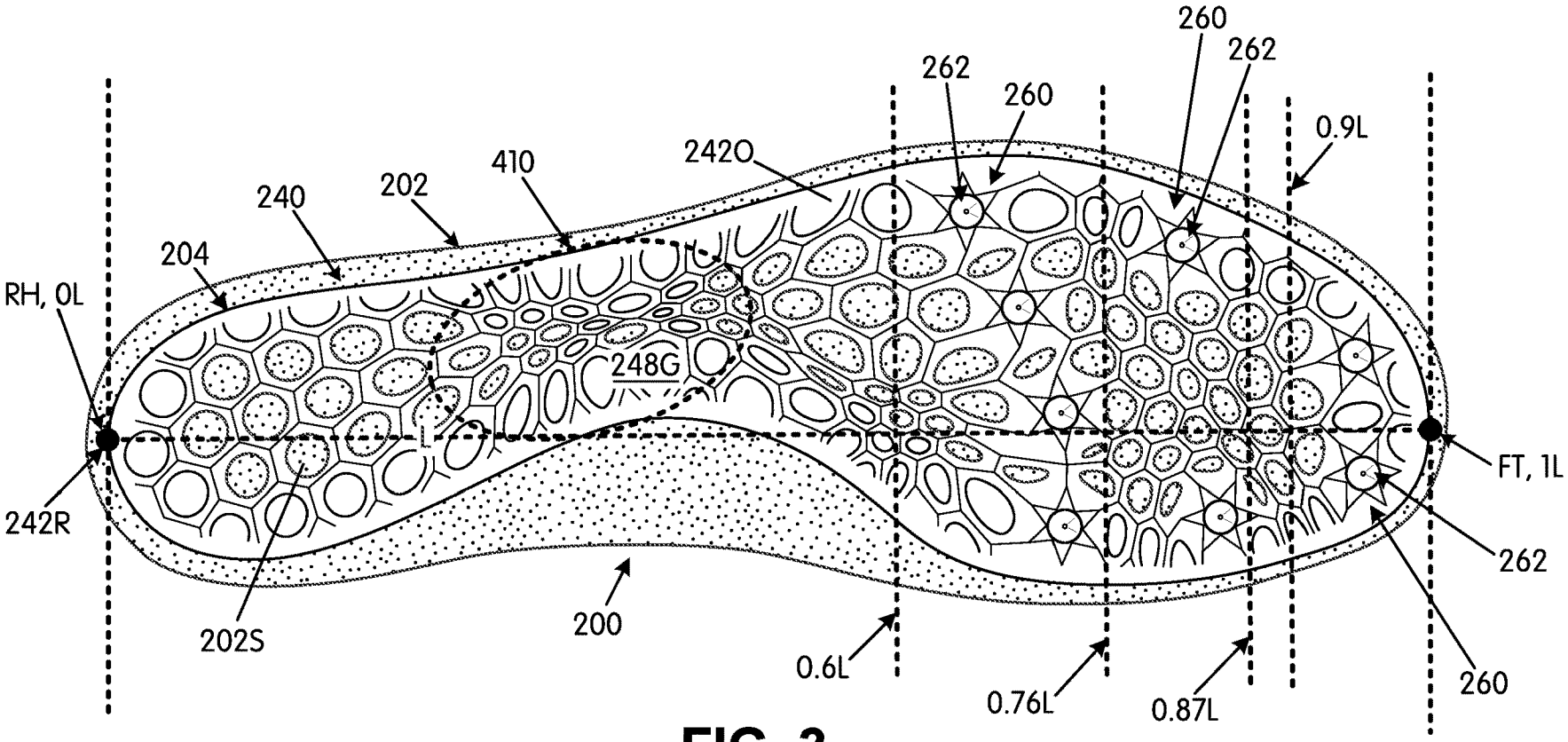
FIG. 3 provides a bottom view similar to FIG. 2B and is provided to illustrate additional potential features of ground-engaging components in accordance with some examples of this invention.

FIG. 3 is provided to illustrate additional features that may be present in ground-engaging components 240 and/or articles of footwear 200 in accordance with at least some aspects of this invention. FIG. 3 is a view similar to that of FIG. 2B with the rear heel RH and forward toe FT locations of the sole structure 204 identified and the longitudinal length L and direction identified. Planes perpendicular to the longitudinal direction (and going into and out of the page) are shown, and the locations of various footwear 200 and/or ground-engaging component 240 features are described with respect to these planes. For example, FIG. 3 illustrates that the rear-most extent 242R of the ground-engaging component 240 is located at 0L. In some examples of this invention, however, this rear-most extent 242R of the ground-engaging component 240 may be located within a range of 0L and 0.12L, and in some examples, within a range of 0L to 0.1L or even 0L to 0.075L based on the overall sole structure 204's and/or the overall footwear 200's longitudinal length L.

FIG. 3 further shows potential primary traction element attachment locations for various primary traction elements 262 and their mount areas 260. For example, FIG. 3 illustrates that the rear-most primary traction element mount areas 260 (e.g., of the rear-most four mount areas 260 described above and shown in FIGS. 2B and 3) may be located between planes located at 0.6L and 0.76L. If desired, center locations (or points) of two or more (e.g., four to six) primary traction elements 262 may be located within this range of 0.6L to 0.76L. FIG. 3 further shows that a central pair of primary traction element mount areas 260 (one on the lateral side and one on the medial side) may be located between planes located at 0.76L and 0.87L. If desired, center locations (or points) of two (or more, e.g., four to six) primary traction elements 262 may be located within this range of 0.76L to 0.87L. Additionally, FIG. 3 shows that a forward-most pair of primary traction element mount areas 260 (one on the lateral side and one on the medial side) may be located between planes located at 0.9L and 1.0L. If desired, center locations (or points) of two (or more, e.g., four to six) primary traction elements 262 may be located within this range of 0.9L to 1.0L. More or fewer mount areas 260 and/or primary traction elements 262 may be provided at the various noted locations and ranges and/or other locations without departing from this invention. All of these plane locations are based on the overall longitudinal length L of the sole structure 204 and/or the footwear structure 200.

In at least some examples of this invention, the centers or points of all of the primary traction elements 262 (or at least all forefoot primary traction elements 262) may be located forward of a plane located at 0.5L, and in some examples, forward of a plane located at 0.55L or even 0.6L (based on the overall longitudinal length L of the sole structure 204 and/or the footwear structure 200).

FIG. 3 further illustrates that the forward-most extent of the outer perimeter boundary rim 242O is located at 1.0L (at the forward-most toe location FT of the sole structure 204). This forward-most extent of the outer perimeter boundary rim 242O, however, may be located at other places, if desired, such as within a range of 0.90L and 1.0L, and in some examples, within a range of 0.92L to 1.0L (based on the overall longitudinal length L of the sole structure 204 and/or the footwear structure 200).

Figure 4B:
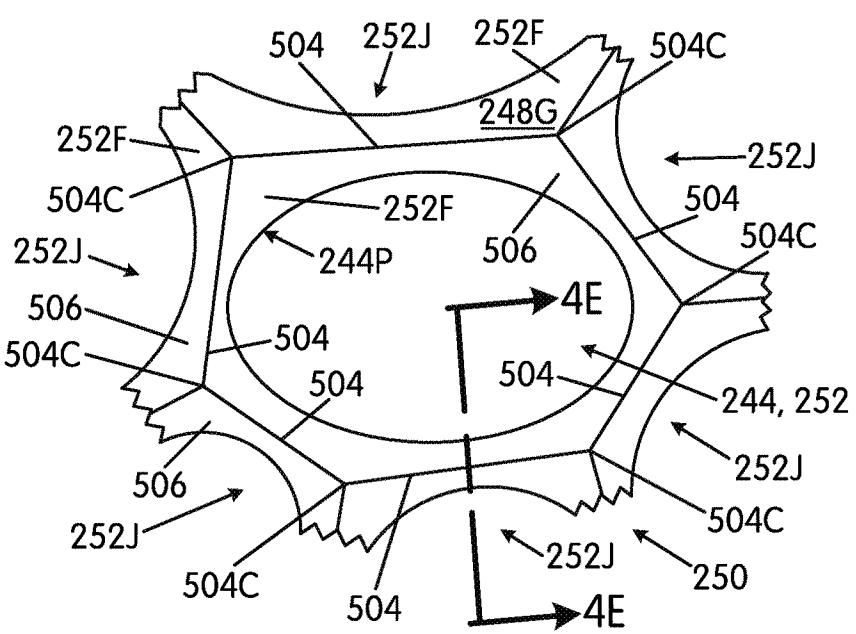
FIGS. 4A-4H provide various views to illustrate additional features of the ground-engaging component's support structure in accordance with some example features of this invention.
Figure 4A:
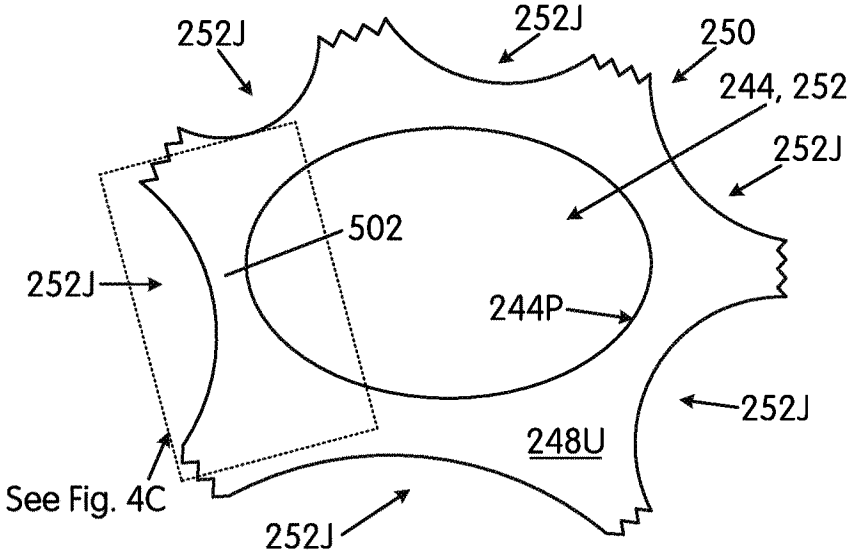
Figure 4E:
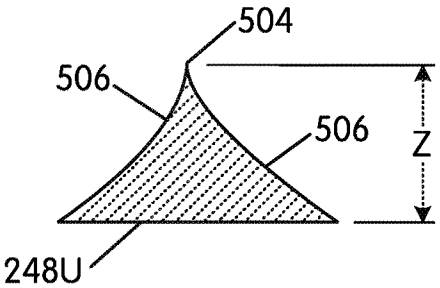
Figure 4D:
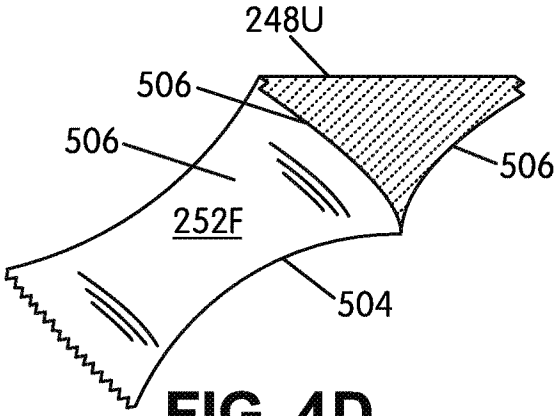
Figure 4C:
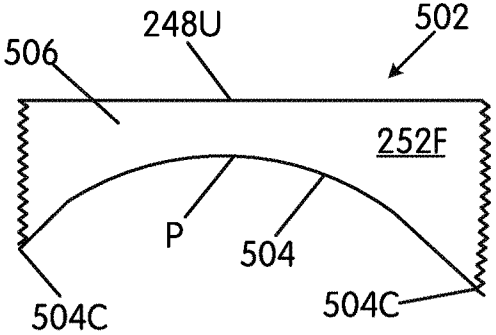

FIGS. 4A through 4H are provided to help illustrate potential features of the matrix structure 250 and the various cells described above. FIG. 4A provides an enlarged top view showing the upper-facing surface 248U at an area around an open cell 252 defined by the matrix structure 250 (the open space is shown at 244). FIG. 4B shows an enlarged bottom view of this same area of the matrix structure 250 (showing the ground-facing surface 248G). FIG. 4C shows a side view at one leg 502 of the matrix structure 250, and FIG. 4D shows a cross-sectional and partial perspective view of this same leg 502 area. As shown in these figures, the matrix structure 250 provides a smooth top (upper-facing) surface 248U but a more angular ground-facing surface 248G. More specifically, at the ground-facing surface 248G, the matrix structure 250 defines a generally hexagonal ridge 504 around the open cell 252, with the corners 504C of the hexagonal ridge 504 located at a junction area between three adjacent cells in a generally triangular arrangement (the junction of the open cell 252 and two adjacent cells 252J, which may be open, partially open, and/or closed cells, in this illustrated example). Some cells (open, partially open, or closed) will have six other cells adjacent and arranged around them (e.g., in the generally triangular arrangement of adjacent cells, as mentioned above). A cell is "adjacent" to another cell if a straight line can be drawn to connect the two cells without that straight line crossing through the open space of another cell or passing between two other adjacent cells and/or if the cells share a wall or side. "Adjacent cells" also may be located close to one another (e.g., so that a straight line distance between the openings of the cells is less than 1 inch long (and in some examples, less than 0.5 inches long).

As further shown in these figures, along with FIG. 4E (which shows a sectional view along line 4E-4E of FIG. 4B), the side walls 506 between the upper-facing surface 248U at cell perimeter 244P and the ground-facing surface 248G, which ends at ridge 504 in this example, are sloped. Thus, the overall matrix structure 250, at least at some locations between the generally hexagonal ridge 504 corners 504C, may have a triangular or generally triangular shaped cross section (e.g., see FIGS. 4D and 4E). Moreover, as shown in FIGS. 4C and 4D, the generally hexagonal ridge 504 may be sloped or curved from one corner 504C to the adjacent corners 504C (e.g., with a local maxima point P located between adjacent corners 504C). The side walls 506 may have a planar surface (e.g., like shown in FIG. 4H), a partially planar surface (e.g., planar along some of its height/thickness dimension Z), a curved surface (e.g., a concave surface as shown in FIG. 4E), a partially curved surface (e.g., curved along some of its height dimension Z), or other desired shape.

The raised corners 504C of the generally hexagonal ridge 504 in this illustrated example ground-engaging component 240 may be formed as sharp peaks that may act as secondary traction elements at desired locations around the ground-engaging component 240. As evident from these figures and the discussion above, the generally hexagonal ridges 504 and side walls 506 from three adjacent cells (e.g., 252 and two 252J cells) meet at a single (optionally raised) corner 504C area and thus may form a substantially pyramid type structure (e.g., a pyramid having three side walls 252F, 506 that meet at a point 504C). This substantially pyramid type structure can have a sharp point (e.g., depending on the slopes of walls 252F, 506), which can function as a secondary traction element when it contacts the ground in use. This same type of pyramid structure formed by matrix 250 also may be used to form the secondary traction elements 264 at cleat support areas 260.

Not every cell (open, partially open, or closed) in the ground-engaging component 240 needs to have this type of secondary traction element structure (e.g., with raised pointed pyramids at the generally hexagonal ridge 504 corners 504C), and in fact, not every generally hexagonal ridge 504 corner 504C around a single cell 252 needs to have a raised secondary traction element structure. One or more of the ridge components 504 of a given cell 252 may have a generally straight line structure along the ground-facing surface 248G and/or optionally a linear or curved structure that moves closer to the upper-facing surface 248U moving from one corner 504C to an adjacent corner 504C. In this manner, secondary traction elements may be placed at desired locations around the ground-engaging element 240 structure and left out (e.g., with smooth corners 504C and/or edges in the z-direction) at other desired locations. Additionally or alternatively, if desired, raised points and/or other secondary traction elements could be provided at other locations on the matrix structure 250, e.g., anywhere along ridge 504 or between adjacent cells. As some more specific examples, a portion of the arch support area (e.g., area 410 in FIG. 3) may have no or fewer prominent secondary traction elements (e.g., smoother matrix 250 walls), while other areas (e.g., the heel support area, the forefoot area (e.g., including one or more of the forward toe area, the lateral forefoot side support area, the medial forefoot side support area, and/or the central forefoot support area, including areas beneath at least some of the metatarsal head support areas) may include the secondary traction elements (or more pronounced secondary traction element structures).

Notably, in this example construction, the matrix structure 250 defines at least some of the cells 252 (and 252J) such that the perimeter of the entrance to the cell opening 252 around the upper-facing surface 248U (e.g., defined by perimeter 244P of the ovoid shaped opening) is smaller than the perimeter of the entrance to the cell opening 252 around the ground-facing surface 248G (e.g., defined by the generally hexagonal perimeter ridge 504). Stated another way, the area of the entrance to the cell opening 252 from the upper-facing surface 248U (e.g., the area within and defined by the perimeter 244P of the ovoid shaped opening) is smaller than the area of the entrance to the cell opening 252 from the ground-facing surface 248G (e.g., the area within and defined by the generally hexagonal perimeter ridge 504). The generally hexagonal perimeter ridge 504 completely surrounds the perimeter 244P in at least some cells. These differences in the entrance areas and sizes are due to the sloped/curved sides walls 506 from the upper-facing surface 248U to the ground-facing surface 248G.

Figure 4G:
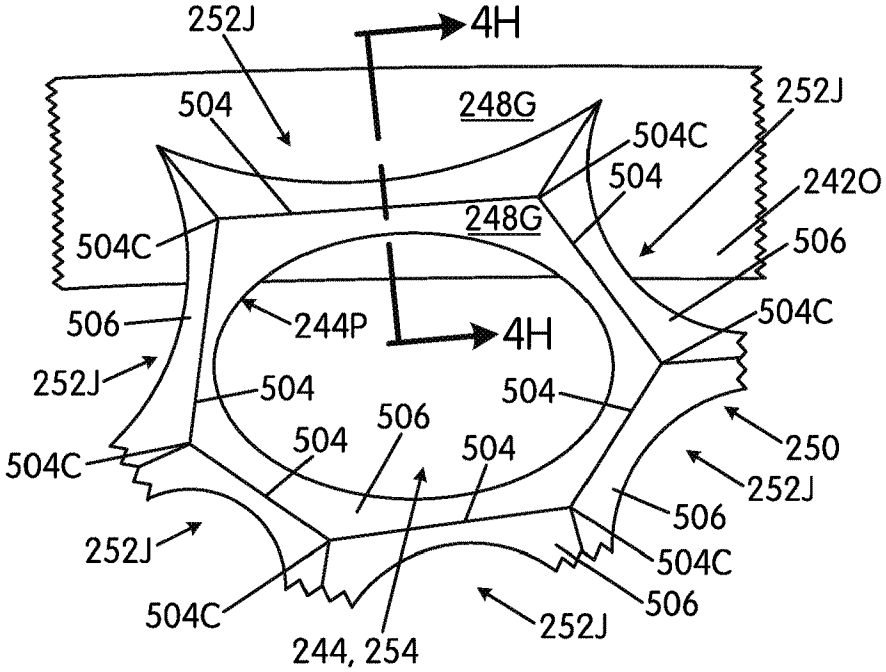
Figure 4F:
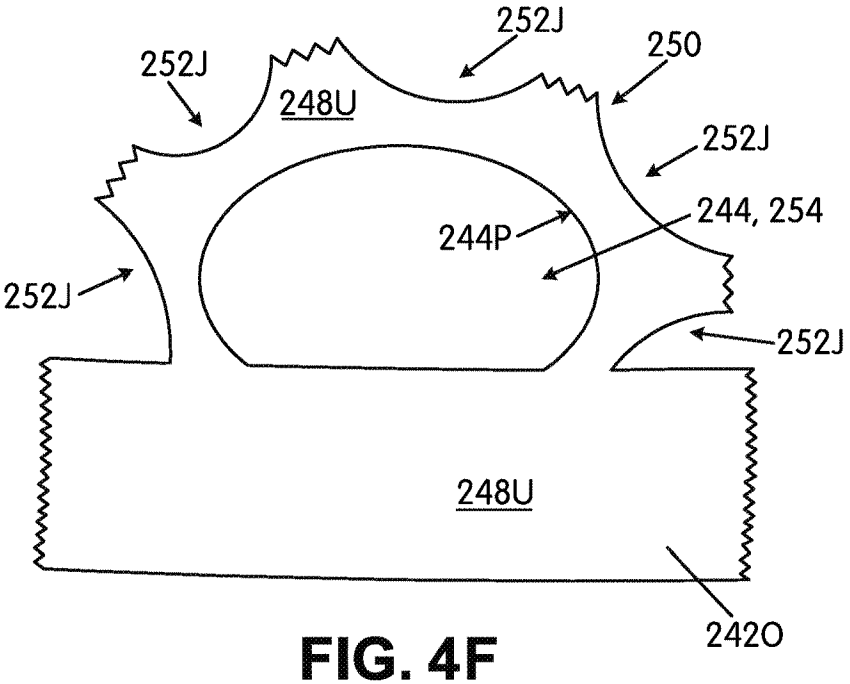
Figure 4H:
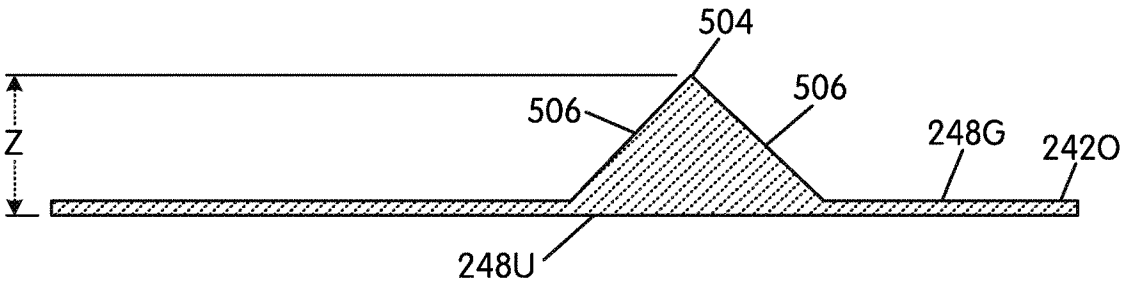

FIGS. 4F through 4H show views similar to those in FIGS. 4A, 4B, and 4E but with a portion of the matrix structure 250 originating in the outer perimeter boundary rim 242O (and thus the cell is a partially open cell 254). As shown in FIG. 4G, in this illustrated example, the matrix structure 250 morphs outward and downward from the ground-facing surface 248G of the outer perimeter boundary rim 242O. This may be accomplished, for example, by molding the matrix structure 250 as an unitary, one-piece component with the outer perimeter boundary rim member 242O. Alternatively, the matrix structure 250 could be formed as a separate component that is fixed to the outer perimeter boundary rim member 242O, e.g., by cements or adhesives, by mechanical connectors, etc. As another option, the matrix structure 250 may be made as an unitary, one-piece component with the outer perimeter boundary rim member 242O by rapid manufacturing techniques, including rapid manufacturing additive fabrication techniques (e.g., 3D printing, laser sintering, etc.) or rapid manufacturing subtractive fabrication techniques (e.g., laser ablation, etc.). The structures and various parts shown in FIGS. 4F-4H may have any one or more of the various characteristics, options, and/or features of the similar structures and parts shown in FIGS. 4A-4E (and like reference numbers in these figures represent the same or similar parts to those used in other figures).

Figure 5A:
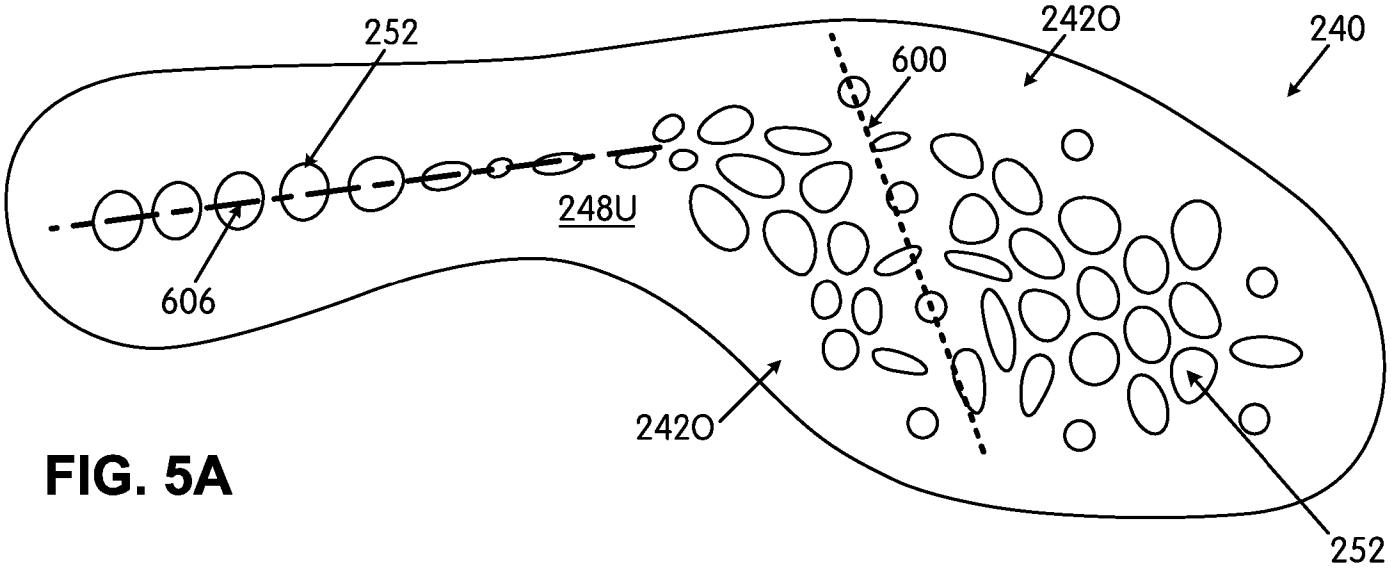
FIGS. 5A-10C provide various views of a set of ground-engaging components of different sizes in accordance with some aspects of this invention.
Figure 5B:
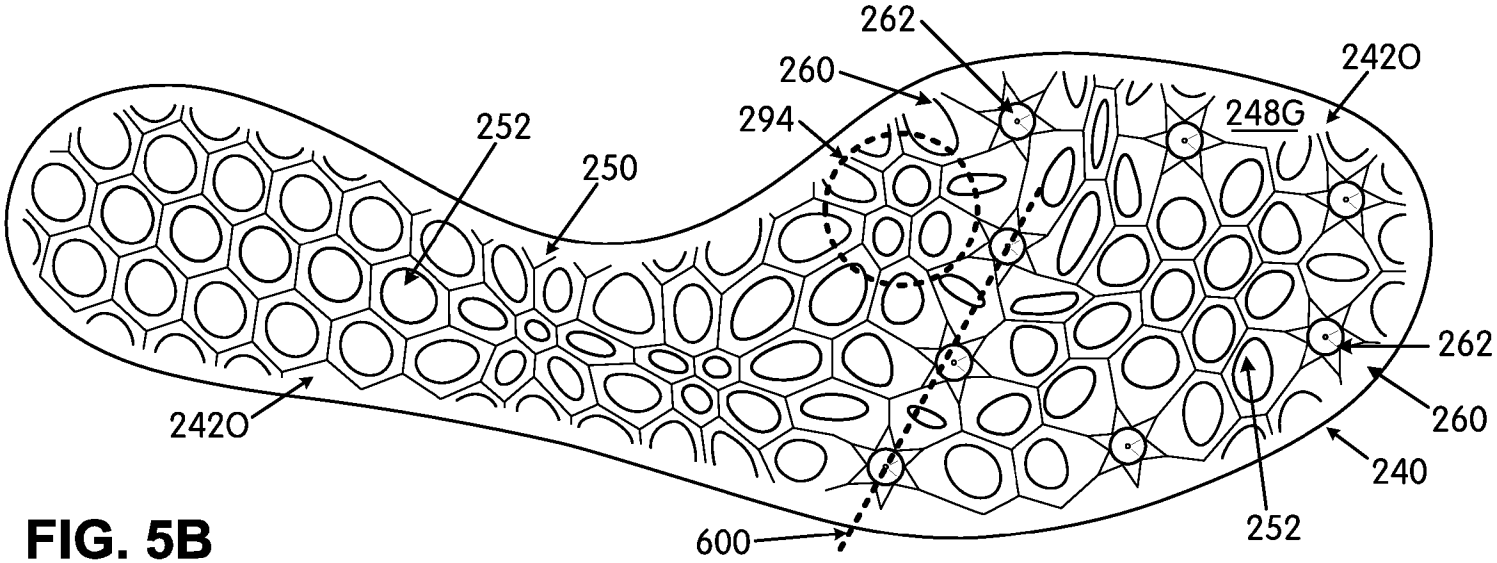
Figure 5C:
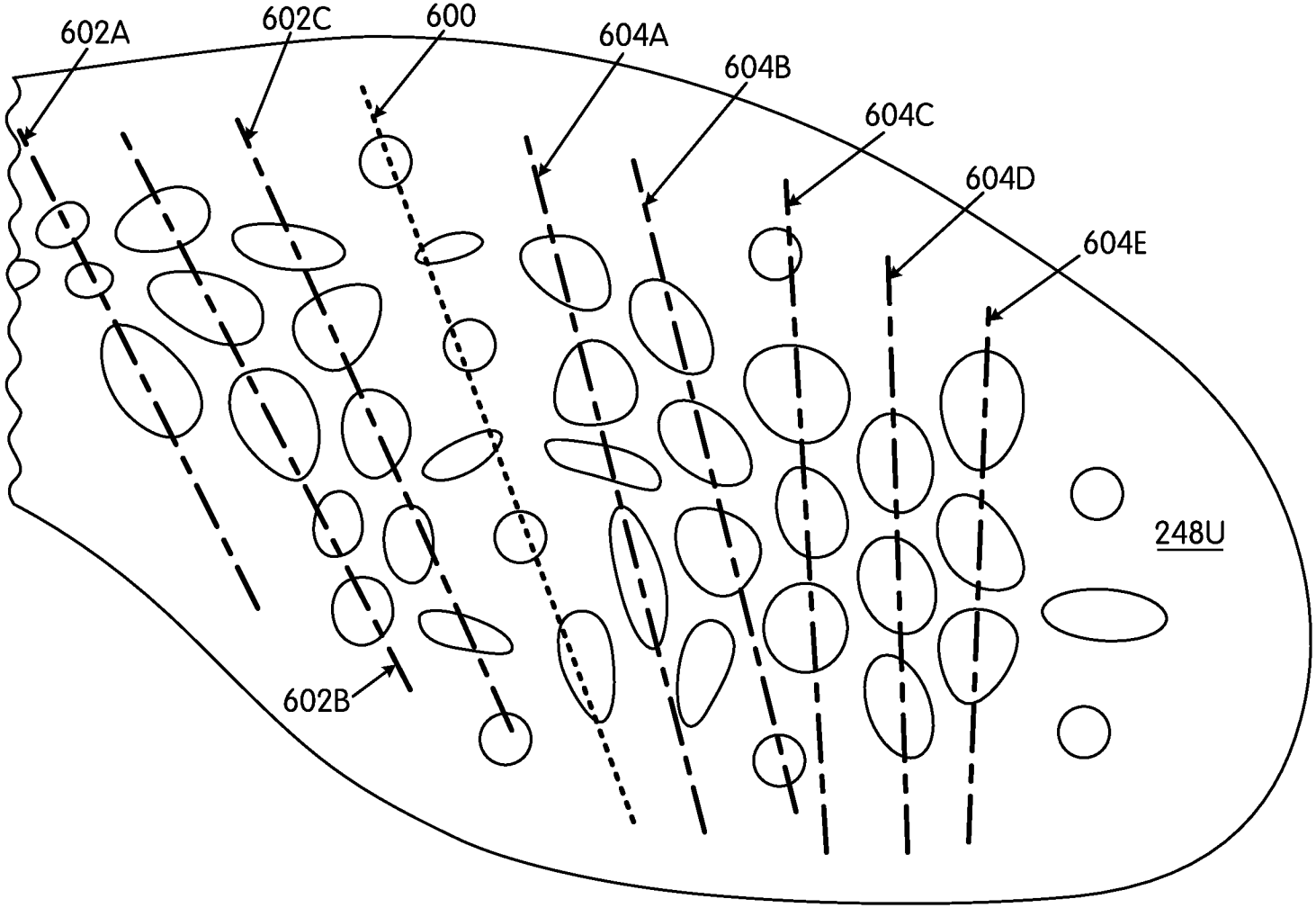
Figure 6A:
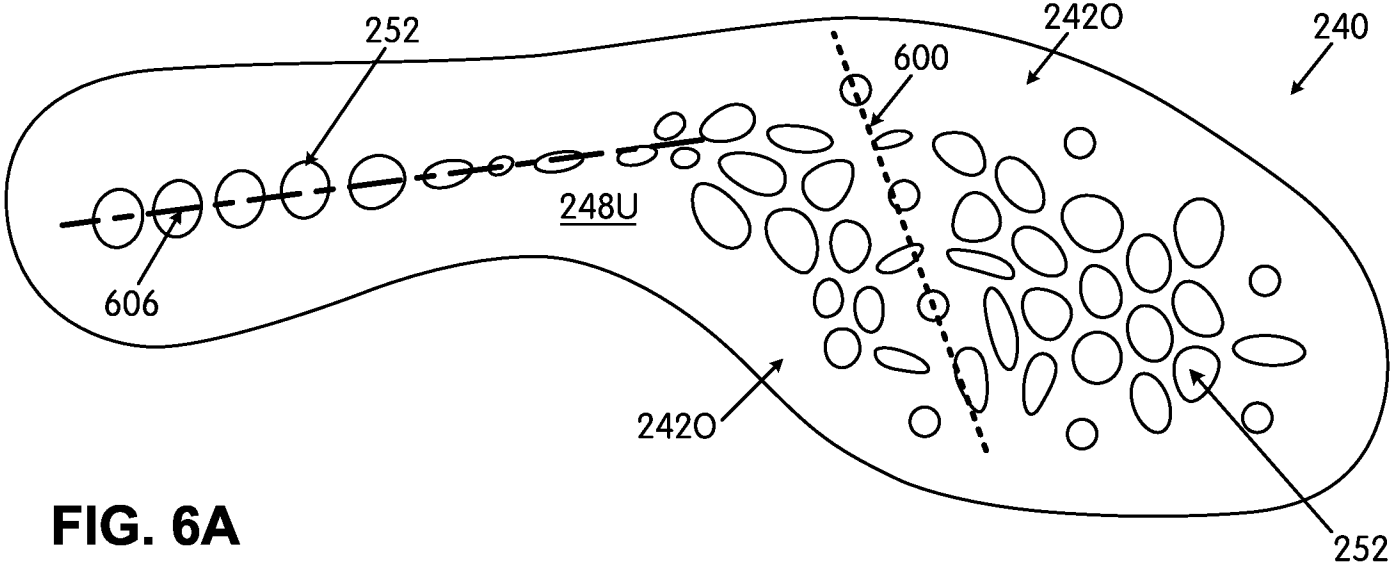
Figure 6B:
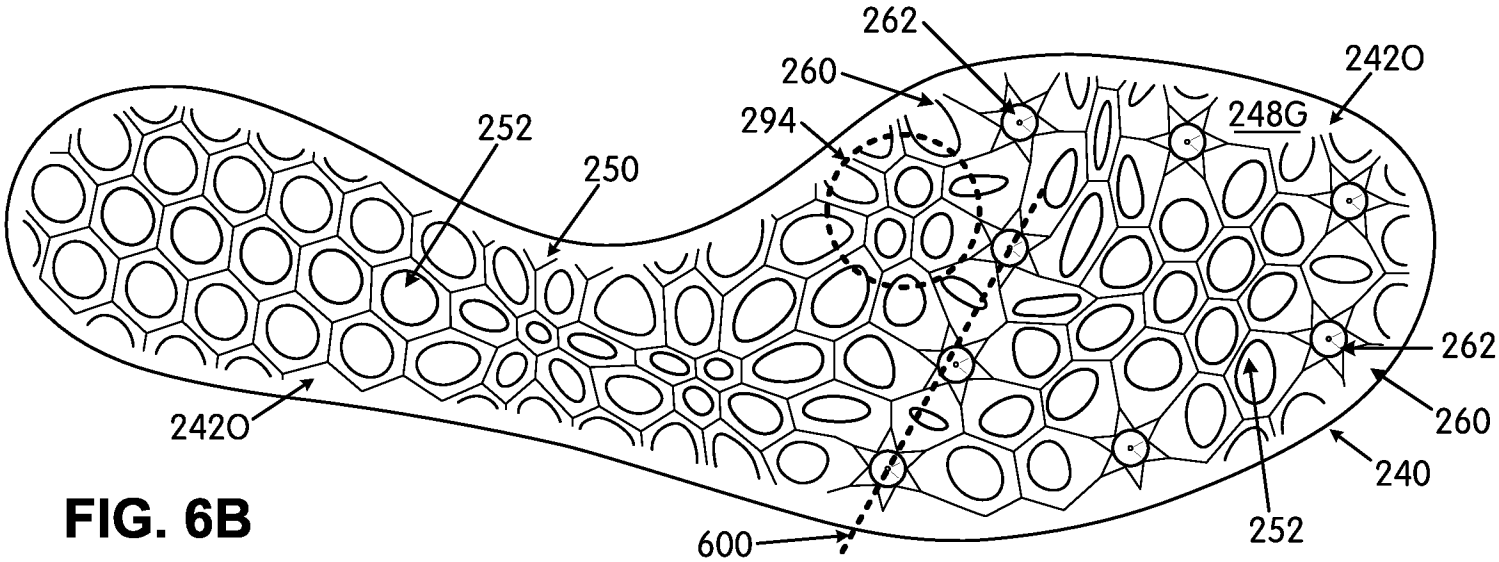
Figure 7A:
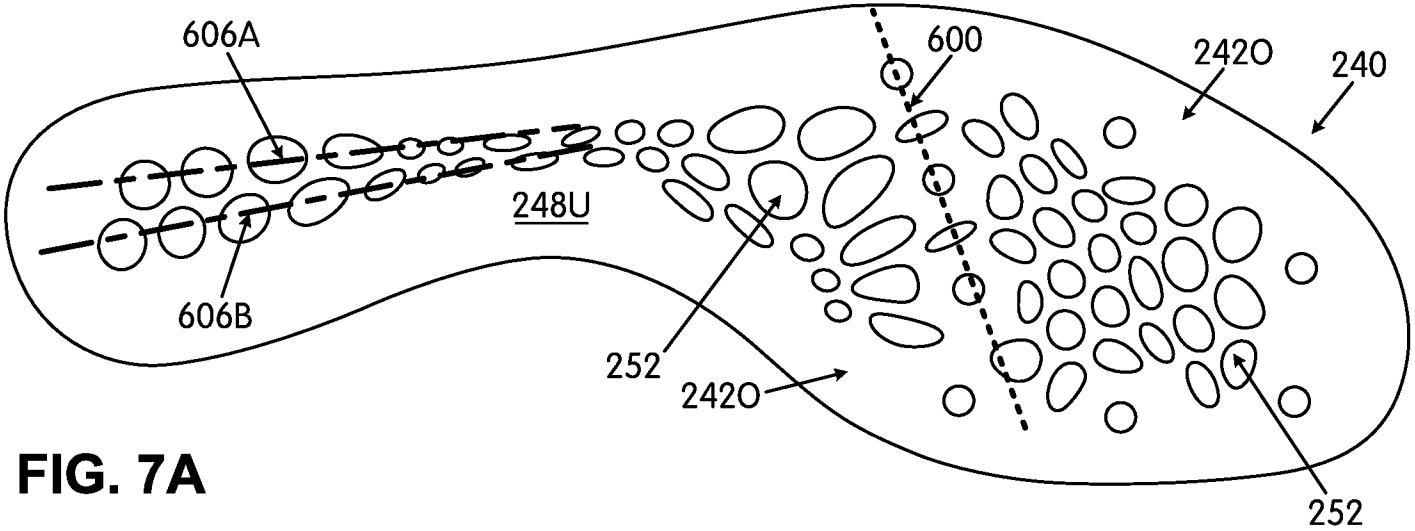
Figure 7B:
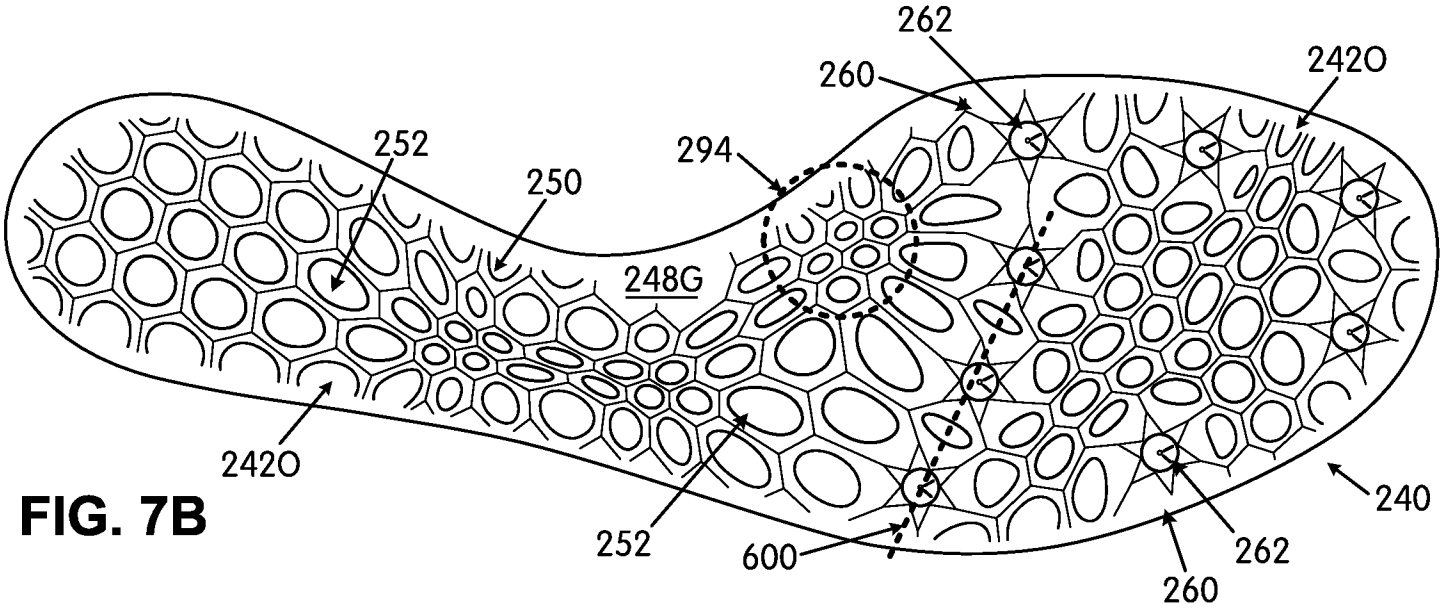
Figure 8A:
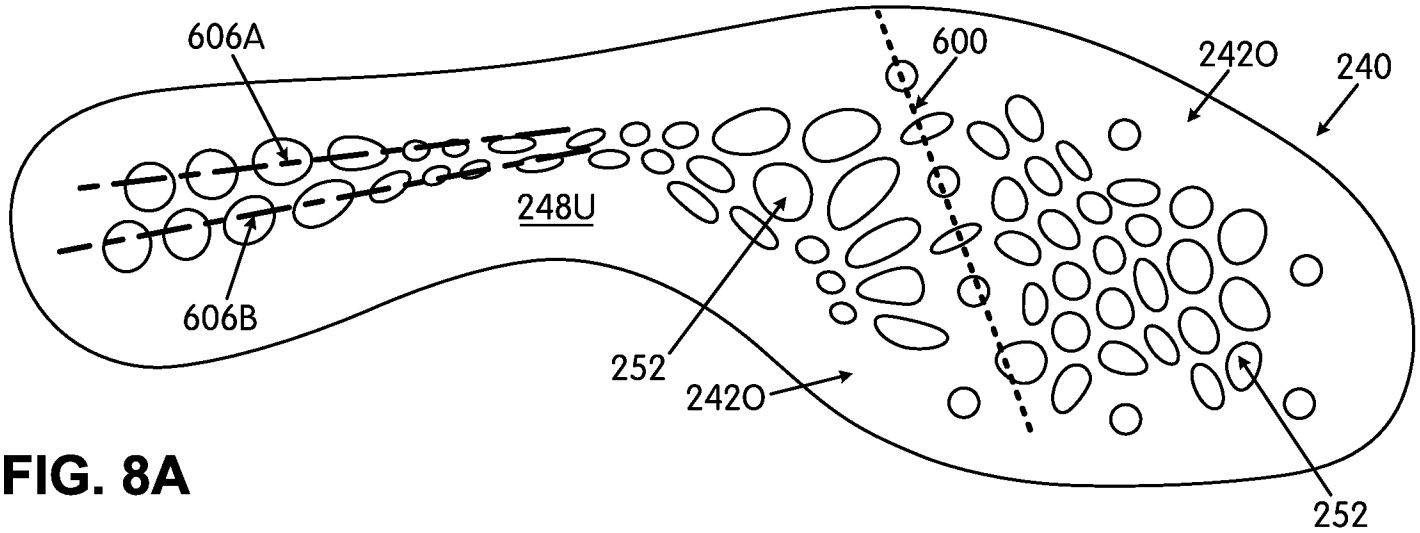
Figure 8B:
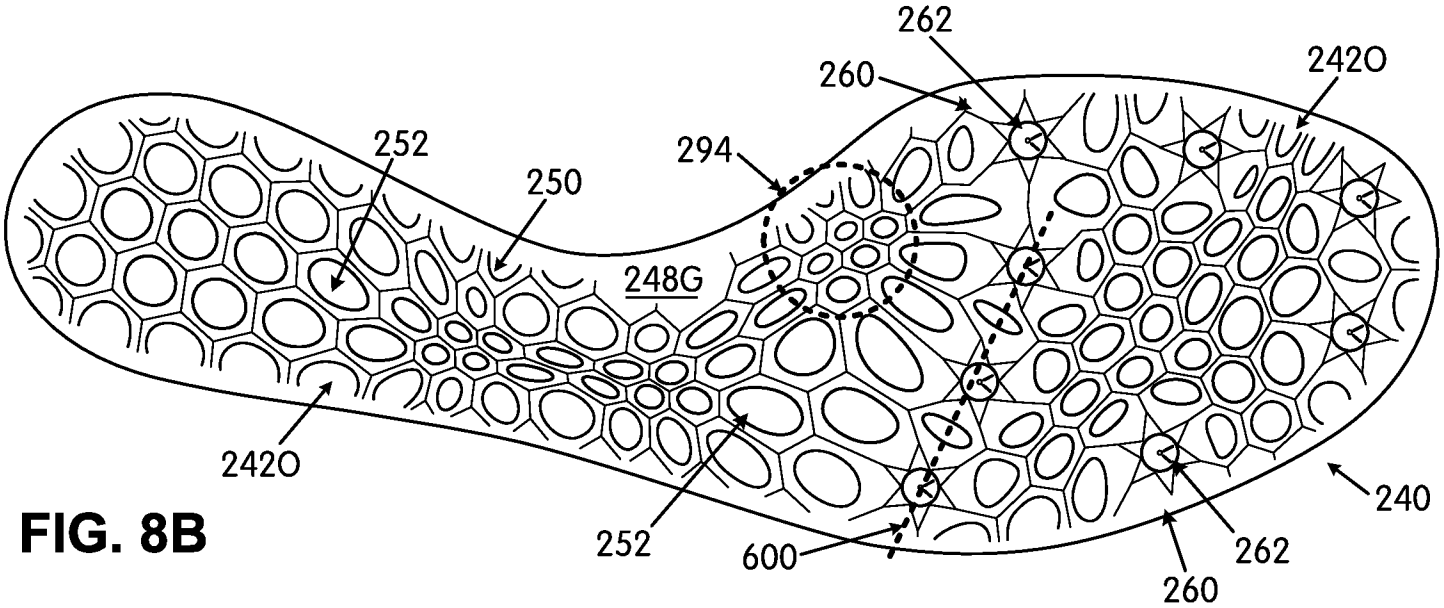
Figure 8C:
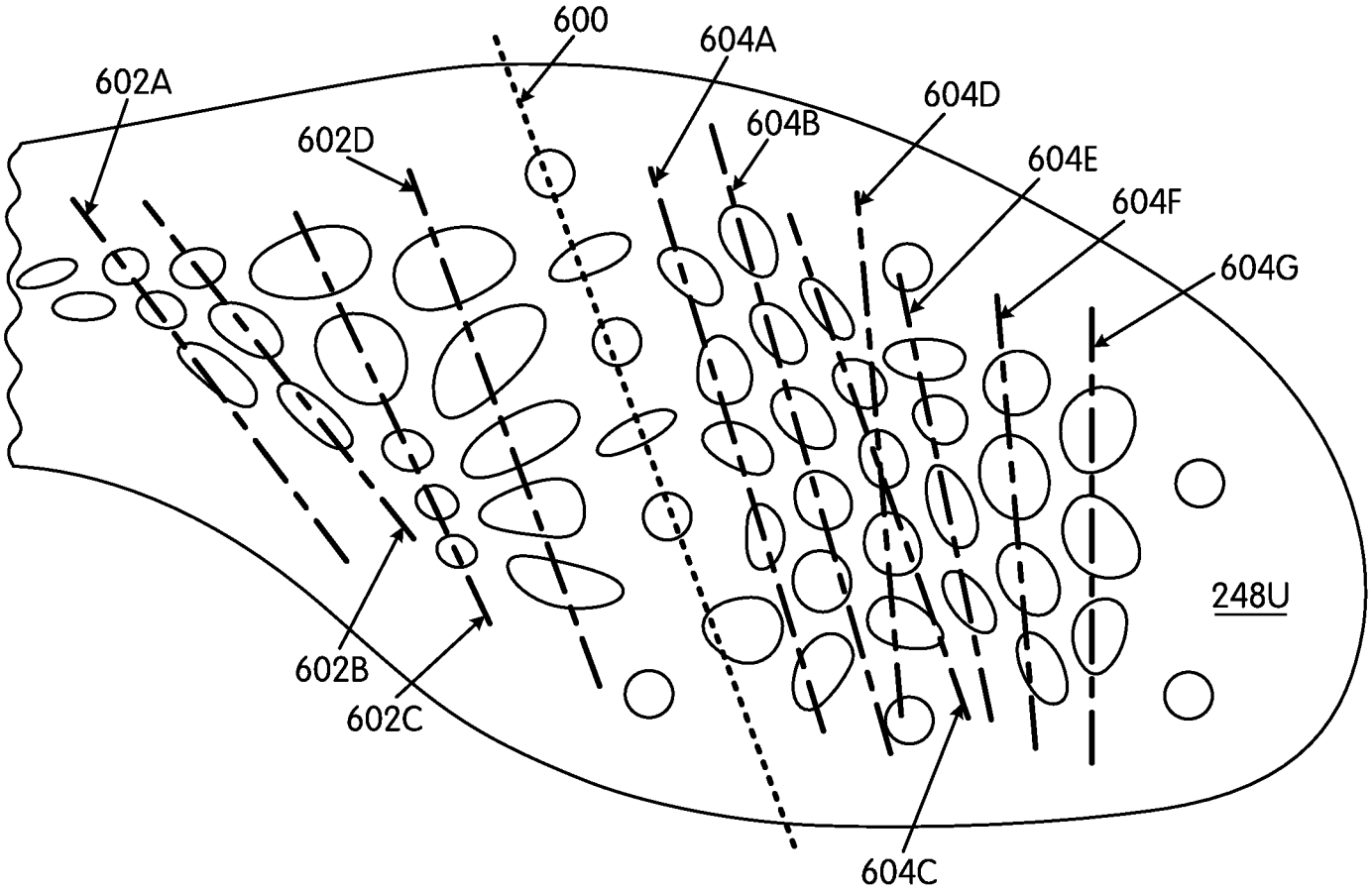
Figure 9A:
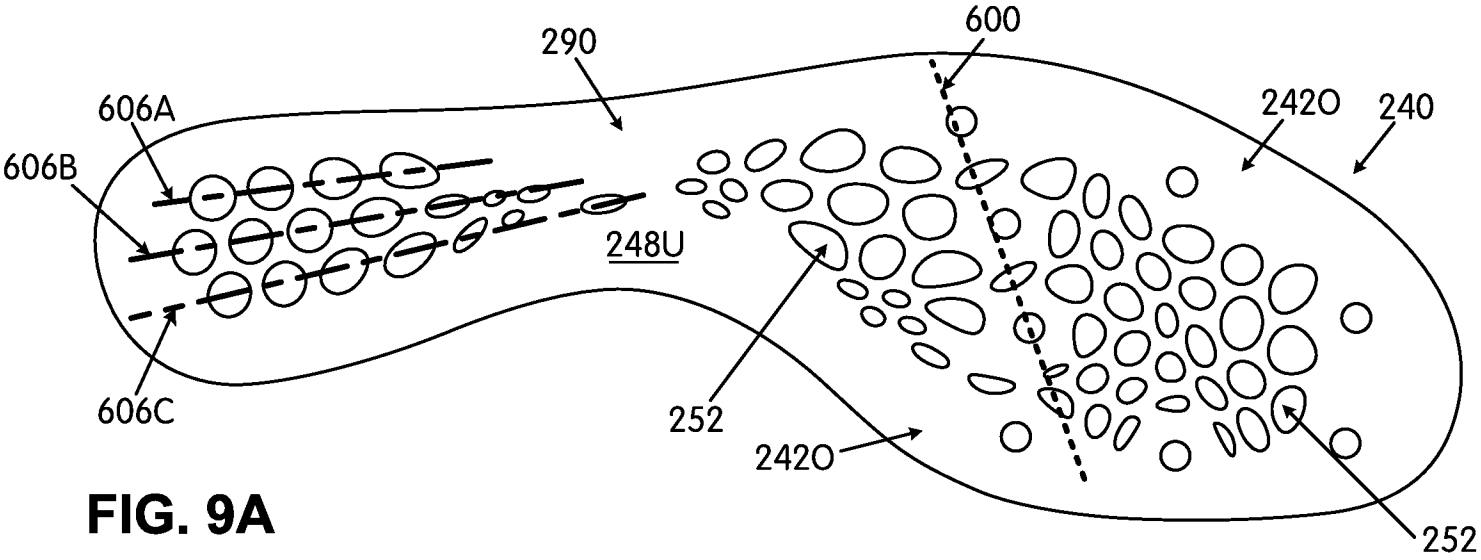
Figure 9B:
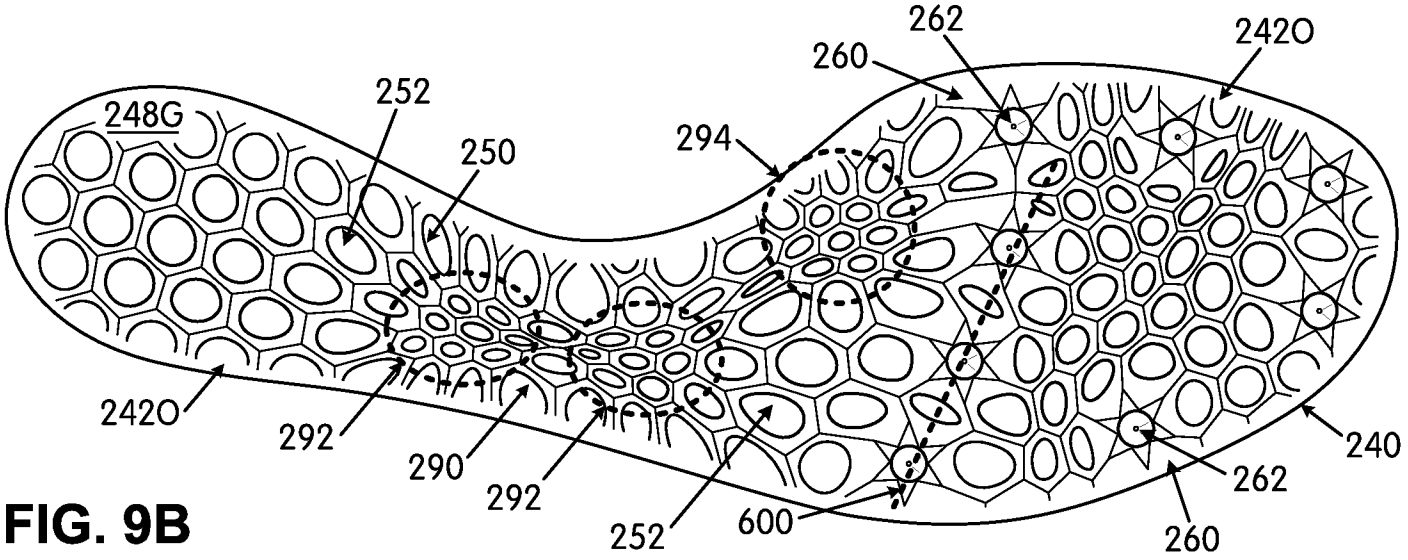
Figure 9C:
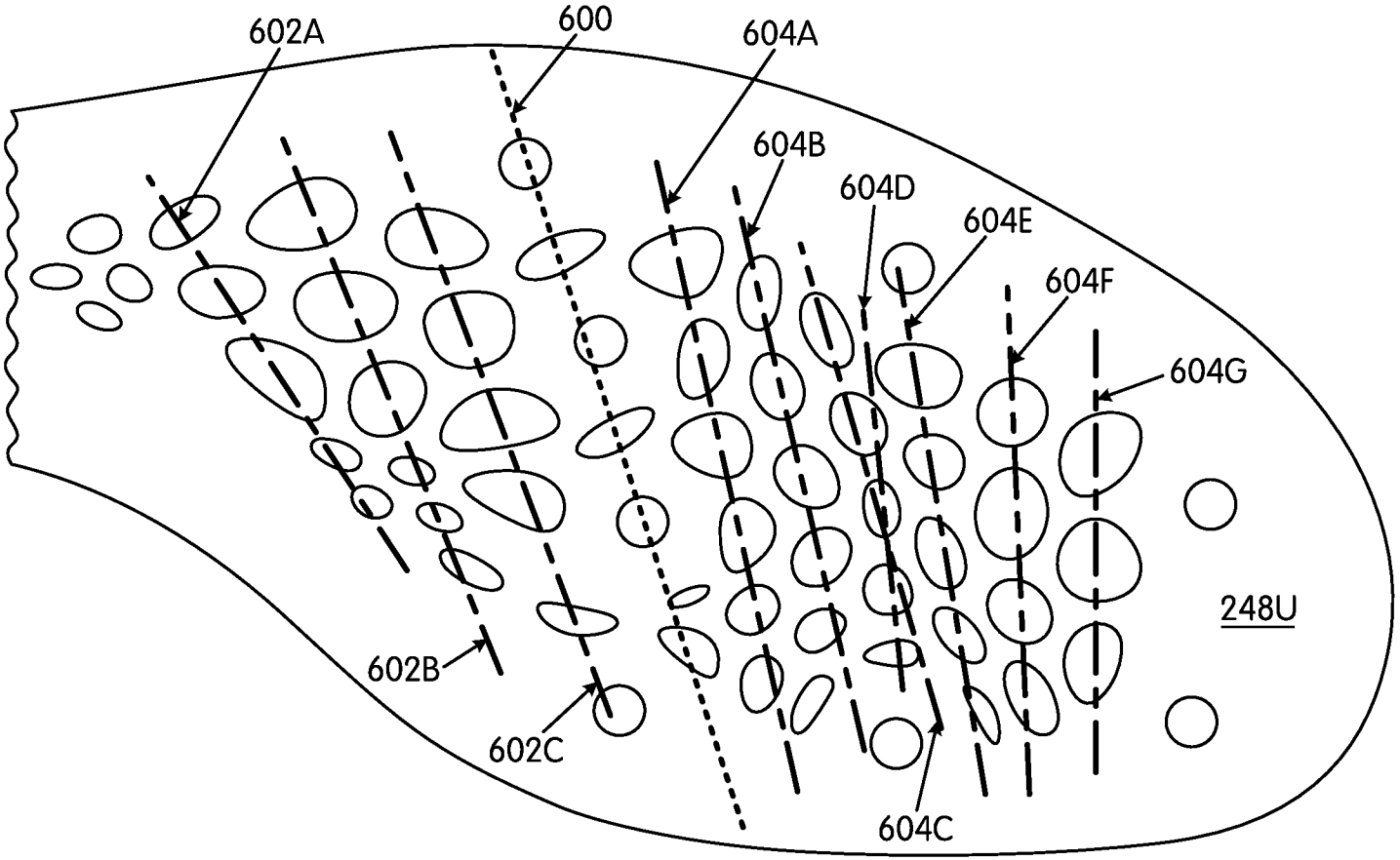
Figure 10A:
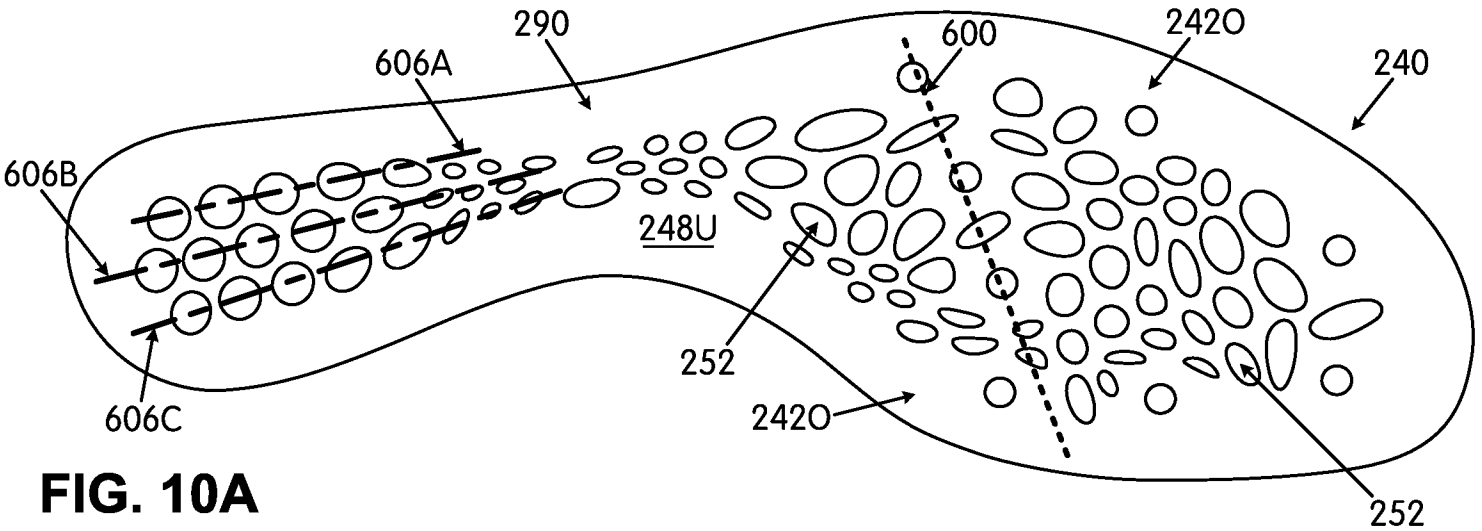
Figure 10B:
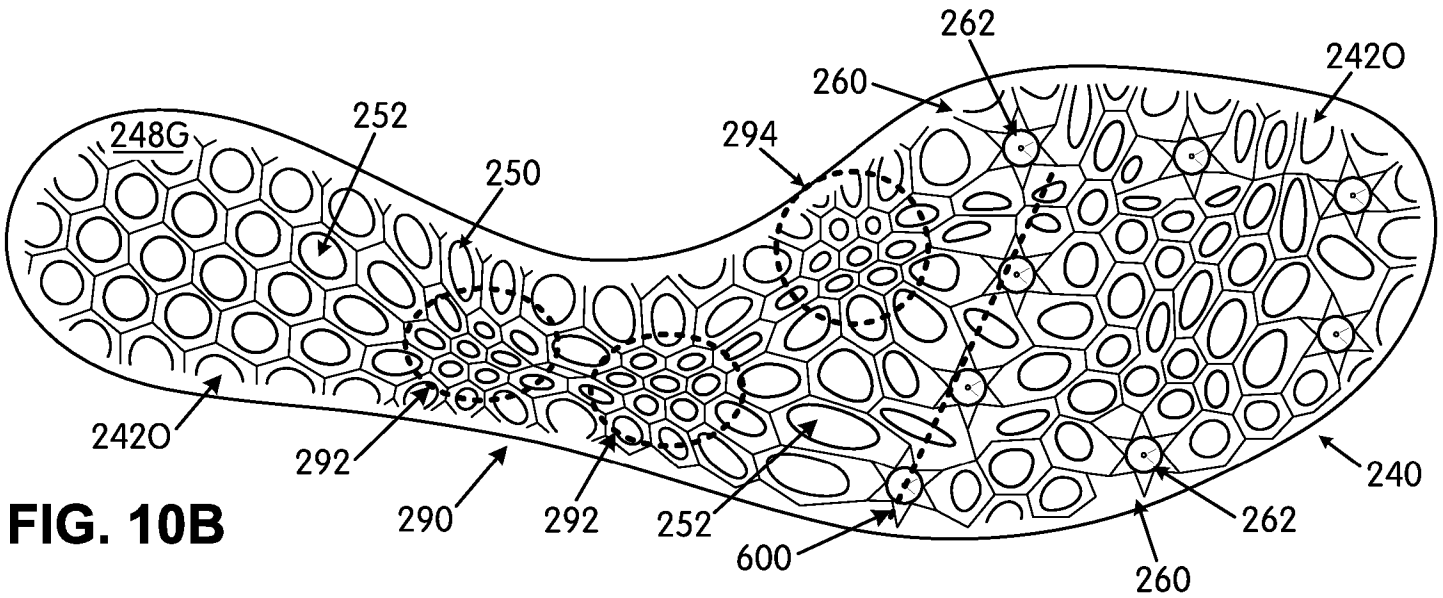
Figure 10C:
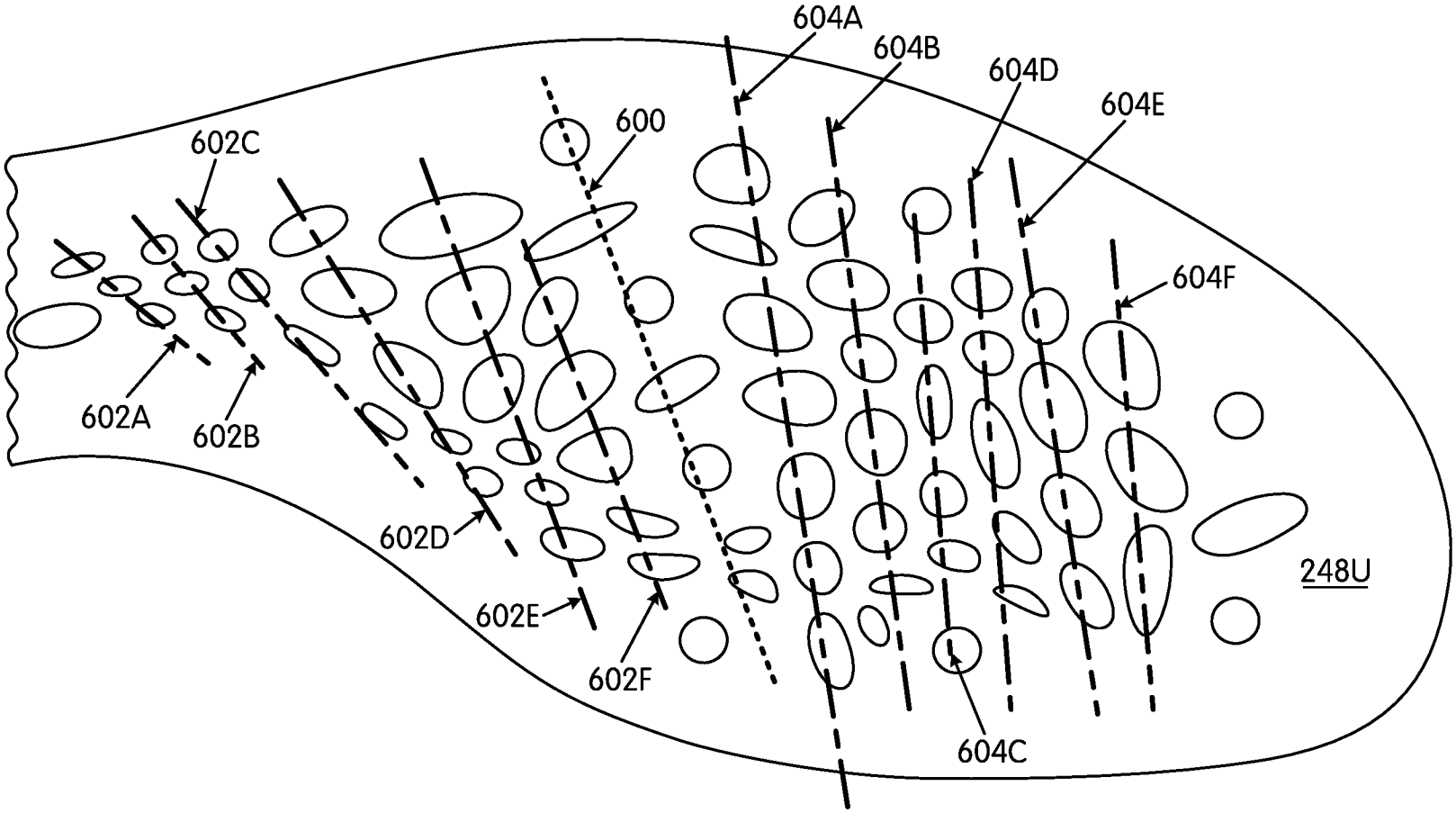

Additional features of some aspects of this invention will be described below in conjunction with FIGS. 5A through 10C. These figures show ground-engaging components in accordance with some examples of this invention in which a set of ground-engaging components is provided for a range of shoe sizes and in which the ground-engaging components for all sizes have substantially the same forefoot stiffness characteristics (e.g., all components have a forefoot stiffness within ±10% of one another and/or each component of the set has a forefoot stiffness within ±10% of a forefoot stiffness of one or more other components in the set). In these illustrated examples, FIGS. 5A-5C show a size 6 ground-engaging component 240; FIGS. 6A-6B show a size 5 ground-engaging component 240; FIGS. 7A-7B show a size 7 ground-engaging component 240; FIGS. 8A-8C show a size 8 ground-engaging component 240; FIGS. 9A-9C show a size 10 ground-engaging component 240; and FIGS. 10A-10C show a size 12 ground-engaging component 240. The "sizes" mentioned above are U.S. men's sizes (or their equivalent in other footwear size systems).

In general, the set of ground-engaging components 240 will include at least two ground-engaging components 240 that are least two standard sizes apart from one another, wherein the matrix structures 250 of the ground-engaging components 240 of the set differ from one another and are structured and arranged with respect to their respective outer perimeter boundary rims 242O so that the ground-engaging components 240 of the set each has a forefoot stiffness within ±10% of one another and/or within ±10% of at least one other member of the set, as described above.

In this illustrated example set, the even numbered sizes (sizes 6, 8, 10, and 12) are designed with different matrix structures, materials, dimensions, etc., so that the final ground-engaging component product 240 will have the stiffness features described above. Thus, as can be seen by comparing FIGS. 5A-5C, 8A-8C, 9A-9C, and 10A-10C, the matrix structures 250 differ in the illustrated plates 240 (e.g., in the pattern/number of openings, etc.). In this set, the odd number sizes (sizes 5, 7, 9 (not shown), and 11 (not shown)) are scaled down versions of the next higher even numbered size. This can be seen, for example, by comparing FIGS. 5A-5B (size 6) with FIGS. 6A-6B (size 5) and by comparing FIGS. 7A-7B (size 7) with FIGS. 8A-8B (size 8). Alternatively, if desired, rather than scaling down to get the next smaller whole size in the series, the odd numbered sizes could be created by scaling up from the next smaller even size (e.g., the size 7 could be a scaled up version of the size 6, the size 9 could be a scaled up version of the size 8, etc.). As another option, if desired, the set could be designed using the odd numbered sizes as the individually created base designs and the even number sizes could be scaled up/scaled down versions of the odd numbered base designs. As another option, if desired, each size could be independently designed to provide the desired stiffness characteristics (rather than scaling up or scaling down for some sizes).

For half sizes in this example set, if any, the same sized plates 240 can be used as used for the whole numbered sizes and the upper can simply be adjusted in size to accommodate the slightly different sized foot. Therefore, in this manner, the size 5½ shoe could use the ground-engaging component of the size 5 shoe (or the size 6 shoe), and the upper can be constructed somewhat larger (or somewhat smaller) to better fit the slightly different sized foot dimensions.

Some features generally common to all the sizes of this example set now will be described in more detail in conjunction with FIGS. 5A-10C. First, as generally described above in conjunction with FIGS. 2A-4H, the ground-engaging components 240 include an outer perimeter boundary rim 242O that at least partially defines an outer perimeter of the ground-engaging component 240, wherein the outer perimeter boundary rim 242O defines an upper-facing surface 248U and a ground-facing surface 248G opposite the upper-facing surface 248U. The outer perimeter boundary rims 242O define an open space 244 at least at a forefoot support area of the components 240, and in some examples, in at least one of the heel support area and/or in the arch support area. The ground-engaging component 240 further includes a matrix structure 250 extending from the outer perimeter boundary rim (e.g., from the ground-facing surface 248G of the outer perimeter boundary rim 242O in this example) and at least partially across the open space 244 at least at the forefoot support area. Thus, the ground-engaging components 240 define an open cellular construction with plural open cells 252 in the open space 244 at least at the forefoot support area. As shown in these figures, at least some of the openings of the open cells 252 of the open cellular construction may have curved perimeters with no distinct corners, e.g., round, elliptical, and/or oval shaped openings (and optionally, at least 50%, at least 60%, at least 70%, at least 80%, at least 90%, or at least 95%, or even 100% of the openings of the open cells 252 may have curved perimeters with no distinct corners). The ground-engaging components 240 of this set may have any of the features and/or combinations of features described above in conjunction with FIGS. 2A-4H (e.g., primary traction component features, cleat mount area features, cleat support area features, secondary traction element features, matrix structure features, alignment features, etc.).

Notably, the ground-engaging components 240 of this illustrated set include the eight cleat mount areas 260 and primary traction elements 262 (e.g., track spikes) as described above in conjunction with FIGS. 2A-2D. More specifically, each of the ground-engaging components 240 of this set includes a rearmost set of four cleat support areas 260 extending across the component 240 from the medial side to the lateral side. These cleat support areas 260 include a cleat mount area for engaging a primary traction element 262 (e.g., where a primary traction element 262 is fixed). Furthermore, as shown in FIGS. 5A-10C by line 600, centers of the cleat support areas 260 and/or the cleat mount areas (e.g., the center point of spike 262) of at least the three lateral-most cleat support areas 260 and/or cleat mount areas (centered at spike 262) of this rearmost set are "substantially aligned" or "highly substantially aligned," as defined above. Additionally, as shown in these figures, at least the three lateral-most cleat support areas 260 and/or cleat mount areas (centered at spike 262) of this rearmost set are "substantially aligned" or "highly substantially aligned" in the forefoot support area of the sole plate 240 along a line 600 that extends from a rear lateral direction toward a forward medial direction of the sole plate 240. Furthermore, as shown, the geographical centers of the rearmost medial side edge forefoot cleat support area 260 and/or their associated primary traction elements 262 are located rearward of the line 600 along which the three lateral-most support areas 260 and/or cleat mount areas (centered at spike 262) are "substantially aligned" or "highly substantially aligned."

The set of ground-engaging components 240 shown in FIGS. 5A-10C also have other general features in common. More specifically, as best shown in FIGS. 5C, 8C, 9C, and 10C, at least some cells of the matrix structures 250 are generally formed in lines that extend across the ground-engaging component 240 and the sole structure 204. The term "cells" used in this context is used generically to refer to any one or more of open cells 252, partially open cells 254, and/or closed cells (e.g., cells completely formed by the matrix structure 250 and closed off within the outer perimeter rim 242O) in any numbers or combinations. In some example structures 240 in accordance with this aspect of the invention, from 3 to 20 "lines" of cells may be formed in the ground-engaging element structure 240 (and in some examples, from 4-16 "lines" of adjacent cells or even from 6-12 "lines" of adjacent cells of this type). Each "line" of adjacent cells extending in the generally medial-to-lateral side direction may contain from 2 to 16 cells, and in some examples, from 3 to 12 cells or from 3-8 cells.

More specifically, and first referring to FIG. 5C (which is an enlarged view of a portion of FIG. 5A), the upper-facing surface 248U of the ground-engaging component 240 is shown with additional lines to highlight certain aligned cell features in this component 240. In this size 6 ground-engaging component structure 240, the matrix structure 250 forms three substantially aligned or highly substantially aligned sets of open cells (identified by lines 602A, 602B, and 602C) rearward of the substantially aligned set of primary traction elements (shown by line 600). Further, in this ground-engaging component structure 240, the matrix structure 250 forms five substantially aligned or highly substantially aligned sets of open cells (identified by lines 604A, 604B, 604C, 604D, and 604E) forward of the substantially aligned set of primary traction elements (shown by line 600). While the substantially aligned or highly substantially aligned sets of cells shown in FIGS. 5A-5C are open cells 252, additionally or alternatively, the aligned cells may include partially open cells and/or closed cells, if desired. To form a "line" of substantially aligned or highly substantially aligned cells, as described above, the geographic centers of three or more cells (e.g., the centers of the cell openings) will be located within a predetermined distance from a single straight line.

Notably, while not a requirement for any or all "sets" of three or more aligned cells, the "alignment lines" 602A-602C and at least 604A and 604B shown in the illustrated example of FIG. 5C extend from a rear lateral direction toward a forward medial direction of the ground-engaging component 240 and/or the sole structure 204 (and not in the direct transverse direction). If desired, any one or more sets of cells may be aligned along a line that extends from the rear lateral direction toward the forward medial direction of the ground-engaging component 240 and/or sole structure 204. These sets of "substantially aligned" or "highly substantially aligned" cells can help provide more natural flexion and motion for the foot, e.g., as the person's weight rolls forward from the heel and/or midfoot to the toe during a step cycle. For example, the substantially aligned or highly substantially aligned open spaces 244 along lines 602A-602C and 604A-604E provide and help define lines of flex that extend at least partially across the sole structure 204 and/or the ground-engaging component 240 from the lateral side to the medial side direction and help the ground-engaging component 240 bend with the foot as the wearer rolls the foot forward for the toe-off phase of a step cycle. The cells in lines 602A-602C and 604A-604E may contain from 3-10 cells or even from 3-8 cells. The "substantially aligned" or "highly substantially aligned" cells may be adjacent one another along the line, but this is not a requirement in all structures in accordance with this invention (e.g., one or more non-aligned cells may be provided between some of the aligned cells, if desired).

FIG. 5A further shows a set of adjacent cells located along a line 606 that extends in the generally forward-to-rear direction in the heel support area and the arch support area. The cells in line 606 may be substantially aligned or highly substantially aligned, if desired, and may contain from 4-18 cells or even from 5-12 cells. This line 606 of cells (which may be open and/or partially open) also may help provide more natural flexion and motion for the foot, e.g., as the person's weight rolls forward from the heel to the toe and from the lateral side to the medial side during a step cycle. For example, adjacent open spaces 244 along line 606 provide and help define a line of flex that extends along the foot from the rear-to-front direction and help the ground-engaging component 240 bend along a front-to-back line or curve with the foot as the wearer rolls the foot from the lateral side to the medial side for the toe-off phase of a step cycle.

FIGS. 6A and 6B illustrate a size 5 ground-engaging component 240 for this example set. As described above, the size 5 component 240 of this example is a scaled down version of the size 6 component 240, and therefore, FIGS. 6A and 6B appear very similar to FIGS. 5A and 5B, respectively. Therefore, like reference numbers are used to illustrate the same or similar features, and the repetitive description is omitted.

FIGS. 7A-8C show the next larger sizes of the ground-engaging components 240 of this set (size 7 in FIGS. 7A and 7B and size 8 in FIGS. 8A-8C). While the components 240 of FIGS. 7A-8C are generally similar to those of FIGS. 5A-6B, the matrix structure 250 differs. More specifically, because the size of the plates 240 in FIGS. 7A-8C is increased from the sizes of the plates 240 shown in FIGS. 5A-6B, the matrix structure 250 has been changed so as to allow the plates 240 of FIGS. 7A-8C to have substantially the same desired stiffness/flex profile as the plates 240 shown in FIGS. 5A-6B (e.g., a forefoot stiffness within ±10% of one another). In this illustrated example, the component 240 of FIGS. 8A-8C was independently designed (e.g., to have the desired stiffness characteristics), and the size 7 component 240 of FIGS. 7A-7B is a scaled down version of the size 8 component 240.

Referring to FIG. 8C (which is an enlarged view of a portion of FIG. 8A), the upper-facing surface 248U of the ground-engaging component 240 is shown with additional lines to highlight certain aligned cell features in this component 240. In this size 8 ground-engaging component structure 240, the matrix structure 250 forms four substantially aligned or highly substantially aligned sets of open cells (identified by lines 602A, 602B, 602C, and 602D) rearward of the substantially aligned set of primary traction elements (shown by line 600). Further, in this ground-engaging component structure 240, the matrix structure 250 forms seven substantially aligned or highly substantially aligned sets of open cells (identified by lines 604A, 604B, 604C, 604D, 604E, 604F, and 604G) forward of the substantially aligned set of primary traction elements (shown by line 600). While the substantially aligned or highly substantially aligned sets of cells shown in FIGS. 8A-8C are open cells 252, additionally or alternatively, the aligned cells may include partially open cells and/or closed cells, if desired. To form a "line" of substantially aligned or highly substantially aligned cells, as described above, the geographic centers of three or more cells (e.g., the centers of the cell openings) will be located within a predetermined distance from a single straight line. Additionally, as shown by lines 604C and 604D, some lines of substantially aligned or highly substantially aligned cells may cross one another and/or an individual cell might be found in more than one line of substantially aligned or highly substantially aligned cells.

Notably, while not a requirement for any or all "sets" of three or more aligned cells, the "alignment lines" 602A-602D and at least 604A-604C and 604E shown in the illustrated example of FIG. 8C extend from a rear lateral direction toward a forward medial direction of the ground-engaging component 240 and/or the sole structure 204 (and not in the direct transverse direction). If desired, any one or more sets of cells may be aligned along a line that extends from the rear lateral direction toward the forward medial direction of the ground-engaging component 240 and/or sole structure 204. These sets of "substantially aligned" or "highly substantially aligned" cells can help provide more natural flexion and motion for the foot, e.g., as the person's weight rolls forward from the heel and/or midfoot to the toe during a step cycle. For example, the substantially aligned or highly substantially aligned open spaces 244 along lines 602A-602D and 604A-604G provide and help define lines of flex that extend at least partially across the sole structure 204 and/or the ground-engaging component 240 from the lateral side to the medial side direction and help the ground-engaging component 240 bend with the foot as the wearer rolls the foot forward for the toe-off phase of a step cycle. The cells in lines 602A-602D and 604A-604G may contain from 3-10 cells or even from 3-8 cells. The "substantially aligned" or "highly substantially aligned" cells may be adjacent one another along the line, but this is not a requirement in all structures in accordance with this invention (e.g., one or more non-aligned cells may be provided between some of the aligned cells, if desired).

FIGS. 7A and 8A further show two sets of adjacent cells located along lines 606A and 606B that extend in the generally forward-to-rear direction in the heel support area (and optionally into the arch support area). The cells in lines 606A and/or 606B may be substantially aligned or highly substantially aligned, if desired, and may contain from 3-12 cells or even from 4-10 cells. The lines 606A-606B may be generally spaced apart in the medial side-to-lateral side direction. These lines 606A and/or 606B of cells (which may be open and/or partially open cells) also may help provide more natural flexion and motion for the foot, e.g., as the person's weight rolls forward from the heel to the toe and from the lateral side to the medial side during a step cycle. For example, adjacent open spaces 244 along lines 606A and/or 606B provide and help define lines of flex that extend along the foot from the rear-to-front direction and help the ground-engaging component 240 bend along a front-to-back line or curve with the foot as the wearer rolls the foot from the lateral side to the medial side for the toe-off phase of a step cycle.

FIGS. 9A-9C show the next larger size of the ground-engaging component 240 of this set (size 10). While the components 240 of FIGS. 9A-9C are generally similar to those of FIGS. 5A-8C, the matrix structure 250 differs. More specifically, because the size of the plates 240 in FIGS. 9A-9C is increased from the sizes of the plates 240 shown in FIGS. 5A-8C, the matrix structure 250 has been changed so as to allow the plates 240 of FIGS. 9A-9C to have substantially the same desired stiffness/flex profile as the plates 240 shown in FIGS. 5A-8C (e.g., a forefoot stiffness within ±10% of any of the other plates in the set described above). In this illustrated example, the component 240 of FIGS. 9A-9C was independently designed (e.g., to have the desired stiffness characteristics), and the corresponding component for the size 9 shoe of the set, if any (not shown in the figures), is a scaled down version of the size 10 component 240 of FIGS. 9A-9C.

Referring to FIG. 9C (which is an enlarged view of a portion of FIG. 9A), the upper-facing surface 248U of the ground-engaging component 240 is shown with additional lines to highlight certain aligned cell features in this component 240. In this size 10 ground-engaging component structure 240, the matrix structure 250 forms three substantially aligned or highly substantially aligned sets of open cells (identified by lines 602A, 602B, and 602C) rearward of the substantially aligned set of primary traction elements (shown by line 600). Further, in this ground-engaging component structure 240, the matrix structure 250 forms seven substantially aligned or highly substantially aligned sets of open cells (identified by lines 604A, 604B, 604C, 604D, 604E, 604F, and 604G) forward of the substantially aligned set of primary traction elements (shown by line 600). While the substantially aligned or highly substantially aligned sets of cells shown in FIGS. 9A-9C are open cells 252, additionally or alternatively, the aligned cells may include partially open cells and/or closed cells, if desired. To form a "line" of substantially aligned or highly substantially aligned cells, as described above, the geographic centers of three or more cells (e.g., the centers of the cell openings) will be located within a predetermined distance from a single straight line. Additionally, as shown by lines 604C and 604D, some lines of substantially aligned or highly substantially aligned cells may cross one another and/or an individual cell might be found in more than one line of substantially aligned or highly substantially aligned cells.

Notably, while not a requirement for any or all "sets" of three or more aligned cells, the "alignment lines" 602A-602C and at least 604A-604C and 604E shown in the illustrated example of FIG. 9C extend from a rear lateral direction toward a forward medial direction of the ground-engaging component 240 and/or the sole structure 204 (and not in the direct transverse direction). If desired, any one or more sets of cells may be aligned along a line that extends from the rear lateral direction toward the forward medial direction of the ground-engaging component 240 and/or sole structure 204. These sets of "substantially aligned" or "highly substantially aligned" cells can help provide more natural flexion and motion for the foot, e.g., as the person's weight rolls forward from the heel and/or midfoot to the toe during a step cycle. For example, the substantially aligned or highly substantially aligned open spaces 244 along lines 602A-602C and 604A-604G provide and help define lines of flex that extend at least partially across the sole structure 204 and/or the ground-engaging component 240 from the lateral side to the medial side direction and help the ground-engaging component 240 bend with the foot as the wearer rolls the foot forward for the toe-off phase of a step cycle. The cells in lines 602A-602C and 604A-604G may contain from 3-10 cells or even from 3-8 cells. Also, the "substantially aligned" or "highly substantially aligned" cells may be adjacent one another along the line, but this is not a requirement in all structures in accordance with this invention (e.g., one or more non-aligned cells may be provided between some of the aligned cells, if desired).

FIG. 9A further shows three sets of adjacent cells located along lines 606A, 606B, and 606C that extend in the generally forward-to-rear direction in the heel support area. The lines 606A-606C may be generally spaced apart in the medial side-to-lateral side direction. The cells in lines 606A, 606B and/or 606C may be substantially aligned or highly substantially aligned, if desired, and may contain from 3-12 cells or even from 4-8 cells. These lines 606A-606C of cells (which may be open and/or partially open cells) also may help provide more natural flexion and motion for the foot, e.g., as the person's weight rolls forward from the heel to the toe and from the lateral side to the medial side during a step cycle. For example, adjacent open spaces 244 along lines 606A-606C provide and help define lines of flex that extend along the foot from the rear-to-front direction and help the ground-engaging component 240 bend along a front-to-back line or curve with the foot as the wearer rolls the foot from the lateral side to the medial side for the toe-off phase of a step cycle. Notably, as compared to some other plates 240 of this set, the arch support area 290 of this example plate 240 is more closed off than the arch support areas in the plates of FIGS. 5A-8C. This feature, together with the relatively high density (and small cell size) of the matrix structure 250 in this area (with several closed cells) with two clusters 292 of small and tightly packed cells, as shown in FIG. 9B, increases the stiffness of the arch support area 290 of this example plate component 240. Each illustrated "cluster" 292 in this example contains at least six complete open cells (and/or optionally, at least six open, partially open, and/or closed cells) within a 35 mm diameter circle (or even within a 30 mm diameter circle or a 25 mm diameter circle).

FIGS. 10A-10C show the next larger size of the ground-engaging component 240 of this set (size 12). While the components 240 of FIGS. 10A-10C are generally similar to those of FIGS. 5A-9C, the matrix structure 250 differs. More specifically, because the size of the plates 240 in FIGS. 10A-10C is increased from the sizes of the plates 240 shown in FIGS. 5A-9C, the matrix structure 250 has been changed so as to allow the plates 240 of FIGS. 10A-10C to have substantially the desired same stiffness/flex profile as the plates 240 shown in FIGS. 5A-9C (e.g., a forefoot stiffness within ±10% of any one or more of the other plates 240 in the set described above). In this illustrated example, the component 240 of FIGS. 10A-10C was independently designed (e.g., to have the desired stiffness characteristics), and the corresponding component for the size 11 shoe of the set, if any (not shown in the figures), is a scaled down version of the size 12 component 240 of FIGS. 10A-10C.

Referring to FIG. 10C (which is an enlarged view of a portion of FIG. 10A), the upper-facing surface 248U of the ground-engaging component 240 is shown with additional lines to highlight certain aligned cell features in this component 240. In this size 12 ground-engaging component structure 240, the matrix structure 250 forms six substantially aligned or highly substantially aligned sets of open cells (identified by lines 602A, 602B, 602C, 602D, 602E, and 602F) rearward of the substantially aligned set of primary traction elements (shown by line 600). Further, in this ground-engaging component structure 240, the matrix structure 250 forms six substantially aligned or highly substantially aligned sets of open cells (identified by lines 604A, 604B, 604C, 604D, 604E, and 604F) forward of the substantially aligned set of primary traction elements (shown by line 600). While the substantially aligned or highly substantially aligned sets of cells shown in FIGS. 10A-10C are open cells 252, additionally or alternatively, the aligned cells may include partially open cells and/or closed cells, if desired. To form a "line" of substantially aligned or highly substantially aligned cells, as described above, the geographic centers (e.g., centers of the cell openings) of three or more cells will be located within a predetermined distance from a single straight line.

Notably, while not a requirement for any or all "sets" of three or more aligned cells, the "alignment lines" 602A-602F and 604A-604F shown in the illustrated example of FIG. 10C may extend from a rear lateral direction toward a forward medial direction of the ground-engaging component 240 and/or the sole structure 204 (and not in the direct transverse direction). If desired, any one or more sets of cells may be aligned along a line that extends from the rear lateral direction toward the forward medial direction of the ground-engaging component 240 and/or sole structure 204. These sets of "substantially aligned" or "highly substantially aligned" cells can help provide more natural flexion and motion for the foot, e.g., as the person's weight rolls forward from the heel and/or midfoot to the toe during a step cycle. For example, the substantially aligned or highly substantially aligned open spaces 244 along lines 602A-602F and 604A-604F provide and help define lines of flex that extend at least partially across the sole structure 204 and/or the ground-engaging component 240 from the lateral side to the medial side direction and help the ground-engaging component 240 bend with the foot as the wearer rolls the foot forward for the toe-off phase of a step cycle. The cells in lines 602A-602F and 604A-604F may contain from 3-10 cells or even from 3-8 cells. Also, the "substantially aligned" or "highly substantially aligned" cells may be adjacent one another along the line, but this is not a requirement in all structures in accordance with this invention (e.g., one or more non-aligned cells may be provided between some of the aligned cells, if desired).

FIG. 10A further shows three sets of adjacent cells located along lines 606A, 606B, and 606C that extend in the generally forward-to-rear direction in the heel support area. The lines 606A-606C may be generally spaced apart in the medial side-to-lateral side direction. The cells in lines 606A, 606B and/or 606C may be substantially aligned or highly substantially aligned, if desired, and may contain from 3-12 cells or even from 4-10 cells. These lines 606A-606C of cells (which may be open and/or partially open cells) also may help provide more natural flexion and motion for the foot, e.g., as the person's weight rolls forward from the heel to the toe and from the lateral side to the medial side during a step cycle. For example, adjacent open spaces 244 along lines 606A-606C provide and help define lines of flex that extend across the foot from the rear-to-front direction and help the ground-engaging component 240 bend along a front-to-back line or curve with the foot as the wearer rolls the foot from the lateral side to the medial side for the toe-off phase of a step cycle. The relatively high density (and small cell size) of the matrix structure 250 in the arch support area 290 (with several closed cells) with two clusters 292 of small and tightly packed cells, as shown in FIG. 10B, increases the stiffness of the arch support area 290 of this example plate component 240. Each illustrated "cluster" 292 in this example contains at least six complete open cells (and/or optionally, at least six open, partially open, and/or closed cells) within a 35 mm diameter circle (or even within a 30 mm diameter circle or a 25 mm diameter circle).

As noted and described above in conjunction with FIGS. 4A-4H, the matrix structures 250 of the ground-engaging components 240 of FIGS. 5A-10C may define secondary traction elements, e.g., at corners 504C of the matrix structure 250 defined by generally hexagonal ridges 504 around the cells 252, 254 of the ground-facing surfaces 248G (e.g., wherein the secondary traction elements 264 may be formed as three sided pyramids). Also, as illustrated in FIGS. 5B, 6B, 7B, 8B, 9B, and 10B, the matrix structures 250 of each of these ground-engaging components 240 may define a cluster 294 of at least ten secondary traction elements at corners 504C (and in some examples, at least 12 secondary traction elements at corners 504C) located within a 35 mm diameter circle (and in some examples, within a 30 mm diameter circle or within a 25 mm diameter circle) at one or more locations in the matrix structure 250. The "circles" noted above may contain from 3 to 9 cells (open cells, partially open cells, and/or closed cells) of the matrix structure 250. FIGS. 5B, 6B, 7B, 8B, 9B, and 10B illustrate such clusters 294 located along a medial side of the ground-engaging component 240 rearward of a first metatarsal head support area and forward of a heel support area of the ground-engaging component 240 (e.g., near the rearmost medial primary cleat 262). Additional such clusters may be provided at other locations, if desired. These clusters 294 define relatively small and dense cell arrangements, which increase the stiffness at these local areas and provide support and added traction. In the illustrated examples, one such cluster 294 is located just rearward of the rearmost medial side primary cleat 262 and provides additional support, stiffness, and traction under the big toe and/or first metatarsal head support areas of the sole structure 204 (e.g., to provide extra support for the push and toe-off phases of the step cycle).

In the discussion above, changes in the matrix structure 250, and particularly the cell sizes, arrangements, and orientations, are described and used to control the stiffness profile of the sole plate 240 and/or to provide substantially constant forefoot stiffness of ±10% across a set of plates 240 of multiple different sizes. Additionally or alternatively, other features of the ground-engaging component 240 can be altered to impact stiffness of the component 240, including, for example: cell density (e.g., the number of cells/unit area); cell shape (round, elongated, ovoid, elliptical, more "angular" or polygonal, etc.); cell thickness (or "z-height") in the ground-facing surface 248G to upper-facing surface 248U direction; matrix 250 material; glass, carbon, or other reinforcing fiber content of the matrix 250 material; cell width (e.g., the distance between adjacent cells); the outer perimeter boundary rim 242O size (e.g., width); the outer perimeter boundary rim 242O thickness; the outer perimeter boundary rim 242O extension amount around the outer perimeter; and the like.

Ground-engaging components in accordance with at least some examples of this invention will have a very lightweight yet stiff construction (including forefoot stiffness). As some more specific examples, ground-engaging components 240 of the types described above may include: (a) an outer perimeter boundary rim 242O that at least partially defines an outer perimeter of the ground-engaging component 240, wherein the outer perimeter boundary rim 242O defines an upper-facing surface 248U and a ground-facing surface 248G opposite the upper-facing surface 248U, and wherein the outer perimeter boundary rim 242O defines an open space 244 at least at a forefoot support area of the ground-engaging component 240; and (b) a matrix structure 250 extending from the outer perimeter boundary rim (e.g., from the ground-facing surface 248G and/or the upper-facing surface 248U) and at least partially across the open space 244 at least at the forefoot support area to define an open cellular construction with plural at least partially open cells across the open space 244 at least at the forefoot support area. This ground-engaging component 240 may include at least one of the following sets of properties:

| Property Set | Size Range (inches) | Weight (grams) |
|---|---|---|
| A | 9 to 9.25 | Less than 60 grams |
| B | 9.25 to 9.5 | Less than 62 grams |
| C | 9.5 to 9.75 | Less than 64 grams |
| D | 9.75 to 10.125 | Less than 68 grams |
| E | 10.125 to 10.438 | Less than 71 grams |
| F | 10.438 to 10.75 | Less than 75 grams |
| G | 10.75 to 11.125 | Less than 78 grams |
| H | 11.125 to 11.41 | Less than 82 grams |
| I | 11.41 to 11.72 | Less than 88 grams |
| J | 11.72 to 12.03 | Less than 94 grams |

wherein the "size range" corresponds to a longitudinal length L of the ground-engaging component 240, and wherein the "weight" corresponds to the weight of the outer perimeter boundary rim 242O and the engaged matrix structure 250 of the ground-engaging component 240 alone, excluding any separately engaged cleats, spikes, or other primary traction elements. The ground-engaging component 240 having any one or more of these properties may extend to support an entire plantar surface of a wearer's foot.

Ground-engaging components 240 in accordance with some examples of this invention also may include at least one of the following sets of properties:

| Property Set | Size Range (inches) | Weight (grams) |
|---|---|---|
| A | 9 to 9.25 | Less than 50 grams |
| B | 9.25 to 9.5 | Less than 52 grams |
| C | 9.5 to 9.75 | Less than 54 grams |
| D | 9.75 to 10.125 | Less than 58 grams |
| E | 10.125 to 10.438 | Less than 63 grams |
| F | 10.438 to 10.75 | Less than 68 grams |
| G | 10.75 to 11.125 | Less than 72 grams |
| H | 11.125 to 11.41 | Less than 76 grams |
| I | 11.41 to 11.72 | Less than 82 grams |
| J | 11.72 to 12.03 | Less than 88 grams |

wherein the "size range" and "weight" have the definitions described above. As yet another example, ground-engaging components 240 in accordance with some examples of this invention may include at least one of the following sets of properties:

| Property Set | Size Range (inches) | Weight (grams) |
|---|---|---|
| A | 9 to 9.25 | Less than 45 grams |
| B | 9.25 to 9.5 | Less than 48 grams |
| C | 9.5 to 9.75 | Less than 51 grams |
| D | 9.75 to 10.125 | Less than 55 grams |
| E | 10.125 to 10.438 | Less than 60 grams |
| F | 10.438 to 10.75 | Less than 62 grams |
| G | 10.75 to 11.125 | Less than 66 grams |
| H | 11.125 to 11.41 | Less than 72 grams |
| I | 11.41 to 11.72 | Less than 78 grams |
| J | 11.72 to 12.03 | Less than 84 grams |

wherein the "size range" and "weight" have the definitions described above.

As some further potential properties, ground-engaging components 240 in accordance with at least some examples of this invention may include at least one of the following sets of properties:

| Property Set | Size Range (inches) | Size/Weight Ratio (in/g) |
|---|---|---|
| A | 9 to 9.25 | At least 0.145 |
| B | 9.25 to 9.5 | At least 0.145 |
| C | 9.5 to 9.75 | At least 0.145 |
| D | 9.75 to 10.125 | At least 0.14 |
| E | 10.125 to 10.438 | At least 0.14 |
| F | 10.438 to 10.75 | At least 0.135 |
| G | 10.75 to 11.125 | At least 0.135 |
| H | 11.125 to 11.41 | At least 0.13 |
| I | 11.41 to 11.72 | At least 0.125 |
| J | 11.72 to 12.03 | At least 0.12 |

wherein the "size range" corresponds to a longitudinal length L of the ground-engaging component 240, and wherein the "size/weight ratio" corresponds to a ratio of the longitudinal length of the ground-engaging component (in inches) with the weight (in grams) of the combined outer perimeter boundary rim 242O and the engaged matrix structure 250 of the ground-engaging component 240 alone, excluding any separately engaged cleats, spikes, or other primary traction elements. Ground-engaging components 240 having any one or more of these properties may extend to support an entire plantar surface of a wearer's foot.

Ground-engaging components 240 in accordance with some examples of this invention may include at least one of the following sets of properties:

| Property Set | Size Range (inches) | Size/Weight Ratio (in/g) |
|---|---|---|
| A | 9 to 9.25 | At least 0.175 |
| B | 9.25 to 9.5 | At least 0.175 |
| C | 9.5 to 9.75 | At least 0.17 |
| D | 9.75 to 10.125 | At least 0.165 |
| E | 10.125 to 10.438 | At least 0.16 |
| F | 10.438 to 10.75 | At least 0.15 |
| G | 10.75 to 11.125 | At least 0.145 |
| H | 11.125 to 11.41 | At least 0.145 |
| I | 11.41 to 11.72 | At least 0.135 |
| J | 11.72 to 12.03 | At least 0.13 |

wherein the "size range" and "size/weight ratio" have the definitions described above. As yet additional examples, ground-engaging components 240 in accordance with some examples of this invention may include at least one of the following sets of properties:

| Property Set | Size Range (inches) | Size/Weight Ratio (in/g) |
|---|---|---|
| A | 9 to 9.25 | At least 0.2 |
| B | 9.25 to 9.5 | At least 0.19 |
| C | 9.5 to 9.75 | At least 0.185 |
| D | 9.75 to 10.125 | At least 0.175 |
| E | 10.125 to 10.438 | At least 0.165 |
| F | 10.438 to 10.75 | At least 0.165 |
| G | 10.75 to 11.125 | At least 0.16 |
| H | 11.125 to 11.41 | At least 0.15 |
| I | 11.41 to 11.72 | At least 0.145 |
| J | 11.72 to 12.03 | At least 0.135 |

wherein the "size range" and "size/weight ratio" have the definitions described above.

Figure 11A:
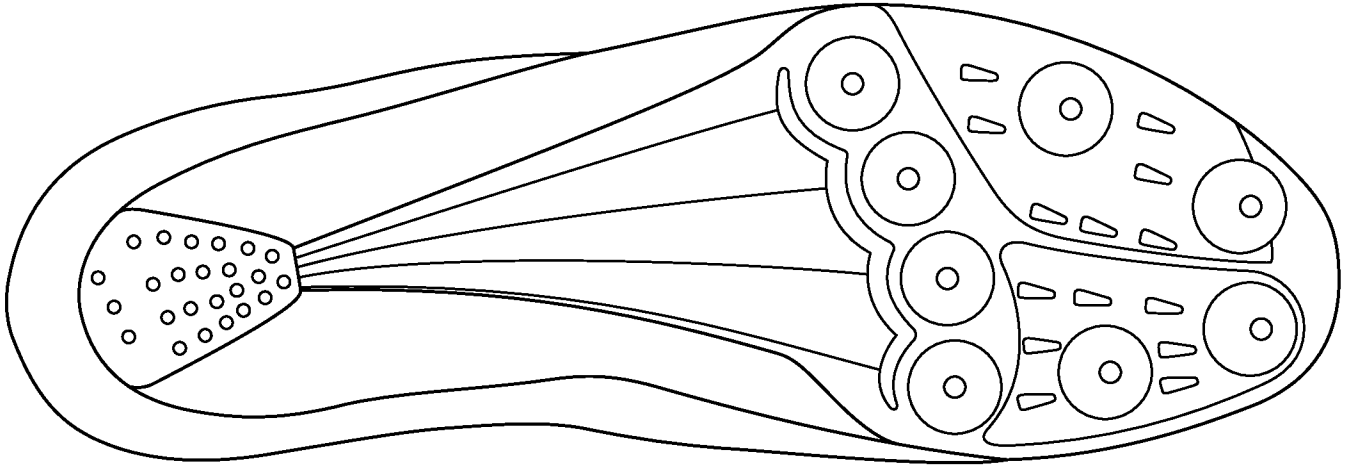
FIG. 11A (Prior Art)
FIGS. 11A-11E provide various views relating to stiffness and energy return testing of example ground-engaging components in accordance with this invention.

As described above, at least some aspects of this invention relate to producing ground-engaging components for articles of footwear that have substantially the same forefoot stiffness/stiffness profile over a range of footwear sizes. Stiffness tests were conducted to compare various stiffness and energy return features of sample sole plates 240 in accordance with at least some examples of this invention (e.g., of the types shown in FIGS. 5A-10C) with a known sole plate of the type shown in FIG. 11A. The test sample sole plates 240 in accordance with examples of this invention included:

Example 1—Plates 240 of the types shown in FIGS. 5A-10C made from PEBAX® Brand 80R53 plastic material available from Arkema Corporation's Renew line;

Example 2—Plates 240 of the types shown in FIGS. 5A-10C made from PEBAX® Brand plastic material available from Arkema Corporation's Rilsan line with 7% added glass fiber; and Example 3—Plates 240 of the types shown in FIGS. 5A-10C made from PEBAX® Brand plastic material available from Arkema Corporation's Rilsan line with 8% added glass fiber.

Figure 11B:
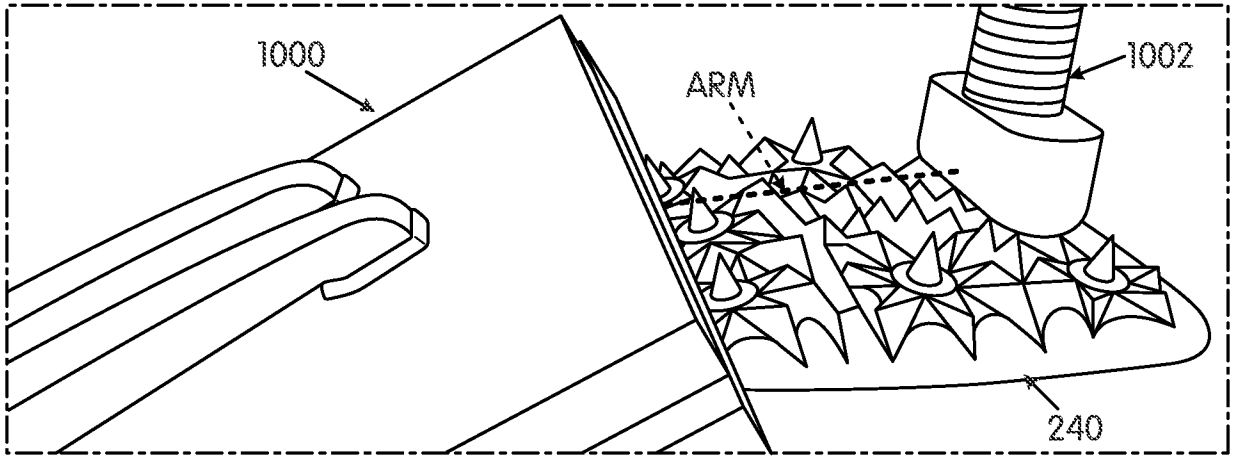
Figure 11C:
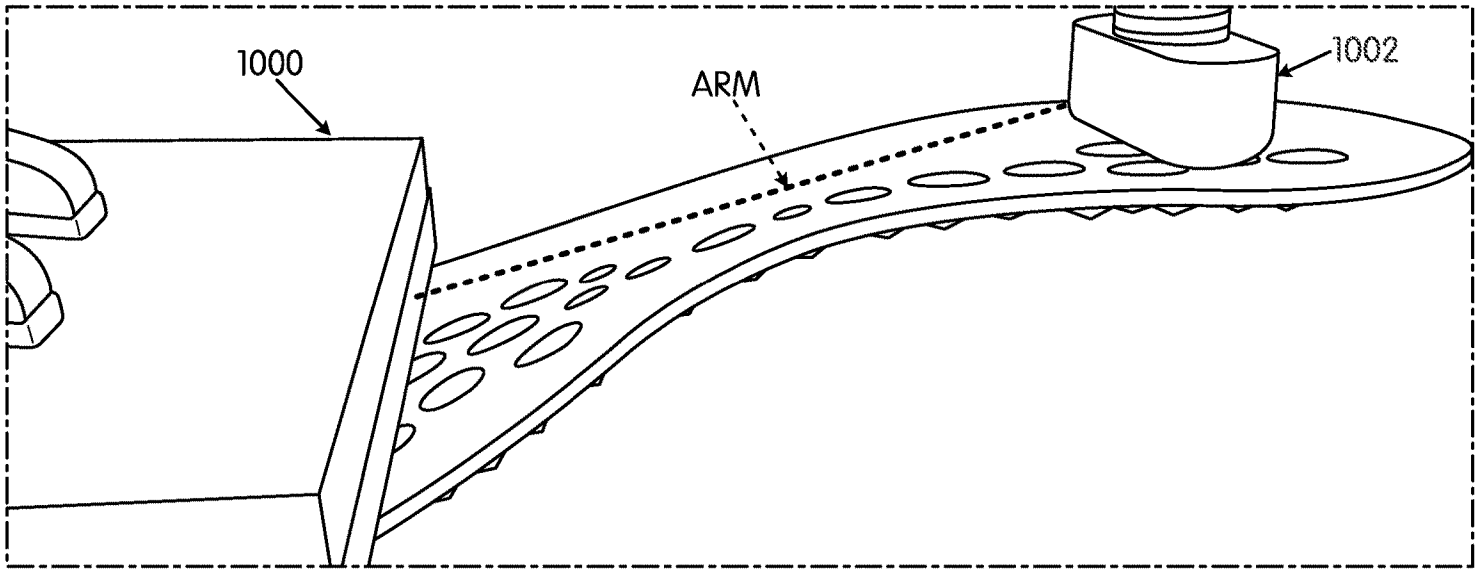
Figure 11D:
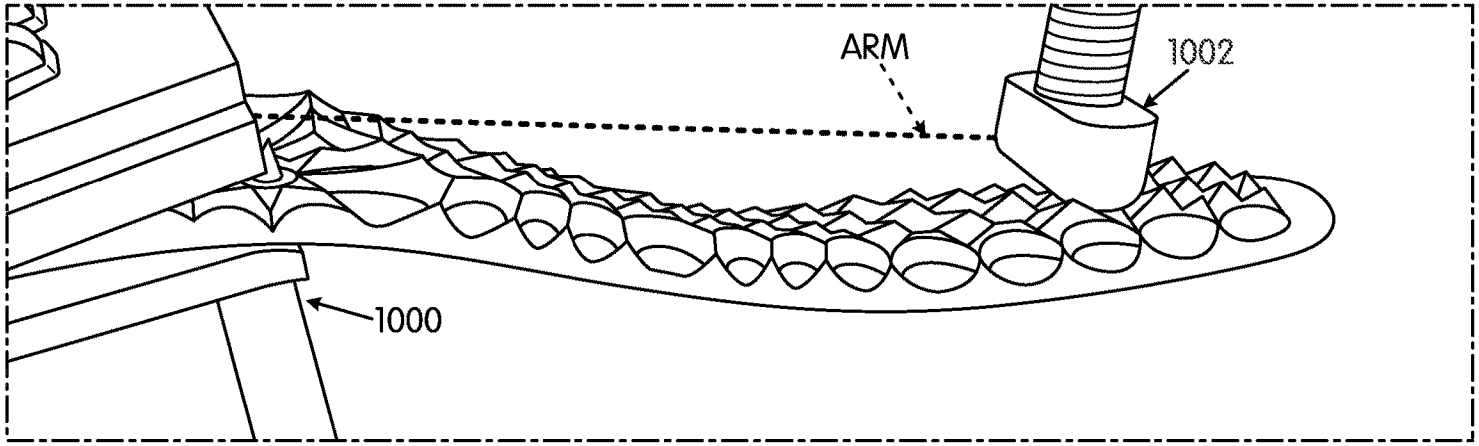

Stiffness, flexibility, and energy return were tested using a cantilever flex test under various product orientations. FIG. 11B shows the test set up for testing forefoot flexibility and energy return. The ground-engaging component 240 is clamped into a vise 1000 so that a portion of the ground-engaging component 240 to be tested is suspended outside of the vise 1000. Force is applied to the suspended portion of the ground-engaging component 240, e.g., by a lever arm 1002, which causes the suspended portion of the component 240 to deflect, rotate, and bend downwardly. The force or load (in N) needed to displace the suspended portion of the ground-engaging component 240 specific distances (in mm) are measured. This force and displacement information, along with the length of the lever arm, allows one to determine the torque (Nm) and angle of flex for the part 240, and the resulting data enables determination of forefoot flex rotational stiffness (as Nm/rad). FIGS. 11C and 11D show similar set ups for measuring heel rotational stiffness in the support direction (FIG. 11C) and heel rotational stiffness in the flex direction (FIG. 11D). Other ways of measuring flex and/or stiffness in various desired areas of components 240 may be used without departing from this invention.

Figure 11E:
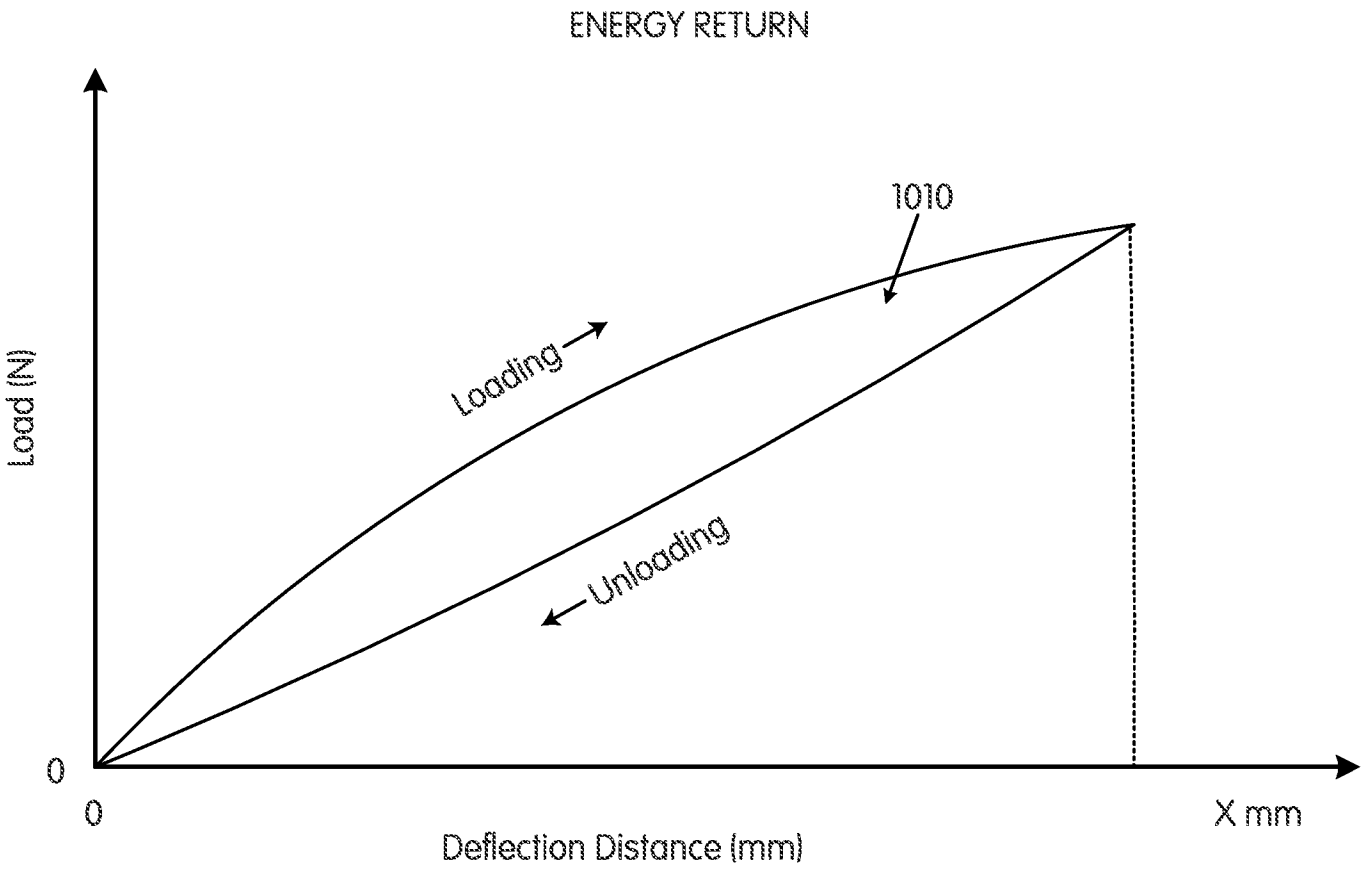

Also, the experimental set ups of FIGS. 11B-11D allow determination of energy return under the applied ground-engaging component 240 test orientations (e.g., forefoot flex energy return, heel support energy return, and heel flex energy return). As shown in FIG. 11E, energy return is calculated using a ratio of the "energy out" during the "unloading" phase (when the force from lever arm 1002 is released and the part returns to its original orientation due to its resiliency) to the "energy in" during the "loading" phase (when the force is applied to the part by the lever arm 1002 to displace the suspended end of the part 240). The area 1010 between the "loading" curve and "unloading" curve in FIG. 11E represents the energy lost during the loading/unloading cycle, and thus, the smaller the area 1010 between the curves, the larger the energy return from the part 240. In other words, the area under the "loading" curve represents the energy expended during loading and the area under the "unloading" curve represents the energy returned as the part returns to its original configuration. The area 1010 between the curves represents the energy lost.

Table 1 shows the forefoot flex rotational stiffness measured for various samples in accordance with this invention and the known sample as described above:

TABLE 1

Cantilever Forefoot Flex Rotational Stiffness (FIG. 11B)

| Size | Known Plate Stiffness (Nm/rad) | Example 1 Stiffness (Nm/rad) | Example 2 Stiffness (Nm/rad) | Example 3 Stiffness (Nm/rad) |
|---|---|---|---|---|
| M5 | | 7.2 | 9.2 | 12.1 |
| M6 | 3.1 | 6.8 | 9.5 | 11.6 |
| M7 | | 6.8 | 9.9 | 12.3 |
| M8 | 3.0 | 6.8 | 9.6 | 11.6 |
| M10 | 3.3 | 6.7 | 9.9 | 12.2 |
| M12 | 3.2 | 6.9 | 9.3 | 12.2 |

As evident from this data, the ground-engaging components 240 in accordance with the examples of the present invention displayed a significantly higher forefoot flex rotational stiffness than did the "known" plate. Moreover, the ground-engaging components 240 in accordance with the examples of the present invention displayed a substantially constant forefoot flex rotational stiffness (all examples within ±10% of one another) across the men's size 5 to 12 range. The ground-engaging components 240 according to the invention were able to achieve these results using a very lightweight plate product 240.

Table 2 shows the forefoot flex energy return measured for various samples in accordance with this invention and the known sample as described above:

TABLE 2

Cantilever Forefoot Flex Energy Return (FIG. 11B)

| Size | Known Plate Energy Return (%) | Example 1 Energy Return (%) | Example 2 Energy Return (%) | Example 3 Energy Return (%) |
|---|---|---|---|---|
| M5 | | 74 | 75 | 74 |
| M6 | 78 | 73 | 73 | 75 |
| M7 | | 73 | 75 | 76 |
| M8 | 79 | 74 | 74 | 76 |
| M10 | 82 | 74 | 76 | 78 |
| M12 | 81 | 72 | 74 | 79 |

As evident from this data, the ground-engaging components 240 in accordance with the examples of this invention had relatively constant energy return properties across the tested size range (e.g., for a given material, all sizes had substantially the same energy return properties) and comparable energy return to that of the known plate. Again, these results were achieved using very lightweight ground-engaging components 240 according to the invention.

Table 3 shows the measured heel support rotational stiffness and Table 4 shows the measured heel support energy return for various samples in accordance with this invention and the known sample as described above:

TABLE 3

Cantilever Heel Support Rotational Stiffness (FIG. 11C)

| Size | Known Plate Stiffness (Nm/rad) | Example 1 Stiffness (Nm/rad) | Example 2 Stiffness (Nm/rad) | Example 3 Stiffness (Nm/rad) |
|---|---|---|---|---|
| M5 | | 5.4 | 6.1 | 8.2 |
| M6 | 6.0 | 4.9 | 5.5 | 7.8 |
| M7 | | 4.8 | 5.8 | 7.8 |
| M8 | 6.4 | 4.9 | 5.8 | 8.5 |
| M10 | 6.2 | 6.7 | 9.3 | 11.9 |
| M12 | 5.9 | 6.8 | 8.8 | 11.4 |

TABLE 4

Cantilever Heel Support Energy Return (FIG. 11C)

| Size | Known Plate Energy Return (%) | Example 1 Energy Return (%) | Example 2 Energy Return (%) | Example 3 Energy Return (%) |
|---|---|---|---|---|
| M5 | | 81 | 80 | 78 |
| M6 | 82 | 76 | 78 | 82 |
| M7 | | 76 | 75 | 80 |
| M8 | 79 | 75 | 74 | 81 |
| M10 | 76 | 72 | 82 | 80 |
| M12 | 79 | 75 | 81 | 80 |

These tables show that the heel support rotational stiffness (Table 3) is relative constant over the men's size 5-8 range for the various components 240 in accordance with this invention and higher (and relatively constant) for the size 10 and 12 products. The energy return (Table 4) remained substantially constant over the entire 5-12 size ranges for the components 240 in accordance with this invention.

Table 5 shows the measured heel flex rotational stiffness and Table 6 shows the measured heel flex energy return for various samples in accordance with this invention and the known sample as described above:

TABLE 5

Cantilever Heel Flex Rotational Stiffness (FIG. 11D)

| Size | Known Plate Stiffness (Nm/rad) | Example 1 Stiffness (Nm/rad) | Example 2 Stiffness (Nm/rad) | Example 3 Stiffness (Nm/rad) |
|---|---|---|---|---|
| M5 | | 4.4 | 5.7 | 7.6 |
| M6 | 4.5 | 4.3 | 5.9 | 8.0 |
| M7 | | 4.1 | 6.0 | 8.1 |
| M8 | 4.7 | 4.3 | 5.9 | 8.0 |
| M10 | 4.6 | 6.2 | 8.3 | 10.8 |
| M12 | 5.2 | 6.0 | 8.1 | 10.9 |

TABLE 6

| Cantilever Heel Flex Energy Return (FIG. 11D) | | | | |
|---|---|---|---|---|
| Size | Known Plate Energy Return (%) | Example 1 Energy Return (%) | Example 2 Energy Return (%) | Example 3 Energy Return (%) |
| M5 | | 90 | 90 | 90 |
| M6 | 87 | 88 | 88 | 91 |
| M7 | | 90 | 89 | 90 |
| M8 | 86 | 92 | 88 | 91 |
| M10 | 87 | 88 | 89 | 89 |
| M12 | 86 | 89 | 88 | 90 |

These tables show that the heel flex rotational stiffness (Table 5) is relative constant over the men's size 5-8 range for the various components 240 in accordance with this invention and higher (and relatively constant) for the size 10 and 12 products. The energy return (Table 6) remained substantially constant over the entire size 5-12 ranges for the components 240 in accordance with this invention. Notably, this heel flex testing orientation provided the highest amount of energy return for all plates and orientations tested.

II. CONCLUSION

The present invention is disclosed above and in the accompanying drawings with reference to a variety of embodiments and/or options. The purpose served by the disclosure, however, is to provide examples of various features and concepts related to the invention, not to limit the scope of the invention. One skilled in the relevant art will recognize that numerous variations and modifications may be made to the features of the invention described above without departing from the scope of the present invention, as defined by the appended claims.

For the avoidance of doubt, the present application includes the subject-matter described in the following numbered paragraphs (referred to as "para." or "paras."):

[Para. 1] A ground-engaging component for an article of footwear, comprising:

an outer perimeter boundary rim that at least partially defines an outer perimeter of the ground-engaging component, wherein the outer perimeter boundary rim defines an upper-facing surface and a ground-facing surface opposite the upper-facing surface, and wherein the outer perimeter boundary rim defines an open space at least at a forefoot support area of the ground-engaging component; and a matrix structure extending from the outer perimeter boundary rim and at least partially across the open space at least at the forefoot support area to define an open cellular construction with plural open cells in the open space at least at the forefoot support area, wherein a plurality of the open cells of the open cellular construction have openings with curved perimeters and no distinct corners.

[Para. 2] The ground-engaging component according to Para. 1, wherein the matrix structure further defines a first cleat support area between a lateral side of the outer perimeter boundary rim and a medial side of the outer perimeter boundary rim.

[Para. 3] The ground-engaging component according to Para. 1, wherein the matrix structure further defines a first cleat support area at the ground-facing surface of the outer perimeter boundary rim.

[Para. 4] The ground-engaging component according to Para. 2 or Para. 3, further comprising:

a track spike engaged with the matrix structure at the first cleat support area.

[Para. 5] The ground-engaging component according to Para. 2, Para. 3, or Para. 4, wherein the matrix structure further defines a plurality of secondary traction elements dispersed around the first cleat support area.

[Para. 6] The ground-engaging component according to Para. 1, wherein the matrix structure further defines:

a first cleat support area at or near a lateral side of the ground-facing surface of the outer perimeter boundary rim;

a second cleat support area between the lateral side of the ground-facing surface of the outer perimeter boundary rim and a medial side of the ground-facing surface of the outer perimeter boundary rim;

a third cleat support area between the second cleat support area and the medial side of the ground-facing surface of the outer perimeter boundary rim; and a fourth cleat support area at or near the medial side of the ground-facing surface of the outer perimeter boundary rim.

[Para. 7] The ground-engaging component according to Para. 6, further comprising a first track spike engaged at the first cleat support area, a second track spike engaged at the second cleat support area, a third track spike engaged at the third cleat support area, and a fourth track spike engaged at the fourth cleat support area.

[Para. 8] The ground-engaging component according to Para. 6 or Para. 7, wherein each of the first cleat support area, the second cleat support area, and the third cleat support area includes a cleat mount area for engaging a primary traction element, wherein the cleat mount areas of at least the first cleat support area, the second cleat support area, and the third cleat support area are substantially aligned.

[Para. 9] The ground-engaging component according to Para. 6 or Para. 7, wherein each of the first cleat support area, the second cleat support area, and the third cleat support area includes a cleat mount area for engaging a primary traction element, wherein the cleat mount areas of at least the first cleat support area, the second cleat support area, and the third cleat support area are substantially aligned in the forefoot support area of the ground-engaging component along a line that extends from a rear lateral direction toward a forward medial direction of the ground-engaging component.

[Para. 10] The ground-engaging component according to any one of Paras. 6-9, wherein the fourth cleat support area includes a cleat mount area for engaging a primary traction element, wherein the cleat mount area of the fourth cleat support area is located rearward from a line along which the first, second, and third cleat support areas are substantially aligned.

[Para. 11] The ground-engaging component according to any one of Paras. 6-10, wherein the matrix structure further defines a first set of open cells located immediately rearward of the first, second, and third cleat support areas, wherein geographical centers of openings of at least three open cells of the first set of open cells are substantially aligned, and wherein optionally the geographical centers of the openings of the at least three open cells of the first set of open cells are substantially aligned along a line that extends from a rear lateral direction toward a forward medial direction.

[Para. 12] The ground-engaging component according to any one of Paras. 6-10, wherein the matrix structure further defines a first set of open cells located immediately forward of the first, second, and third cleat support areas, wherein geographical centers of openings of at least three open cells of the first set of open cells are substantially aligned, and wherein optionally the geographical centers of the openings of the at least three open cells of the first set of open cells are substantially aligned along a line that extends from a rear lateral direction toward a forward medial direction.

[Para. 13] The ground-engaging component according to any one of Paras. 6-10, wherein the matrix structure further defines:

a first set of open cells located immediately rearward of the first, second, and third cleat support areas, wherein geographical centers of openings of at least three open cells of the first set of open cells are substantially aligned, and wherein optionally the geographical centers of the openings of the at least three open cells of the first set of open cells are substantially aligned along a line that extends from a rear lateral direction toward a forward medial direction; and a second set of open cells located immediately rearward of the first set of open cells, wherein geographical centers of openings of at least three open cells of the second set of open cells are substantially aligned, and wherein optionally the geographical centers of the openings of the at least three open cells of the second set of open cells are substantially aligned along a line that extends from the rear lateral direction toward the forward medial direction.

[Para. 14] The ground-engaging component according to any one of Paras. 6-10, wherein the matrix structure further defines:

a first set of open cells located immediately forward of the first, second, and third cleat support areas, wherein geographical centers of openings of at least three open cells of the first set of open cells are substantially aligned, and wherein optionally the geographical centers of the openings of the at least three open cells of the first set of open cells are substantially aligned along a line that extends from a rear lateral direction toward a forward medial direction; and a second set of open cells located immediately forward of the first set of open cells, wherein geographical centers of openings of at least three open cells of the second set of open cells are substantially aligned, and wherein optionally the geographical centers of the openings of the at least three open cells of the second set of open cells are substantially aligned along a line that extends from the rear lateral direction toward the forward medial direction.

[Para. 15] The ground-engaging component according to any one of Paras. 6-10, wherein the matrix structure further defines:

a first set of open cells located immediately rearward of the first, second, and third cleat support areas, wherein geographical centers of openings of at least three open cells of the first set of open cells are substantially aligned, and wherein optionally the geographical centers of the openings of the at least three open cells of the first set of open cells are substantially aligned along a line that extends from a rear lateral direction toward a forward medial direction; and a second set of open cells located immediately forward of the first, second, and third cleat support areas, wherein geographical centers of openings of at least three open cells of the second set of open cells are substantially aligned, and wherein optionally the geographical centers of the openings of the at least three open cells of the second set of open cells are substantially aligned along a line that extends from the rear lateral direction toward the forward medial direction.

[Para. 16] The ground-engaging component according to Para. 15, wherein the matrix structure further defines at least one of:

a third set of open cells located immediately rearward of the first set of open cells, wherein geographical centers of openings of at least three open cells of the third set of open cells are substantially aligned, and wherein optionally the geographical centers of the openings of the at least three open cells of the third set of open cells are substantially aligned along a line that extends from the rear lateral direction toward the forward medial direction; and/or a fourth set of open cells located immediately forward of the second set of open cells, wherein geographical centers of openings of at least three open cells of the fourth set of open cells are substantially aligned, and wherein optionally the geographical centers of the openings of the at least three open cells of the fourth set of open cells are substantially aligned along a line that extends from the rear lateral direction toward the forward medial direction.

[Para. 17] The ground-engaging component according to Para. 16, wherein the matrix structure further defines at least one of:

a fifth set of open cells located immediately rearward of the third set of open cells, wherein geographical centers of openings of at least three open cells of the fifth set of open cells are substantially aligned, and wherein optionally the geographical centers of the openings of the at least three open cells of the fifth set of open cells are substantially aligned along a line that extends from the rear lateral direction toward the forward medial direction; and/or a sixth set of open cells located immediately forward of the fourth set of open cells, wherein geographical centers of openings of at least three open cells of the sixth set of open cells are substantially aligned, and wherein optionally the geographical centers of the openings of the at least three open cells of the sixth set of open cells are substantially aligned along a line that extends from the rear lateral direction toward the forward medial direction.

[Para. 18] The ground-engaging component according to any one of Paras. 6-10, wherein the matrix structure further defines:

a first set of open cells located immediately rearward of the first, second, and third cleat support areas, wherein geographical centers of openings of at least three open cells of the first set of open cells are substantially aligned, and wherein optionally the geographical centers of the openings of the at least three open cells of the first set of open cells are substantially aligned along a line that extends from the rear lateral direction toward the forward medial direction;

a second set of open cells located immediately rearward of the first set of open cells, wherein geographical centers of openings of at least three open cells of the second set of open cells are substantially aligned, and wherein optionally the geographical centers of the openings of the at least three open cells of the second set of open cells are substantially aligned along a line that extends from the rear lateral direction toward the forward medial direction; and a third set of open cells located immediately rearward of the second set of open cells, wherein geographical centers of openings of at least three open cells of the third set of open cells are substantially aligned, and wherein optionally the geographical centers of the openings of the at least three open cells of the third set of open cells are substantially aligned along a line that extends from the rear lateral direction toward the forward medial direction.

[Para. 19] The ground-engaging component according to Para. 18, wherein the matrix structure further defines:

a fourth set of open cells located immediately rearward of the third set of open cells, wherein geographical centers of openings of at least three open cells of the fourth set of open cells are substantially aligned, and wherein optionally the geographical centers of the openings of the at least three open cells of the fourth set of open cells are substantially aligned along a line that extends from the rear lateral direction toward the forward medial direction.

[Para. 20] The ground-engaging component according to Para. 19, wherein the matrix structure further defines:

a fifth set of open cells located immediately rearward of the fourth set of open cells, wherein geographical centers of openings of at least three open cells of the fifth set of open cells are substantially aligned, and wherein optionally the geographical centers of the openings of the at least three open cells of the fifth set of open cells are substantially aligned along a line that extends from the rear lateral direction toward the forward medial direction.

[Para. 21] The ground-engaging component according to Para. 20, wherein the matrix structure further defines:

a sixth set of open cells located immediately rearward of the fifth set of open cells, wherein geographical centers of openings of at least three open cells of the sixth set of open cells are substantially aligned, and wherein optionally the geographical centers of the openings of the at least three open cells of the sixth set of open cells are substantially aligned along a line that extends from the rear lateral direction toward the forward medial direction.

[Para. 22] The ground-engaging component according to any one of Paras. 6-10 or Paras. 18-21, wherein the matrix structure further defines:

a first set of open cells located immediately forward of the first, second, and third cleat support areas, wherein geographical centers of openings of at least three open cells of the first set of open cells are substantially aligned, and wherein optionally the geographical centers of the openings of the at least three open cells of the first set of open cells are substantially aligned along a line that extends from the rear lateral direction toward the forward medial direction;

a second set of open cells located immediately forward of the first set of open cells, wherein geographical centers of openings of at least three open cells of the second set of open cells are substantially aligned, and wherein optionally the geographical centers of the openings of the at least three open cells of the second set of open cells are substantially aligned along a line that extends from the rear lateral direction toward the forward medial direction; and a third set of open cells located immediately forward of the second set of open cells, wherein geographical centers of openings of at least three open cells of the third set of open cells are substantially aligned, and wherein optionally the geographical centers of the openings of the at least three open cells of the third set of open cells are substantially aligned along a line that extends from the rear lateral direction toward the forward medial direction.

[Para. 23] The ground-engaging component according to Para. 22, wherein the matrix structure further defines:

a fourth set of open cells located immediately forward of the third set of open cells, wherein geographical centers of openings of at least three open cells of the fourth set of open cells are substantially aligned, and wherein optionally the geographical centers of the openings of the at least three open cells of the fourth set of open cells are substantially aligned along a line that extends from the rear lateral direction toward the forward medial direction.

[Para. 24] The ground-engaging component according to Para. 23, wherein the matrix structure further defines:

a fifth set of open cells located immediately forward of the fourth set of open cells, wherein geographical centers of openings of at least three open cells of the fifth set of open cells are substantially aligned, and wherein optionally the geographical centers of the openings of the at least three open cells of the fifth set of open cells are substantially aligned along a line that extends from the rear lateral direction toward the forward medial direction.

[Para. 25] The ground-engaging component according to Para. 24, wherein the matrix structure further defines:

a sixth set of open cells located immediately forward of the fifth set of open cells, wherein geographical centers of openings of at least three open cells of the sixth set of open cells are substantially aligned, and wherein optionally the geographical centers of the openings of the at least three open cells of the sixth set of open cells are substantially aligned along a line that extends from the rear lateral direction toward the forward medial direction.

[Para. 26] The ground-engaging component according to Para. 6, wherein cleat mount areas of the first cleat support area, the second cleat support area, the third cleat support area, and the fourth cleat support area are located forward of a plane perpendicular to a longitudinal direction of the ground-engaging component and located a distance of 0.6L forward from a rear heel location of the ground-engaging component, wherein L is a longitudinal length of the ground-engaging component.

[Para. 27] The ground-engaging component according to any preceding Para., wherein the matrix structure additionally forms a plurality of closed cells and/or a plurality of partially closed cells beneath the ground-facing surface of the outer perimeter boundary rim.

[Para. 28] The ground-engaging component according to Para. 1, wherein at least 40% of individual open cells of the open cellular construction each includes a plurality of secondary traction elements dispersed around a periphery of that individual open cell.

[Para. 29] The ground-engaging component according to Para. 1, wherein at least 40% of individual open cells of the open cellular construction each includes at least four secondary traction elements dispersed around a periphery of that individual open cell.

[Para. 30] The ground-engaging component according to Para. 1, wherein at least 40% of individual open cells of the open cellular construction each includes six secondary traction elements dispersed around a periphery of that individual open cell.

[Para. 31. The ground-engaging component according to Para. 1, wherein the matrix structure defines a cluster of at least ten secondary traction elements within a 30 mm diameter circle at a location along a medial side of the ground-engaging component rearward of a first metatarsal head support area of the ground-engaging component and forward of a heel support area of the ground-engaging component.

[Para. 32] The ground-engaging component according to any preceding Para., wherein the outer perimeter boundary rim has a width dimension of at least 6 mm.

[Para. 33] The ground-engaging component according to any preceding Para., wherein the outer perimeter boundary rim is present around at least 80% of the outer perimeter of the ground-engaging component.

[Para. 34] The ground-engaging component according to any preceding Para., wherein at least 60% of the open cells of the open cellular construction have openings with curved perimeters and no distinct corners.

[Para. 35] A ground-engaging component for an article of footwear, comprising:

an outer perimeter boundary rim that at least partially defines an outer perimeter of the ground-engaging component, wherein the outer perimeter boundary rim defines an upper-facing surface and a ground-facing surface opposite the upper-facing surface, and wherein the outer perimeter boundary rim defines an open space at least at a forefoot support area of the ground-engaging component; and a matrix structure extending from the outer perimeter boundary rim and at least partially across the open space at least at the forefoot support area to define an open cellular construction with plural open cells across the open space at least at the forefoot support area, wherein the ground-engaging component includes at least one of the following sets of properties:

| Property Set | Size Range (inches) | Weight (grams) |
|---|---|---|
| A | 9 to 9.25 | Less than 60 grams |
| B | 9.25 to 9.5 | Less than 62 grams |
| C | 9.5 to 9.75 | Less than 64 grams |
| D | 9.75 to 10.125 | Less than 68 grams |
| E | 10.125 to 10.438 | Less than 71 grams |
| F | 10.438 to 10.75 | Less than 75 grams |
| G | 10.75 to 11.125 | Less than 78 grams |
| H | 11.125 to 11.41 | Less than 82 grams |
| I | 11.41 to 11.72 | Less than 88 grams |
| J | 11.72 to 12.03 | Less than 94 grams |
| | | Size/Weight Ratio (inches/grams) |
| K | 9 to 9.25 | At least 0.145 |
| L | 9.25 to 9.5 | At least 0.145 |
| M | 9.5 to 9.75 | At least 0.145 |
| N | 9.75 to 10.125 | At least 0.14 |
| O | 10.125 to 10.438 | At least 0.14 |
| P | 10.438 to 10.75 | At least 0.135 |
| Q | 10.75 to 11.125 | At least 0.135 |
| R | 11.125 to 11.41 | At least 0.13 |
| S | 11.41 to 11.72 | At least 0.125 |
| T | 11.72 to 12.03 | At least 0.12 |

wherein the "size range" corresponds to a longitudinal length of the ground-engaging component, wherein the "weight" corresponds to a weight of the outer perimeter boundary rim and the engaged matrix structure of the ground-engaging component alone, excluding any separately engaged cleats, spikes, or other primary traction elements, and wherein the "size/weight ratio" corresponds to a ratio of the longitudinal length of the ground-engaging component (in inches) with the weight (in grams).

[Para. 36] The ground-engaging component according to Para. 35, wherein the ground-engaging component extends to support an entire plantar surface of a wearer's foot.

[Para. 37] The ground-engaging component according to Para. 35 or Para. 36, wherein the matrix structure further defines a first cleat support area between a lateral side of the outer perimeter boundary rim and a medial side of the outer perimeter boundary rim.

[Para. 38] The ground-engaging component according to Para. 35 or Para. 36, wherein the matrix structure further defines a first cleat support area at the ground-facing surface of the outer perimeter boundary rim.

[Para. 39] The ground-engaging component according to Para. 37 or Para. 38, further comprising:

a track spike engaged with the matrix structure at the first cleat support area.

[Para. 40] The ground-engaging component according to any one of Para. 37, Para. 38, or Para. 39, wherein the matrix structure further defines a plurality of secondary traction elements dispersed around the first cleat support area.

[Para. 41] The ground-engaging component according to Para. 35, wherein the matrix structure further defines a plurality of cleat support areas located at one or more of the following: (a) at or near the ground-facing surface of the outer perimeter boundary rim, (b) at least partially within the open space, or (c) completely within the open space.

[Para. 42] The ground-engaging component according to Para. 41, further comprising a plurality of track spikes engaged with the plurality of cleat support areas such that each cleat support area supports a single track spike.

[Para. 43] A set of ground-engaging components for articles of footwear of varying footwear sizes, comprising:

(a) a first ground-engaging component of a first standard size including: (i) an outer perimeter boundary rim that at least partially defines an outer perimeter of the first ground-engaging component, wherein the outer perimeter boundary rim of the first ground-engaging component defines an upper-facing surface and a ground-facing surface opposite the upper-facing surface, and wherein the outer perimeter boundary rim of the first ground-engaging component defines an open space at least at a forefoot support area of the first ground-engaging component, and (ii) a matrix structure extending from the outer perimeter boundary rim and at least partially across the open space of the first ground-engaging component at least at the forefoot support area of the first ground-engaging component to define an open cellular construction with plural open cells across the open space at least at the forefoot support area of the first ground-engaging component; and (b) a second ground-engaging component of a second standard size including: (i) an outer perimeter boundary rim that at least partially defines an outer perimeter of the second ground-engaging component, wherein the outer perimeter boundary rim of the second ground-engaging component defines an upper-facing surface and a ground-facing surface opposite the upper-facing surface, and wherein the outer perimeter boundary rim of the second ground-engaging component defines an open space at least at a forefoot support area of the second ground-engaging component, and (ii) a matrix structure extending from the outer perimeter boundary rim and at least partially across the open space of the second ground-engaging component at least at the forefoot support area of the second ground-engaging component to define an open cellular construction with plural open cells across the open space at least at the forefoot support area of the second ground-engaging component, wherein the second standard size of the second ground-engaging component is at least ±two standard sizes different from the first standard size of the first ground-engaging component, and wherein the matrix structure of the first ground-engaging component and the matrix structure of the second ground-engaging component differ from one another and are structured and arranged with respect to the outer perimeter boundary rim of the first ground-engaging component and the outer perimeter boundary rim of the second ground-engaging component, respectively, so that the second ground-engaging component has a forefoot stiffness within ±10% of a forefoot stiffness of the first ground-engaging component.

[Para. 44] The set of ground-engaging components according to Para. 43, wherein the second standard size is ±two standard sizes different from the first standard size.

[Para. 45] The set of ground-engaging components according to Para. 43 or Para. 44, further comprising:

a third ground-engaging component of a third standard size including: (i) an outer perimeter boundary rim that at least partially defines an outer perimeter of the third ground-engaging component, wherein the outer perimeter boundary rim of the third ground-engaging component defines an upper-facing surface and a ground-facing surface opposite the upper-facing surface, and wherein the outer perimeter boundary rim of the third ground-engaging component defines an open space at least at a forefoot support area of the third ground-engaging component, and (ii) a matrix structure extending from the outer perimeter boundary rim and at least partially across the open space of the third ground-engaging component at least at the forefoot support area of the third ground-engaging component to define an open cellular construction with plural open cells across the open space at least at the forefoot support area of the third ground-engaging component, wherein the third standard size of the third ground-engaging component is ±one standard size different from the first standard size of the first ground-engaging component, and wherein the matrix structure of the first ground-engaging component and the matrix structure of the third ground-engaging component are structured and arranged with respect to the outer perimeter boundary rim of the first ground-engaging component and the outer perimeter boundary rim of the third ground-engaging component, respectively, so that the third ground-engaging component has a forefoot stiffness within ±10% of the forefoot stiffness of the first ground-engaging component.

[Para. 46] The set of ground-engaging components according to Para. 45, wherein the third ground-engaging component is one of: a scaled down version of the first ground-engaging component or a scaled up version of the first ground-engaging component.

[Para. 47] The set of ground-engaging components according to Para. 45, wherein matrix structure of the third ground-engaging component is one of: a scaled down version of the matrix structure of the first ground-engaging component or a scaled up version of the matrix structure of the first ground-engaging component.

[Para. 48] The set of ground-engaging components according to Para. 43 or Para. 44, further comprising:

(a) a third ground-engaging component of a third standard size including: (i) an outer perimeter boundary rim that at least partially defines an outer perimeter of the third ground-engaging component, wherein the outer perimeter boundary rim of the third ground-engaging component defines an upper-facing surface and a ground-facing surface opposite the upper-facing surface, and wherein the outer perimeter boundary rim of the third ground-engaging component defines an open space at least at a forefoot support area of the third ground-engaging component, and (ii) a matrix structure extending from the outer perimeter boundary rim and at least partially across the open space of the third ground-engaging component at least at the forefoot support area of the third ground-engaging component to define an open cellular construction with plural open cells across the open space at least at the forefoot support area of the third ground-engaging component, wherein the third standard size of the third ground-engaging component is ±one standard size different from the first standard size of the first ground-engaging component, and wherein the matrix structure of the first ground-engaging component and the matrix structure of the third ground-engaging component are structured and arranged with respect to the outer perimeter boundary rim of the first ground-engaging component and the outer perimeter boundary rim of the third ground-engaging component, respectively, so that the third ground-engaging component has a forefoot stiffness within ±10% of the forefoot stiffness of the first ground-engaging component; and (b) a fourth ground-engaging component of a fourth standard size including: (i) an outer perimeter boundary rim that at least partially defines an outer perimeter of the fourth ground-engaging component, wherein the outer perimeter boundary rim of the fourth ground-engaging component defines an upper-facing surface and a ground-facing surface opposite the upper-facing surface, and wherein the outer perimeter boundary rim of the fourth ground-engaging component defines an open space at least at a forefoot support area of the fourth ground-engaging component, and (ii) a matrix structure extending from the outer perimeter boundary rim and at least partially across the open space of the fourth ground-engaging component at least at the forefoot support area of the fourth ground-engaging component to define an open cellular construction with plural open cells across the open space at least at the forefoot support area of the fourth ground-engaging component, wherein the fourth standard size of the fourth ground-engaging component is ±one standard size different from the second standard size of the second ground-engaging component, and wherein the matrix structure of the second ground-engaging component and the matrix structure of the fourth ground-engaging component are structured and arranged with respect to the outer perimeter boundary rim of the second ground-engaging component and the outer perimeter boundary rim of the fourth ground-engaging component, respectively, so that the fourth ground-engaging component has a forefoot stiffness within ±10% of the forefoot stiffness of the second ground-engaging component;

[Para. 49] The set of ground-engaging components according to Para. 48, wherein the third ground-engaging component is one of: a scaled down version of the first ground-engaging component or a scaled up version of the first ground-engaging component, and wherein the fourth ground-engaging component is one of: a scaled down version of the second ground-engaging component or a scaled up version of the second ground-engaging component.

[Para. 50] The set of ground-engaging components according to Para. 48, wherein the matrix structure of the third ground-engaging component is one of: a scaled down version of the matrix structure of the first ground-engaging component or a scaled up version of the matrix structure of the first ground-engaging component, and wherein the matrix structure of the fourth ground-engaging component is one of: a scaled down version of the matrix structure of the second ground-engaging component or a scaled up version of the matrix structure of the second ground-engaging component.

[Para. 51] The set of ground-engaging components according to Para. 43 or Para. 44, wherein the second ground-engaging component is two standard sizes larger than the first ground-engaging component, and wherein the set of ground-engaging components further includes:

a third ground-engaging component of a third standard size that is two standard sizes larger than the second standard size of the second ground-engaging component, wherein the third ground-engaging component includes: (i) an outer perimeter boundary rim that at least partially defines an outer perimeter of the third ground-engaging component, wherein the outer perimeter boundary rim of the third ground-engaging component defines an upper-facing surface and a ground-facing surface opposite the upper-facing surface, and wherein the outer perimeter boundary rim of the third ground-engaging component defines an open space at least at a forefoot support area of the third ground-engaging component, and (ii) a matrix structure extending from the outer perimeter boundary rim and at least partially across the open space of the third ground-engaging component at least at the forefoot support area of the third ground-engaging component to define an open cellular construction with plural open cells across the open space at least at the forefoot support area of the third ground-engaging component, wherein the matrix structure of the third ground-engaging component differs from the matrix structures of the first and second ground-engaging components, and wherein the matrix structure of the second ground-engaging component and the matrix structure of the third ground-engaging component are structured and arranged with respect to the outer perimeter boundary rim of the second ground-engaging component and the outer perimeter boundary rim of the third ground-engaging component, respectively, so that the third ground-engaging component has a forefoot stiffness within ±10% of the forefoot stiffness of the second ground-engaging component.

[Para. 52] The set of ground-engaging components according to Para. 51, further comprising:

a fourth ground-engaging component of a fourth standard size that is two standard sizes larger than the standard size of the third ground-engaging component, wherein the fourth ground-engaging component includes: (i) an outer perimeter boundary rim that at least partially defines an outer perimeter of the fourth ground-engaging component, wherein the outer perimeter boundary rim of the fourth ground-engaging component defines an upper-facing surface and a ground-facing surface opposite the upper-facing surface, and wherein the outer perimeter boundary rim of the fourth ground-engaging component defines an open space at least at a forefoot support area of the fourth ground-engaging component, and (ii) a matrix structure extending from the outer perimeter boundary rim and at least partially across the open space of the fourth ground-engaging component at least at the forefoot support area of the fourth ground-engaging component to define an open cellular construction with plural open cells across the open space at least at the forefoot support area of the fourth ground-engaging component, wherein the matrix structure of the fourth ground-engaging component differs from the matrix structures of the first, second, and third ground-engaging components, and wherein the matrix structure of the third ground-engaging component and the matrix structure of the fourth ground-engaging component are structured and arranged with respect to the outer perimeter boundary rim of the third ground-engaging component and the outer perimeter boundary rim of the fourth ground-engaging component, respectively, so that the fourth ground-engaging component has a forefoot stiffness within ±10% of the forefoot stiffness of the third ground-engaging component.

[Para. 53] The set of ground-engaging components according to Para. 43 or Para. 44, wherein the second ground-engaging component is at least two standard sizes larger than the first ground-engaging component, and wherein the set of ground-engaging components further includes:

a third ground-engaging component of a third standard size that is at least two standard sizes larger than the second standard size of the second ground-engaging component, wherein the third ground-engaging component includes: (i) an outer perimeter boundary rim that at least partially defines an outer perimeter of the third ground-engaging component, wherein the outer perimeter boundary rim of the third ground-engaging component defines an upper-facing surface and a ground-facing surface opposite the upper-facing surface, and wherein the outer perimeter boundary rim of the third ground-engaging component defines an open space at least at a forefoot support area of the third ground-engaging component, and (ii) a matrix structure extending from the outer perimeter boundary rim and at least partially across the open space of the third ground-engaging component at least at the forefoot support area of the third ground-engaging component to define an open cellular construction with plural open cells across the open space at least at the forefoot support area of the third ground-engaging component, wherein the matrix structure of the third ground-engaging component differs from the matrix structures of the first and second ground-engaging components, and wherein the matrix structure of the second ground-engaging component and the matrix structure of the third ground-engaging component are structured and arranged with respect to the outer perimeter boundary rim of the second ground-engaging component and the outer perimeter boundary rim of the third ground-engaging component, respectively, so that the third ground-engaging component has a forefoot stiffness within ±10% of the forefoot stiffness of the second ground-engaging component.

[Para. 54] The set of ground-engaging components according to Para. 53, further comprising:

a fourth ground-engaging component of a fourth standard size that is at least two standard sizes larger than the standard size of the third ground-engaging component, wherein the fourth ground-engaging component includes: (i) an outer perimeter boundary rim that at least partially defines an outer perimeter of the fourth ground-engaging component, wherein the outer perimeter boundary rim of the fourth ground-engaging component defines an upper-facing surface and a ground-facing surface opposite the upper-facing surface, and wherein the outer perimeter boundary rim of the fourth ground-engaging component defines an open space at least at a forefoot support area of the fourth ground-engaging component, and (ii) a matrix structure extending from the outer perimeter boundary rim and at least partially across the open space of the fourth ground-engaging component at least at the forefoot support area of the fourth ground-engaging component to define an open cellular construction with plural open cells across the open space at least at the forefoot support area of the fourth ground-engaging component, wherein the matrix structure of the fourth ground-engaging component differs from the matrix structures of the first, second, and third ground-engaging components, and wherein the matrix structure of the third ground-engaging component and the matrix structure of the fourth ground-engaging component are structured and arranged with respect to the outer perimeter boundary rim of the third ground-engaging component and the outer perimeter boundary rim of the fourth ground-engaging component, respectively, so that the fourth ground-engaging component has a forefoot stiffness within ±10% of the forefoot stiffness of the third ground-engaging component.

What is claimed is:

1. A ground-engaging component for an article of footwear, comprising:

an outer perimeter boundary rim that at least partially defines an outer perimeter of the ground-engaging component, wherein the outer perimeter boundary rim defines an upper-facing surface and a ground-facing surface opposite the upper-facing surface, and wherein the outer perimeter boundary rim defines an interior area at least at a forefoot support area of the ground-engaging component; and a matrix structure extending from the outer perimeter boundary rim and at least partially across the interior area at least at the forefoot support area to define an open cellular construction with plural open cells across the interior area at least at the forefoot support area, wherein the matrix structure further defines:

a first cleat support area between a lateral side of the outer perimeter boundary rim and a medial side of the outer perimeter boundary rim, or a first cleat support area at the ground-facing surface of the outer perimeter boundary rim, wherein a primary traction element engages with the matrix structure at the first cleat support area;

wherein the matrix structure further defines a plurality of secondary traction elements dispersed around the first cleat support area, wherein the primary traction element comprises a track spike engaged with the matrix structure at the first cleat support area;

wherein the ground-engaging component includes at least one of the following sets of properties:

| Property Set | Size Range (inches) | |
|---|---|---|
| | | Weight (grams) |
| A | 9 to 9.25 | Less than 60 grams |
| B | 9.25 to 9.5 | Less than 62 grams |
| C | 9.5 to 9.75 | Less than 64 grams |
| D | 9.75 to 10.125 | Less than 68 grams |
| E | 10.125 to 10.438 | Less than 71 grams |
| F | 10.438 to 10.75 | Less than 75 grams |
| G | 10.75 to 11.125 | Less than 78 grams |
| H | 11.125 to 11.41 | Less than 82 grams |
| I | 11.41 to 11.72 | Less than 88 grams |
| J | 11.72 to 12.03 | Less than 94 grams |
| | | Size/Weight Ratio (inches/grams) |
| K | 9 to 9.25 | At least 0.145 |
| L | 9.25 to 9.5 | At least 0.145 |
| M | 9.5 to 9.75 | At least 0.145 |
| N | 9.75 to 10.125 | At least 0.14 |
| O | 10.125 to 10.438 | At least 0.14 |
| P | 10.438 to 10.75 | At least 0.135 |
| Q | 10.75 to 11.125 | At least 0.135 |
| R | 11.125 to 11.41 | At least 0.13 |
| S | 11.41 to 11.72 | At least 0.125 |
| T | 11.72 to 12.03 | At least 0.12 |

wherein the "size range" corresponds to a longitudinal length of the ground-engaging component, wherein the "weight" corresponds to a weight of the outer perimeter boundary rim and the matrix structure of the ground-engaging component alone, excluding the primary and secondary traction elements, and wherein the "size/weight ratio" corresponds to a ratio of the longitudinal length of the ground-engaging component (in inches) to the weight (in grams).

2. The ground-engaging component according to claim 1, wherein the ground-engaging component extends to support an entire plantar surface of a wearer's foot.

3. The ground-engaging component according to claim 1, wherein the first cleat support area is between a lateral side of the outer perimeter boundary rim and a medial side of the outer perimeter boundary rim.

4. The ground-engaging component according to claim 1, wherein the first cleat support area is at the ground-facing surface of the outer perimeter boundary rim.

5. The ground-engaging component according to claim 1, wherein the matrix structure further defines a plurality of cleat support areas located at one or more of the following: (a) at or near the ground-facing surface of the outer perimeter boundary rim, (b) at least partially within the interior area, or (c) completely within the interior area.

6. The ground-engaging component according to claim 5, further comprising a plurality of track spikes engaged with the plurality of cleat support areas such that each cleat support area supports a single track spike.

7. A set of ground-engaging components for articles of footwear of varying footwear sizes, comprising:

(a) a first ground-engaging component of a first standard size including: (i) an outer perimeter boundary rim that at least partially defines an outer perimeter of the first ground-engaging component, wherein the outer perimeter boundary rim of the first ground-engaging component defines an upper-facing surface and a ground-facing surface opposite the upper-facing surface, and wherein the outer perimeter boundary rim of the first ground-engaging component defines an interior area at least at a forefoot support area of the first ground-engaging component, and (ii) a matrix structure extending from the outer perimeter boundary rim and at least partially across the interior area of the first ground-engaging component at least at the forefoot support area of the first ground-engaging component to define an open cellular construction with plural open cells across the interior area at least at the forefoot support area of the first ground-engaging component; and (b) a second ground-engaging component of a second standard size including: (i) an outer perimeter boundary rim that at least partially defines an outer perimeter of the second ground-engaging component, wherein the outer perimeter boundary rim of the second ground-engaging component defines an upper-facing surface and a ground-facing surface opposite the upper-facing surface, and wherein the outer perimeter boundary rim of the second ground-engaging component defines an interior area at least at a forefoot support area of the second ground-engaging component, and (ii) a matrix structure extending from the outer perimeter boundary rim and at least partially across the interior area of the second ground-engaging component at least at the forefoot support area of the second ground-engaging component to define an open cellular construction with plural open cells across the interior area at least at the forefoot support area of the second ground-engaging component, wherein the second standard size of the second ground-engaging component is at least ±two standard sizes different from the first standard size of the first ground-engaging component, and wherein the matrix structure of the first ground-engaging component and the matrix structure of the second ground-engaging component differ from one another and are structured and arranged with respect to the outer perimeter boundary rim of the first ground-engaging component and the outer perimeter boundary rim of the second ground-engaging component, respectively, so that the second ground-engaging component has a forefoot stiffness within ±10% of a forefoot stiffness of the first ground-engaging component, when the forefoot stiffness is measured as Nm/rad.

8. The set of ground-engaging components according to claim 7, wherein the second standard size is ±two standard sizes different from the first standard size.

9. The set of ground-engaging components according to claim 7, further comprising:

a third ground-engaging component of a third standard size including: (i) an outer perimeter boundary rim that at least partially defines an outer perimeter of the third ground-engaging component, wherein the outer perimeter boundary rim of the third ground-engaging component defines an upper-facing surface and a ground-facing surface opposite the upper-facing surface, and wherein the outer perimeter boundary rim of the third ground-engaging component defines an interior area at least at a forefoot support area of the third ground-engaging component, and (ii) a matrix structure extending from the outer perimeter boundary rim and at least partially across the interior area of the third ground-engaging component at least at the forefoot support area of the third ground-engaging component to define an open cellular construction with plural open cells across the interior area at least at the forefoot support area of the third ground-engaging component, wherein the third standard size of the third ground-engaging component is ±one standard size different from the first standard size of the first ground-engaging component, and wherein the matrix structure of the first ground-engaging component and the matrix structure of the third ground-engaging component are structured and arranged with respect to the outer perimeter boundary rim of the first ground-engaging component and the outer perimeter boundary rim of the third ground-engaging component, respectively, so that the third ground-engaging component has a forefoot stiffness within ±10% of the forefoot stiffness of the first ground-engaging component, when the forefoot stiffness is measured as Nm/rad.

10. The set of ground-engaging components according to claim 9, wherein the third ground-engaging component is one of: a scaled down version of the first ground-engaging component or a scaled up version of the first ground-engaging component.

11. The set of ground-engaging components according to claim 9, wherein matrix structure of the third ground-engaging component is one of: a scaled down version of the matrix structure of the first ground-engaging component or a scaled up version of the matrix structure of the first ground-engaging component.

12. The set of ground-engaging components according to claim 7, further comprising:

(a) a third ground-engaging component of a third standard size including: (i) an outer perimeter boundary rim that at least partially defines an outer perimeter of the third ground-engaging component, wherein the outer perimeter boundary rim of the third ground-engaging component defines an upper-facing surface and a ground-facing surface opposite the upper-facing surface, and wherein the outer perimeter boundary rim of the third ground-engaging component defines an interior area at least at a forefoot support area of the third ground-engaging component, and (ii) a matrix structure extending from the outer perimeter boundary rim and at least partially across the interior area of the third ground-engaging component at least at the forefoot support area of the third ground-engaging component to define an open cellular construction with plural open cells across the interior area at least at the forefoot support area of the third ground-engaging component, wherein the third standard size of the third ground-engaging component is ±one standard size different from the first standard size of the first ground-engaging component, and wherein the matrix structure of the first ground-engaging component and the matrix structure of the third ground-engaging component are structured and arranged with respect to the outer perimeter boundary rim of the first ground-engaging component and the outer perimeter boundary rim of the third ground-engaging component, respectively, so that the third ground-engaging component has a forefoot stiffness within ±10% of the forefoot stiffness of the first ground-engaging component, when the forefoot stiffness is measured as Nm/rad; and (b) a fourth ground-engaging component of a fourth standard size including: (i) an outer perimeter boundary rim that at least partially defines an outer perimeter of the fourth ground-engaging component, wherein the outer perimeter boundary rim of the fourth ground-engaging component defines an upper-facing surface and a ground-facing surface opposite the upper-facing surface, and wherein the outer perimeter boundary rim of the fourth ground-engaging component defines an interior area at least at a forefoot support area of the fourth ground-engaging component, and (ii) a matrix structure extending from the outer perimeter boundary rim and at least partially across the interior area of the fourth ground-engaging component at least at the forefoot support area of the fourth ground-engaging component to define an open cellular construction with plural open cells across the interior area at least at the forefoot support area of the fourth ground-engaging component, wherein the fourth standard size of the fourth ground-engaging component is ±one standard size different from the second standard size of the second ground-engaging component, and wherein the matrix structure of the second ground-engaging component and the matrix structure of the fourth ground-engaging component are structured and arranged with respect to the outer perimeter boundary rim of the second ground-engaging component and the outer perimeter boundary rim of the fourth ground-engaging component, respectively, so that the fourth ground-engaging component has a forefoot stiffness within ±10% of the forefoot stiffness of the second ground-engaging component, when the forefoot stiffness is measured as Nm/rad.

13. The set of ground-engaging components according to claim 12, wherein the third ground-engaging component is one of: a scaled down version of the first ground-engaging component or a scaled up version of the first ground-engaging component, and wherein the fourth ground-engaging component is one of: a scaled down version of the second ground-engaging component or a scaled up version of the second ground-engaging component.

14. The set of ground-engaging components according to claim 12, wherein the matrix structure of the third ground-engaging component is one of: a scaled down version of the matrix structure of the first ground-engaging component or a scaled up version of the matrix structure of the first ground-engaging component, and wherein the matrix structure of the fourth ground-engaging component is one of: a scaled down version of the matrix structure of the second ground-engaging component or a scaled up version of the matrix structure of the second ground-engaging component.

15. The set of ground-engaging components according to claim 7, wherein the second ground-engaging component is two standard sizes larger than the first ground-engaging component, and wherein the set of ground-engaging components further includes:

a third ground-engaging component of a third standard size that is two standard sizes larger than the second standard size of the second ground-engaging component, wherein the third ground-engaging component includes: (i) an outer perimeter boundary rim that at least partially defines an outer perimeter of the third ground-engaging component, wherein the outer perimeter boundary rim of the third ground-engaging component defines an upper-facing surface and a ground-facing surface opposite the upper-facing surface, and wherein the outer perimeter boundary rim of the third ground-engaging component defines an interior area at least at a forefoot support area of the third ground-engaging component, and (ii) a matrix structure extending from the outer perimeter boundary rim and at least partially across the interior area of the third ground-engaging component at least at the forefoot support area of the third ground-engaging component to define an open cellular construction with plural open cells across the interior area at least at the forefoot support area of the third ground-engaging component, wherein the matrix structure of the third ground-engaging component differs from the matrix structures of the first and second ground-engaging components, and wherein the matrix structure of the second ground-engaging component and the matrix structure of the third ground-engaging component are structured and arranged with respect to the outer perimeter boundary rim of the second ground-engaging component and the outer perimeter boundary rim of the third ground-engaging component, respectively, so that the third ground-engaging component has a forefoot stiffness within ±10% of the forefoot stiffness of the second ground-engaging component, when the forefoot stiffness is measured as Nm/rad.

16. The set of ground-engaging components according to claim 15, further comprising:

a fourth ground-engaging component of a fourth standard size that is two standard sizes larger than the standard size of the third ground-engaging component, wherein the fourth ground-engaging component includes: (i) an outer perimeter boundary rim that at least partially defines an outer perimeter of the fourth ground-engaging component, wherein the outer perimeter boundary rim of the fourth ground-engaging component defines an upper-facing surface and a ground-facing surface opposite the upper-facing surface, and wherein the outer perimeter boundary rim of the fourth ground-engaging component defines an interior area at least at a forefoot support area of the fourth ground-engaging component, and (ii) a matrix structure extending from the outer perimeter boundary rim and at least partially across the interior area of the fourth ground-engaging component at least at the forefoot support area of the fourth ground-engaging component to define an open cellular construction with plural open cells across the interior area at least at the forefoot support area of the fourth ground-engaging component, wherein the matrix structure of the fourth ground-engaging component differs from the matrix structures of the first, second, and third ground-engaging components, and wherein the matrix structure of the third ground-engaging component and the matrix structure of the fourth ground-engaging component are structured and arranged with respect to the outer perimeter boundary rim of the third ground-engaging component and the outer perimeter boundary rim of the fourth ground-engaging component, respectively, so that the fourth ground-engaging component has a forefoot stiffness within ±10% of the forefoot stiffness of the third ground-engaging component, when the forefoot stiffness is measured as Nm/rad.

17. The set of ground-engaging components according to claim 7, wherein the second ground-engaging component is at least two standard sizes larger than the first ground-engaging component, and wherein the set of ground-engaging components further includes:

a third ground-engaging component of a third standard size that is at least two standard sizes larger than the second standard size of the second ground-engaging component, wherein the third ground-engaging component includes: (i) an outer perimeter boundary rim that at least partially defines an outer perimeter of the third ground-engaging component, wherein the outer perimeter boundary rim of the third ground-engaging component defines an upper-facing surface and a ground-facing surface opposite the upper-facing surface, and wherein the outer perimeter boundary rim of the third ground-engaging component defines an interior area at least at a forefoot support area of the third ground-engaging component, and (ii) a matrix structure extending from the outer perimeter boundary rim and at least partially across the interior area of the third ground-engaging component at least at the forefoot support area of the third ground-engaging component to define an open cellular construction with plural open cells across the interior area at least at the forefoot support area of the third ground-engaging component, wherein the matrix structure of the third ground-engaging component differs from the matrix structures of the first and second ground-engaging components, and wherein the matrix structure of the second ground-engaging component and the matrix structure of the third ground-engaging component are structured and arranged with respect to the outer perimeter boundary rim of the second ground-engaging component and the outer perimeter boundary rim of the third ground-engaging component, respectively, so that the third ground-engaging component has a forefoot stiffness within ±10% of the forefoot stiffness of the second ground-engaging component, when the forefoot stiffness is measured as Nm/rad.

18. The set of ground-engaging components according to claim 17, further comprising:

a fourth ground-engaging component of a fourth standard size that is at least two standard sizes larger than the standard size of the third ground-engaging component, wherein the fourth ground-engaging component includes: (i) an outer perimeter boundary rim that at least partially defines an outer perimeter of the fourth ground-engaging component, wherein the outer perimeter boundary rim of the fourth ground-engaging component defines an upper-facing surface and a ground-facing surface opposite the upper-facing surface, and wherein the outer perimeter boundary rim of the fourth ground-engaging component defines an open space interior area at least at a forefoot support area of the fourth ground-engaging component, and (ii) a matrix structure extending from the outer perimeter boundary rim and at least partially across the interior area of the fourth ground-engaging component at least at the forefoot support area of the fourth ground-engaging component to define an open cellular construction with plural open cells across the interior area at least at the forefoot support area of the fourth ground-engaging component, wherein the matrix structure of the fourth ground-engaging component differs from the matrix structures of the first, second, and third ground-engaging components, and wherein the matrix structure of the third ground-engaging component and the matrix structure of the fourth ground-engaging component are structured and arranged with respect to the outer perimeter boundary rim of the third ground-engaging component and the outer perimeter boundary rim of the fourth ground-engaging component, respectively, so that the fourth ground-engaging component has a forefoot stiffness within ±10% of the forefoot stiffness of the third ground-engaging component, when the forefoot stiffness is measured as Nm/rad.

* * * * *